US006878513B2

(12) United States Patent
Yanagi et al.

(10) Patent No.: US 6,878,513 B2
(45) Date of Patent: Apr. 12, 2005

(54) MODIFIED GELATIN, AND SILVER HALIDE PHOTOGRAPHIC EMULSION AND PHOTOGRAPHIC LIGHT-SENSITIVE MATERIAL USING THE SAME

(75) Inventors: Terukazu Yanagi, Minami-Ashigara (JP); Mamoru Sakurazawa, Minami-Ashigara (JP); Naohiro Takeda, Minami-Ashigara (JP); Yoichi Maruyama, Minami-Ashigara (JP); Katsuyuki Takada, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 38 days.

(21) Appl. No.: 10/026,843

(22) Filed: Dec. 27, 2001

(65) Prior Publication Data

US 2002/0155398 A1 Oct. 24, 2002

(30) Foreign Application Priority Data

| | | |
|---|---|---|
| Dec. 27, 2000 | (JP) | 2000-397237 |
| Mar. 19, 2001 | (JP) | 2001-078191 |
| Mar. 30, 2001 | (JP) | 2001-102468 |
| Oct. 5, 2001 | (JP) | 2001-310289 |

(51) Int. Cl.[7] ..... G03C 1/005; G03C 1/494

(52) U.S. Cl. ..... 430/640; 430/217; 430/230; 430/231; 430/232; 430/247; 430/642; 106/31.54

(58) Field of Search ..... 430/640, 642, 430/567, 106, 217, 230, 231, 232, 247, 537, 203, 588, 604, 605, 944, 569; 530/350, 435; 516/430; 106/31.54

(56) References Cited

U.S. PATENT DOCUMENTS

| | | | | |
|---|---|---|---|---|
| 5,213,959 A | | 5/1993 | Saitou et al. | |
| 5,362,601 A | * | 11/1994 | Miyake | 430/203 |
| 5,378,598 A | | 1/1995 | Bagchi et al. | |
| 5,426,020 A | | 6/1995 | Bagchi et al. | |

FOREIGN PATENT DOCUMENTS

| | | |
|---|---|---|
| JP | 3-37643 | 2/1991 |
| JP | 5-113618 | 5/1993 |
| JP | 11-237704 | 8/1999 |

* cited by examiner

*Primary Examiner*—Robert A. Wax
*Assistant Examiner*—Rbert B Mondesi
(74) *Attorney, Agent, or Firm*—Sughrue Mion, PLLC

(57) ABSTRACT

A modified gelatin obtained by reacting (A) a gelatin and (B) a compound which contains a nitrogenous aromatic ring having a mercapto group to form covalent bond with a reactive group in the gelatin, an introduction amount of the compound in the gelatin being $1.0\times10^{-6}$ mol to $2.0\times10^{-3}$ mol per 100 g of the gelatin.

4 Claims, No Drawings

MODIFIED GELATIN, AND SILVER HALIDE PHOTOGRAPHIC EMULSION AND PHOTOGRAPHIC LIGHT-SENSITIVE MATERIAL USING THE SAME

CROSS-REFERENCE TO RELATED APPLCATIONS

This application is based upon and claims the benefit of priority from the prior Japanese Patent Applications No. 2000-397237, filed Dec. 27, 2000; No. 2001-078191, filed Mar. 19, 2001; No. 2001-102468, filed Mar. 30, 2001; and No. 2001-310289, filed Oct. 5, 2001, the entire contents of all of which are incorporated herein by reference.

BACKGROUND OF THE INVENTION

1. Field of the Invention

The present invention relates to a modified gelatin, more especially a gelatin modified by a compound containing a nitrogenous aromatic ring. The present invention further relates to a silver halide photographic emulsion, which improves aggregation stability of a silver halide photographic emulsion containing the modified gelatin and has a high sensitivity and good graininess, and a silver halide photographic light-sensitive material using the same.

2. Description of the Related Art

Gelatin has been used for a long time in the photographic chemical industry, and performs various functions in photographic systems. This is because gelatin has excellent property such as an excellent protective colloidal property, sol-gel conversion property, ion permeability, moderate moisture absorption property and water-holding property, and simultaneously has a chemical reaction site, and thereby it simultaneously has a binding ability with intermolecular bridges and photographically useful groups. However, it is required to further improve the property of gelatin. As a method for improvement, there is a method of substituting a part of gelatin by a synthetic macromolecule and a method of adding modification (binding of a photographically useful group) to the gelatin itself. A general method of modification of gelatin is a method of modification by using an amine portion or carboxylic portion of a pendant or branch of a principal peptide chain of a gelatin, and various methods have been proposed. For example, various gelatin-modifying methods are proposed in "Glue and Gelatin" edited by Yoshihiro Abiko, et al., published by Maruzen (1987), U.S. Pat. No. 4,978,607 and Jpn. Pat. Appln. KOKAI Pub. No. (hereinafter referred to as "JP-A-") 6-73341.

With respect to tabular silver halide grains, a method of preparing and technique of using thereof have already been disclosed in U.S. Pat. Nos. 4,434,226, 4,439,520, 4,414,310, 4,433,048, 4,414,306, and 4,459,353. Using tabular grains having a high aspect ratio increases the specific surface of tabular grains, and thus it is possible to take effective advantage of the above tabular grains. Namely, by using tabular grains each having a larger surface area to absorb more sensitizing dye, it is possible to increase the absorption amount of light per grain to achieve high sensitivity. As described above, though a high sensitivity can be obtained by using tabular grains each having a larger surface area to absorb more sensitizing dye, it causes a great problem of aggregation. The term "aggregation" means a phenomenon in which two or more tabular grains aggregate and principal planes of the tabular grains cohered to form secondary grains. Aggregation is more likely to occur when the tabular grains have a higher aspect ratio, a greater absorption dye amount, namely, when the coating rate of the grain surfaces with the absorbed dye is high. This aggregation causes deterioration of graininess, decrease in density after development, and deterioration of photographic performance such as increase of fog.

Many studies have been made so far with respect to prevention of aggregation of tabular grains. For example, Pierre Glafkides, "Chimie et Physique Photographiques" (5th ed., l'Usine, Paris, 1987) describes that it is possible to reduce aggregation by strongly stirring an emulsion during formation of grains, raising the temperature, diluting a silver nitrate solution, or increasing the gelatin content to some extent. However, demand for suitability for preparation on a high-sensitivity silver halide emulsion is more increasing. In particular, conventional emulsions containing tabular grains having a higher aspect ratio to obtain high sensitivity cannot achieve a fully satisfactory result.

As another means for improving aggregation of tabular grains, it has been studied to improve the protective colloidal property of gelatin. For example, European Patent No. 603804 discloses an acid-processed gelatin whose chain lengths are extended. Since an acid-processed gelatin has a more low-molecular-weight component than that of alkali-processed gelatin, the patent is aimed at reducing this defect by bridging gelatin molecular chains. In the patent, a cross linking agent for bridging amino groups of gelatin, such as a bis-(vinyl sulfonyl) compound, is used as a cross linking agent. Acid-processed gelatin has a defect that a preferable photographic property cannot be obtained, since it has a higher reduction property and includes more impurities than those of alkali-processed gelatin in formation of silver halide emulsion grains and chemical sensitization thereof. JP-A-5-113618 discloses a technique of preventing aggregation of tabular silver halide emulsion containing gelatin containing at least 12% of macromolecular component, and JP-A-11-237704 discloses a method of preparing tabular silver halide emulsion prepared under the presence of gelatin containing at least 30% of macromolecular component having a molecular weight of 280,000 or more.

As a method of inhibiting aggregation of silver halide grains by using modified gelatin, a gelatin which is covalent-bonded with latex (JP-A-7-152103) has been proposed.

However, although these techniques show certain effects on prevention of aggregation of tabular grains, the effects are still insufficient.

In the meantime, it is known that a mercaptoazole group strongly adsorbs to silver halide and improves keeping property, which is described, for example, in T. H. James "THE THEORY OF THE PHOTOGRAPHIC PROCESS Fourth Edition" published by Macmillan Inc., New York, Chapter 1, section III (1977). JP-A-3-37643 and JP-A-4-226449, etc. disclose improving keeping property of a silver halide photographic light-sensitive material by introducing a mercaptoazole group into gelatin. However, according to the inventors of the present invention, the modified gelatin in the embodiment of JP-A-3-37643 causes a problem of deterioration of graininess in tabular grains, which is strongly required to be improved.

BRIEF SUMMARY OF THE INVENTION

The first object of the present invention is to provide a modified gelatin which can inhibit aggregation of tabular silver halide emulsion. The second object of the present invention is to provide a silver halide photographic emulsion and a silver halide photographic light-sensitive material including the same, which have a high sensitivity, an excellent graininess, and a low photographic property change due to lapse of time, by using the above gelatin into which modifying group is introduced for the silver halide photographic light-sensitive material.

As a result of diligent research to solve the above problem, the inventors of the present invention have found that it is possible to provide an excellent photographic light-sensitive material by using a modified gelatin into which a modifying group containing a nitrogenous aromatic ring having a mercapto group is introduced at a predetermined ratio, and made the present invention.

(1) A modified gelatin obtained by reacting (A) a gelatin and (B) a compound which contains a nitrogenous aromatic ring having a mercapto group to form covalent bond with a reactive group in the gelatin, an introduction amount of the compound in the gelatin being $1.0\times10^{-6}$ mol to $2.0\times10^{-3}$ mol per 100 g of the gelatin.

(2) A modified gelatin represented by the following formula (I):

$$\text{Gel-L}^1\text{-(L}^2\text{-Z-SH)}_n \quad \text{(I)}$$

Where Gel represents a gelatin, $L^1$ represents a group selected from —C(=O)O—, —NH—, —N=, —N<, —O—, —S—, —NH—C(=$NH_2^+$)NH— and —NH—C(=NH)NH— existing in the gelatin, $L^2$ represents a divalent or trivalent coupling group, Z represents a nitrogenous aromatic heterocycle group, n is 1 or 2, and the introduction amount of the modifying group represented by -$L^2$-Z-SH is $1.0\times10^{-6}$ mol to $2.0\times10^{-3}$ mol per 100 g of the gelatin.

(3) The modified gelatin of (2), represented by the following formula (II).

(II)

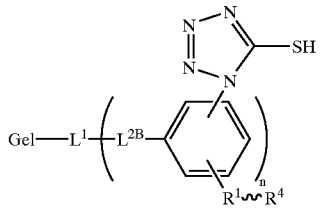

Where Gel represents a gelatin, $L^1$ represents a group selected from —C(=O)O—, —NH—, —N=, —N<, —O—, —S—, —NH—C(=$NH_2^+$)NH— and —NH—C(=NH)NH— existing in the gelatin, $L^{2B}$ represents a divalent or trivalent coupling group, each of $R^1$, $R^2$, $R^3$ and $R^4$ independently represents a hydrogen atom or a substituent, n is 1 or 2, and the introduction amount of the modifying group indicated in parentheses is $1.0\times10^{-6}$ mol to $2.0\times10^{-3}$ mol per 100 g of the gelatin.

(4) The modified gelatin of any one of (1) to (3), satisfying the following requirement (C):

(C) the gelatin has a molecular weight distribution obtained by measuring on the basis of the PAGI method, wherein a high-molecular-weight component having a molecular weight of about 2,000,000 or more is 3% to 30%, and the low-molecular-weight component having a molecular weight of about 100,000 or less is 55% or less.

(5) A silver halide photographic emulsion, wherein at least 50% of the total projected area of grains is occupied by silver halide grains satisfying the following requirements (a) to (d), and the emulsion containing the modified gelatin of any one of (1) to (4):

(a) having parallel principal planes being (111) faces;

(b) having an aspect ratio being 2 or more;

(c) including at least 10 dislocation lines per grain; and (d) being tabular silver halide grains formed of silver iodobromide or silver chloroiodobromide having a silver chloride content of less than 10 mol %.

(6) A silver halide photographic emulsion, wherein at least 50% of the total projected area of grains is occupied by silver halide grains satisfying the following requirements (a), (d) and (e), and the emulsion containing the modified gelatin of any one of (1) to (4):

(a) having parallel principal planes being (111) faces;

(d) being tabular silver halide grains formed of silver iodobromide or silver chloroiodobromide having a silver chloride content of less than 10 mol %; and (e) being hexagonal silver halide grains having at least one epitaxial junction per grain on respective corner portions and/or side face portions and/or principal plane portions.

(7) A silver halide photographic emulsion, wherein at least 50% of the total projected area of grains are occupied by tabular silver halide grains having an equivalent circle diameter of 0.6 μm or more, grain thickness of less than 0.2 μm, and parallel principal planes being (111) faces, the emulsion containing the modified gelatin of any one of (1) to (4).

(8) The silver halide photographic emulsion of (7), wherein the grain thickness of the tabular silver halide grains is 0.1 μm or less.

(9) The silver halide photographic emulsion of (7) or (8), wherein principal planes of the tabular silver halide grains are controlled to be (111) faces under the presence of at least one kind of crystal-habit control agent.

(10) The silver halide photographic emulsion of (9), wherein the crystal-habit control agent is a compound represented by the following formula (III), (IV) or (V):

(III)

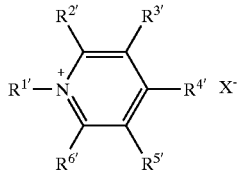

In formula (III), $R^{1'}$ represents an alkyl group, alkenyl group or aralkyl group, each of $R^{2'}$, $R^{3'}$, $R^{4'}$, $R^{5'}$, and $R^{6'}$ independently represents a hydrogen atom or a substituent, each pair of $R^{2'}$ and $R^{3'}$, $R^{3'}$ and $R^{4'}$, $R^{4'}$ and $R^{5'}$, and $R^{5'}$ and $R^{6'}$ may be cyclocondensed independently, with the proviso that at least one of $R^{2'}$, $R^{3'}$, $R^{4'}$, $R^{5'}$ and $R^{6'}$ represents an aryl group, and $X^-$ represents a pair anion.

(IV)

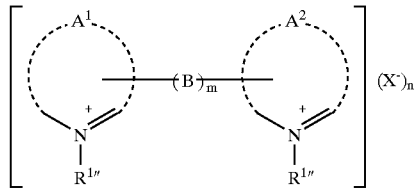

(V)

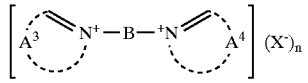

In formulae (IV) and (V), each of $A^1$, $A^2$, $A^3$ and $A^4$ independently represents a nonmetallic atom group for completing a nitrogenous heterocycle, B represents a divalent coupling group, m represents 0 or 1, each of $R^{1''}$ and $R^{2''}$ independently represents an alkyl group, $X^-$ represents an anion, and n represents 0, 1 or 2, with the proviso that n is 0 or 1 when the formula (IV) or (V) forms an intramolecular salt.

(11) A silver halide photographic emulsion, wherein at least 50% of the total projected area of grains are occupied by silver halide grains satisfying the following requirements (b), (d) and (g), and the emulsion containing the modified gelatin of any one of (1) to (4):

(b) having an aspect ratio being 2 or more;

(d) being tabular silver halide grains formed of silver iodobromide or silver chloroiodobromide having a silver chloride content of less than 10 mol %; and (g) having parallel principal planes being (100) faces.

(12) A silver halide photographic emulsion, wherein at least 50% of the total projected area of grains are occupied by silver halide grains satisfying the following requirements (b), (h) and (i), and the emulsion containing the modified gelatin of any one of (1) to (4):

(b) having an aspect ratio being 2 or more;

(h) having parallel principal planes being (111) faces or (100) faces; and (i) being tabular silver halide grains containing at least 80 mol % of silver chloride.

(13) A silver halide photographic emulsion, wherein at least 50% of the total projected area of grains are occupied by silver halide grains satisfying the following requirements (j), (k) and (m), and the emulsion containing the modified gelatin of any one of (1) to (4):

(j) having an equivalent circle diameter being 2 $\mu$m or more;

(k) having an aspect ratio being 10 or more; and (m) having an average AgI content of each grain being 5 mol % or more.

(14) A silver halide photographic light sensitive material, comprising at least one light-sensitive layer containing the silver halide photographic emulsion of any one of (5) to (11) on a support.

(15) The silver halide photographic light-sensitive material of (14), wherein at least 50% of the total projected area of silver halide grains contained in the light-sensitive layer further satisfy the following requirement (j), and at least 80% of the total projected area of the silver halide grains contained in the light-sensitive layer are occupied by grains having no dislocation lines in an area ranging from the center of grain projected portion to 50% of the whole area of the grain projected portion:

(j) having an equivalent circle being 2 $\mu$m or more.

(16) The silver halide photographic light-sensitive material of (14), wherein at least 50% of the total projected area of the silver halide grains contained in the light-sensitive layer are prepared by a method of preparation comprising the step of forming grains while rapidly generating iodide ions by using an iodide-ion releasing agent.

(17) The silver halide photographic light-sensitive material of (14), wherein at least 50% of the total projected area of the silver halide grains contained in the light-sensitive layer are prepared by a method of preparation comprising the step of adding silver iodide fine grains into a reaction vessel performing formation of grains at the time of formation of grains. (18) The silver halide photographic light-sensitive material of (17), wherein the silver iodide fine grains are formed outside the reaction vessel forming silver halide grains.

(19) The silver halide photographic light-sensitive material of (14), wherein, in at least 50% of the total projected area of the silver halide grains contained in the light-sensitive layer, formation of grains occupying at least 30% of the total silver amount of a grain is performed by adding silver halide fine grains formed in another vessel into the vessel containing the silver halide grains.

(20) The silver halide photographic light-sensitive material of (14), wherein at least 50% of the total projected area of the silver halide grains contained in the light-sensitive layer is reduction-sensitized emulsion.

(21) A silver halide photographic light-sensitive material, comprising the modified gelatin of any one of (1) to (4).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

A method of carrying out the present invention and embodiments of the present invention will now be described hereinafter. In this specification, the symbol "-" between numerical values is used as having the meaning of including the numerical values before and after the symbol as the lower limit value and the upper limit value respectively.

The present invention is based on the knowledge that it is possible to obtain a gelatin effective for preparing an excellent photographic light-sensitive material, by introducing a modifying group containing a nitrogenous aromatic ring having a mercapto group into the gelatin at a specific rate.

The kind of the gelatin (A) used in the present invention is not specifically limited. Skin and bones, etc. of pigs and cattle are mentioned as main supply source of gelatin. Preferable gelatin is produced from cattle bones. Acid processing and alkali (lime) processing, etc. are mentioned as methods of processing thereof. Although both of the above processing can be used as a processing method, a more preferable gelatin is an alkali (lime) processed gelatin. The gelatin may be modified by another functional group, if any chemical reactive group remains in the gelatin. Examples of such modified gelatin are water-soluble chain-extended gelatin, phthalated gelatin, succinated gelatin, trimellitated gelatin, pyromellitated gelatin, and enzyme-processed low-molecular weight gelatin (molecular weight 2000–100,000), which are prepared by use of a bis-(vinylsulfoniy) compound or a compound activating a carboxyl group so as to cross-link gelatin. A mixture of two or more kinds of these gelatins may be used.

The ratio of gelatin components, i.e., the molecular weight distribution in the present invention is measured by gel permeation chromatography (to be referred to as "GPC" hereinafter) on the basis the PAGI method which is internationally determined. Details of GPC are described in, e.g., Takashi Ohno, Yukihiro Kobayashi, and Shinya Mizusawa, "The Journal of Japan Photographic Society", Vol. 47, No. 4, 1984, pp. 237 to 247.

The measurement conditions of the molecular weight distribution of gelatin according to the present invention are presented below.

Measurement Conditions

Column: Shodex Asahipak GS-620 7G (8 mm I.D.×500 mm)×2

Guard column: Shodex Asahipack GS-1G 7B

Eluting solution: A solution mixture of the same quantity of 0.1 millimole/litter potassium dihydrogenphosphate and 0.1 millimole/litter sodium dihydrogenphosphate
Flow rate: 1.0 milliliter/min
Column temperature: 50° C.
Detection: UV 230 nm
Sample concentration: 0.2 mass %
Implantation amount: 100 maicrolitter On a GPC curve obtained by plotting the retention time on the abscissa and the absorbance on the ordinate, the peak of the exclusion limit first appears, and then the peaks of the β and α components of gelatin appear. The curve forms a long tail as the retention time prolongs.

In the present invention, the ratio occupied by a high-molecular-weight component having a molecular weight of about 2,000,000 or more is obtained by calculating the ratio which the area of the peak of the exclusion limit accounts for in the whole area. More specifically, a perpendicular is drawn to the abscissa from a minimum point which appears on the GPC curve when the retention time is about 17 min. The ratio which the area of a portion (high-molecular-weight component) on the high-molecular-weight side of the perpendicular accounts for in the whole area is calculated. Also, the ratio occupied by a low-molecular-weight component having a molecular weight of about 100,000 or less is obtained by calculating the ratio which the a and subsequent components account for in the whole area. More specifically, a perpendicular is drawn to the abscissa from a minimum point which appears on the GPC curve between the β and α component peaks when the retention time is about 23 min. The ratio which the area of a portion (low-molecular-weight component) on the low-molecular-weight side of the perpendicular accounts for in the whole area is calculated.

To achieve the effect of the present invention, it is favorable that the high-molecular-weight component having a molecular weight of about 2,000,000 or more be 3% to 30%, and the low-molecular-weight component having a molecular weight of about 100,000 or less be 55% or less. If the high-molecular-weight component is more than 30%, the filtering characteristics abruptly worsen. Also, if the low-molecular-weight component is more than 55% and/or the high-molecular-weight component is less than 3%, the effect of the present invention is not well achieved. To achieve the effect of the present invention, it is particularly favorable that the high-molecular-weight component having a molecular weight of about 2,000,000 or more be 5% to 15%, and the low-molecular-weight component having a molecular weight of about 100,000 or less be 50% or less.

Manufacturing methods of the gelatin having high-molecular-weight of the present invention are roughly classified into the following two methods.

1. Methods in which Gelatin is not Crosslinked

For example, the following methods are used.

Manufacturing method (i) In the extracting operation of the gelatin, a gelatin extract in the extraction late stage is used, and a gelatin extract in the extraction initial stage is excluded.

Manufacturing method (ii) In the above manufacturing method, the processing temperature is less than 40° C. in the manufacturing steps from extraction of the gelatin to drying.

Manufacturing method (iii) A gelatin gel is dialyzed with cold water (15° C.). Refer to [The Journal of Photographic Science, Vol. 23, p. 33 (1975)].

Manufacturing method (iv) A differential method using isopropyl alcohol. Refer to Discussions of the Faraday Society, Vol. 18, p. 288 (1954).

The gelatin of the present invention can be obtained by using the above manufacturing methods singly or in combination.

2. Methods Using Gelatin Crosslinking Agent.

Gelatin used in the present invention is more preferably crosslinked to control its molecular weight distribution. Crosslinking methods are a method of crosslinking gelatin molecules by enzyme, and a method of adding a crosslinking agent to form chemical bonds between gelatin molecules, thereby crosslinking the gelatin molecules.

As a representative method of the method using enzyme according to the present invention, gelatin crosslinked by transglutaminase will be described below. Transglutaminase enzyme can crosslink gelatin by a function of catalyzing an acyl transition reaction between a γ-carboxyamide group of a glutamine residue of gelatin as protein and various primary amines. The orinins of the transglutaminase includes animals, vegetables, and bacterias. Transglutaminase derived from animal is extracted from the liver of a mammal organ such as a guinea pig or from blood.

Transglutaminase derived from vegetable is extracted from peas. Transglutaminase derived from bacteria is extracted from ray fungus. In the present invention, transglutaminase originated from anything can be preferably used provided that the transglutaminase shows transglutaminase activity.

Transglutaminase used in the present invention can be favorably synthesized by any of a method of Clark et al. (Archives of Biochemistry and Biophysics, 79, 338 (1959)), a method of Connei et al. (J. Bilogical Chemistry, 246 (1971)), a method described in JP-A-4-207149, and a method described in JP-A-6-30770. An example of such transglutaminase is AKUTEBA (trade name: manufactured by Ajinomoto Co., Inc.)

Transglutaminase activity used in the present invention can be measured by reacting benzyloxycarbonyl L glutaminylglycine and hydroxyamine and obtaining the amount of the produced hydroxamic acid.

Transglutaminase activity found by this measurement to produce $1\times10^{-6}$ mol of hydroxamic acid per min is one unit. Transglutaminase used in the present invention is preferably added in an amount which produces $1\times10^{-6}$ mol or more of hydroxamic acid per g of gelatin, although this amount changes in accordance with gelatin used, thereby controlling the molecular weight distribution.

In the method which crosslinks gelatin by using a crosslinking agent, all crosslinking agents conventionally known as gelatin hardeners can be used. Representative compounds are as follows.

A. Inorganic Crosslinking Agents (Inorganic Film Hardeners)

Cationic chromium complexes; ligands of the complexes are a hydroxyl group, oxalic acid group, citric acid group, malonic acid group, lactate, tartrate, succinate, acetate, formate, sulfate, chloride, and nitrate.

Aluminum salt; particularly sulfate, potassium alum, and ammonium alum. These compounds crosslink carboxyl groups of gelatin.

B. Organic Crosslinking Agents (Organic Hardening Agents)

1. Aldehyde-based crosslinking agent; Formaldehyde is most generally used as this kind of agent. Further, it is also possible to achieve effective bridging by dialdehyde such as glyoxal and succinaldehyde, in particular, glutaraldehyde is effective. Diglycoaldehyde, various aromatic dialdehyde, dialdehyde starch and dialdehyde of plant gum can be also used for bridging of the present invention.

2. N-methylol compounds and other protected aldehyde crosslinking agents; N-methylol compounds obtained by condensation between formaldehyde and various aliphatic straight-chain or cyclic amide, urea, or nitrogenous heterocycle. Specific examples thereof are 2,3-dihydroxyoxane, acetic ester of dialdehyde and hemiacetal thereof, and 2,5-methoxytetrahydrofuran.

3. Ketone crosslinking agents; compounds of diketone and quinone. Examples of well-known diketone are 2,3-butanedione, and $CH_3COCOCH_3$. p-benzoquinone is well known as a kinone.

4. Sulfonate ester and sulfonyl halide; Typical compounds are bis(sulfonylchloride) and bis(sulfonylfluoride).

5. Activated halogen compounds; compounds having at least two activated halogen atoms. Typical compounds are simple bis-α-chloro or bis-α-bromo derivative of ketone, ester and amide, bis(2-chloroethylurea), bis(2-chloroethyl) sulfone, and phosphoramidichalide.

6. Epoxides; Typical compound is butadiene dioxide.

7. Active olefin; Many compounds having two or more double bonds, in particular, having nonsubstituted vinyl group activated by an adjacent electron attractive group are effective as crosslinking agent for gelatin. Examples of such compounds are divinylketone, resorcinol bis(vinylsufonate), 4,6-bis(vinylsulfonate), 4,6-bis(vinylsulfonyl)-m-xylene, bis(vinylsulfonylalkyl)ether or amine, 1,3,5-triacrylylhexahydro-s-triazine, diacrylamide, and 1,3-bis (acrylyl)urea.

8. s-triazine-based compounds; compounds represented by the following formula (H-I).

(H-I)

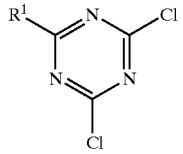

Where $R^1$ represents a hydroxyl group, —OM group (M is a monovalent metal atom), alkyl group of carbon number 1–10 (such as methyl, ethyl, 2-ethylhexyl), —$N(R^2)(R^3)$ group (each of $R^2$ and $R^3$ represents an alkyl group of carbon number 1–10 or aryl group of carbon number 6–15, and they may be the same group or different groups), —$NHCOR^4$ ($R^4$ represents a hydrogen atom, alkyl group of carbon number 1–20, aryl group of carbon number 6–20, alkylthio group of carbon number 1–20, or arylthio group of carbon number 6–20), or alkoky group of carbon number 1–20. Further, the cyanuric chloride hardening agent represented by the formula (H-I) is detailed in Jpn. Pat. Appln. KOKOKU Pub. Nos. (hereinafter referred to as "JP-B-") 47-6151, 47-33380, 54-25411, and JP-A-56-130740. Furthermore, the compounds described in JP-B-53-2726, JP-A-50-61219 and 56-27135 which have structures similar to that of the compounds of the formula (H-I) are also useful for the present invention.

9. Vinylsulfone-based compounds; compounds represented by the following formula (H-II).

$$X^1—SO_2\text{-}L\text{-}SO_2—X^2 \quad \text{(H-II)}$$

Where each of $X^1$ and $X^2$ is —CH═$CH_2$ or —$CH_2CH_2Y$ and may be the same or different. Y represents a group (for example, halogen atom, sulfonyloxy or monoester sulfate) which is substituted by a nucleophilic group or can be eliminated in the form of HY by a base. L is a divalent coupling group, which may have been substituted. The vinylsulfone-based hardening agent represented by the formula (H-II) is detailed in JP-B-47-24259, 50-35807, and JP-A-49-24435, 53-41221 and 59-18944, for example.

10. Carbamoyl ammonium salt; compounds represented by the following formula (H-III).

(H-III)

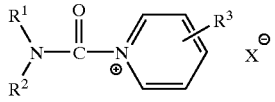

Where each of $R^1$ and $R^2$ represents an alkyl group of carbon number 1–10 (for example, methyl group, ethyl group, and 2-ethylhexyl group), aryl group of carbon number 6–15 (for example, phenyl group, naphthyl group), or aralkyl group of carbon number 7–15 (for example, benzyl group and phenethyl group), and they may be the same group or different groups. Further, $R^1$ and $R^2$ are preferably bound to each other to form a heterocycle with a nitrogen atom. $X^-$ represents an anion. The carbamoyl ammonium salt-based hardening agent represented by the general formula (H-III) is detailed in JP-B-56-12853, 58-32699, and JP-A-49-51945, 51-59625 and 61-9641.

$R^3$ represents a substituent such as a hydrogen atom, halogen atom, acylamide group, nitro group, carbomoyl group, ureide group, alkoky group of carbon number 1–10 (such as methoxy group and ethoxy group), alkyl group of carbon number 1–10 (such as methyl group and n-butyl group), aryl group of carbon number 6–15 (such as phenyl group, and naphthyl group), or aralkyl group (such as benzyl group).

11. Compounds represented by the following formula (H-IV).

(H-IV)

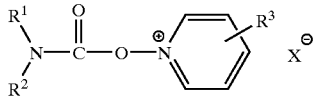

The definitions of $R^1$, $R^2$, $R^3$ and $X^-$ are entirely the same as those in the formula (H-III). These compounds are detailed in Belgian Patent No. 825,726.

12. Amidinium salt-based compounds; compounds represented by the following formula (H-V).

(H-V)

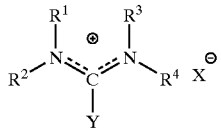

Each of $R^1$, $R^2$, $R^3$ and $R^4$ is an alkyl group of carbon number 1–20, aralkyl group of carbon number 6–20, or aryl group of carbon number 6–20, and they may be the same group or different groups. Y represents a group which can be eliminated when a compound represented by the formula (H-V) reacts with a nucleophilic reagent, and preferable examples of the group are halogen atom, sulfonyloxy group, and 1-pyridiniumyl group, etc. $X^-$ represents an anion. The amidinium salt-based hardening agents represented by the formula (H-V) are detailed in JP-A-60-225148.

13. Carbodiimide-based compounds; compounds represented by the following formula (H-VI).

$$R^1—N=C=N—R^2 \quad \text{(H-VI)}$$

Where $R^1$ represents an alkyl group of carbon number 1–10 (such as methyl group and ethyl group), cycloalkyl group of carbon number 5–8, alkokyalkyl group of carbon number 3–10, or aralkyl group of carbon number 7–15. $R^2$ represents a group defined as $R^1$. These carbodiimide-based hardening agents are detailed in JP-A-51-126125 and 52-48311.

14. Lysinium base compounds; compounds represented by the following formula (H-VII).

(H-VII)

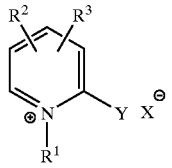

Where $R^1$ represents an alkyl group of carbon number 1–10, aryl group of carbon number 6–15, or aralkyl group of carbon number 7–15. These groups may have been substituted. Each of $R^2$ and $R^3$ represents a substituent such as a hydrogen atom, halogen atom, acylamide group, nitro group, carbomoyl group, ureide group, alkoky group, alkyl group, alkenyl group, aryl group and aralkyl group, and they may represent the same group or different groups. Further, $R^2$ and $R^3$ are preferably bound to each other to form a condensed ring with a pyridinium ring skeleton. Y represents a group which can be eliminated when a compound represented by the formula (H-VII) reacts with a nucleophilic reagent. $X^-$ represents an anion. These pyrisinium base hardening agents are detailed in JP-B-58-50699, JP-A-57-44140 and 57-46538.

15. Pyridinium salt-based compounds; compounds represented by the following formula (H-VIII).

(H-VIII)

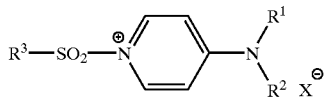

Where the definitions of $R^1$ and $R^2$ are entirely the same as those of $R^1$ and $R^2$ in the formula (H-III). $R^3$ represents an alkyl group of carbon number 1–10, aryl group of carbon number 6–15 or aralkyl group of carbon number 7–15. $X^-$ represents an anion. Pyridinium salt-based hardening agents represented by the formula (H-VIII) are detailed in JP-A-52-54427.

Besides the compounds represented by the formula (H-I) to formula (H-VIII), compounds preferable as hardening agents to be used in the present invention are described in JP-A-50-38540, 52-93470, 56-43353 and 58-113929 and U.S. Pat. No. 3,321,313.

Specific examples of compounds used in the present invention are mentioned in classes as follows. However, the present invention is not limited to the examples.

(H-I-1)

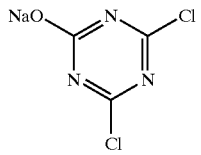

-continued (H-I-2)

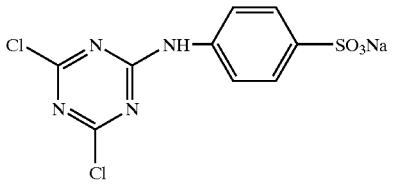

(H-II-1)

$CH_2{=}CHSO_2CH_2SO_2CH{=}CH_2$ (H-II-2)

$CH_2{=}CHSO_2CH_2OCH_2SO_2CH{=}CH_2$ (H-II-3)

$CH_2{=}CHSO_2CHSO_2CH{=}CH_2$

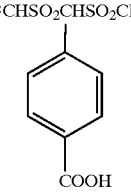

(H-II-4)

$CH_2{=}CHSO_2CH_2CONH{-}(CH_2)_2{-}NHCOCH_2SO_2CH{=}CH_2$ (H-II-5)

$CH_2{=}CHSO_2CH_2CONH{-}(CH_2)_3{-}NHCOCH_2SO_2CH{=}CH_2$ (H-III-1)

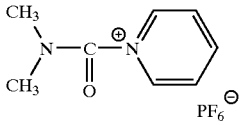

(H-III-2)

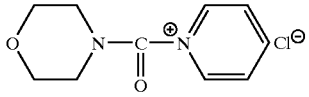

(H-III-3)

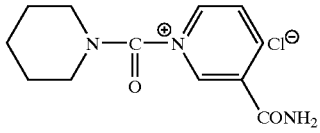

(H-III-4)

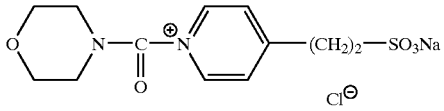

(H-IV-1)

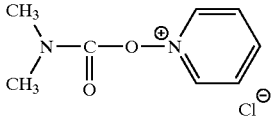

(H-IV-2)

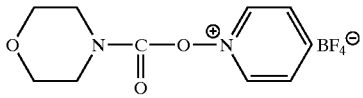

(H-V-1)

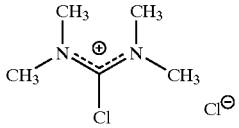

(H-VI-1)

$C_2H_5{-}N{=}C{=}N{-}(CH_2)_3{-}\overset{\oplus}{N}(CH_3)_3$

-continued (H-VI-2)

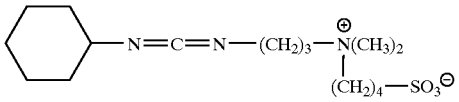

(H-VI-3)

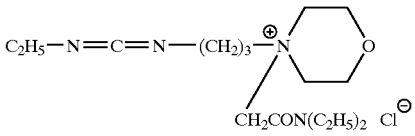

(H-VII-1)

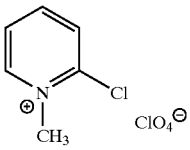

(H-VIII-1)

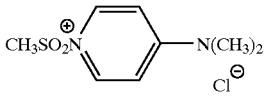

In preparation of gelatin having high molecular weight used for the emulsion of the present invention, any of the crosslinking agent mentioned above is added to a gelatin solution to cause bridging between gelatin molecules. The conditions for such addition vary according to the crosslinking agents. The conditions for reaction can be determined by measuring the molecular weight distribution of gelatin by a GPC method with a certain reaction temperature and reaction time set. When performing such measurement, it is possible to track the progress of bridging by measuring the viscosity of the gelatin solution. Although it is desirable to react all the added crosslinking agent with the gelatin solution, if a part of the crosslinking agent remains unreacted, it is possible to remove the remaining crosslinking agent by ultrafiltration of the gelatin solution after bridging reaction. The molecular weight distribution of the gelatin of the present invention can be controlled by adjusting the conditions for bridging such as the addition amount of the crosslinking agent, and the temperature, time and pH of the bridging reaction.

As a gelatin of a high molecular weight of the present invention, a gelatin bridged by any one of the above crosslinking agents or a combination of two or more kinds of the crosslinking agents can be preferably used. Preferable gelatins are gelatins bridged by a s-triazine-based compound represented by the formula (H-I), vinylsulfone-based compound represented by the formula (H-II), carbamoyl ammonium salt compound represented by the formula (H-III) or carbodiimide-based compound represented by the formula (H-VI). In particular, vinylsulfone-based compounds represented by the formula (H-II) are preferable in that they have little effects on the photographic property.

Both of alkali-processed gelatin and acid-processed gelatin can be used as an original gelatin used for preparation of the gelatin of high molecular weight of the present invention. Alkali-processed gelatin is more preferable in that it has less impurity content which have an adverse influence on the photographic property. In particular, it is preferable to use alkali-processed gelatin having been subjected to deionization or ultrafiltration to remove impurity ions and impurities. Further, alkali-processed gelatin is also preferable as an original gelatin for bridged gelatin which is preferably used in the present invention.

U.S. Pat. No. 5,318,889 discloses a gelatin which have a high molecular weight by bridging acid-processed gelatin by a vinylsulfone compound. The molecular weight distribution of the gelatin disclosed in the patent does not reach the molecular weight distribution of the gelatin of the present invention. However, it has already been clear that acid-processed gelatin has a defect in the photographic property, such as deterioration in photographic sensitivity, if its high-molecular-weight components are increased to be equal to that of the gelatin of the present invention.

In the present invention, gelatin is modified by using the compound (B) which contains a nitrogenous aromatic ring having a mercapto group to form covalent bond with a reactive group in the gelatin. Specifically, the nitrogenous aromatic ring is a monocyclic or condensed nitrogenous aromatic heterocycle, preferably 5 to 7-membered nitrogenous aromatic heterocycle, and more preferably 5 to 6-membered nitrogenous aromatic heterocycle such as imidazole, pyrazole, triazole, tetrazole, thiazole, oxazole, selenazole, benztriazole, benzthiazole, benzoxazole, benzselenazole, thiadiazole, oxadiazole, naphthothiazole, naphthooxazole, azabenzimidazole, purine, pyridine, pyrazine, pyrimidine, pyridazine, triazine, triazaindene, and tetrazaindene. Further preferable nitrogenous aromatic ring is a 5-membered nitrogenous aromatic heterocycle, specifically, imidazole, pyrazole, triazole, tetrazole, thiazole, oxazole, benztriazole, benzthiazole, benzoxazole, thiadiazole, and oxadiazole. Triazole and tetrazole are especially preferable, and tetrazole is most preferable. The specific compounds which can form covalent bond with a reactive group in the gelatin are compounds having a group which can form a covalent bonding with a reactive group (such as an amino group, carboxyl group, hydroxyl group, and mercapto group) contained in the gelatin or gelatin derivative. The groups which can form the covalent bonding include not only groups directly reacting with the reactive group, but groups reacting after being activated by a condensing agent. Specific examples of such groups which can form covalent bonding will be described later.

In the modified gelatin of the present invention, the introduction amount of a compound, which can form a covalent bonding with a reactive group in the gelatin, into the gelatin is $1.0\times10^{-6}$ mol to $2.0\times10^{-3}$ mol per 100 g of gelatin, preferably $1.0\times10^{-6}$ mol to $1.5\times10^{-3}$ mol, and more preferably $1.0\times10^{-6}$ mol to $1.0\times10^{-3}$ mol. The introduction amount of the above compound limited to the above range permits inhibition of rise in the fog density without reducing the sensitivity of the silver halide photographic light-sensitive material. Further, the gelatin exerts effects of inhibiting aggregation of silver halide grains after lapse of time of dissolution of the emulsion, which improves the problem of deterioration in the photographic property in coating, and permits preparation of a silver halide emulsion excellent in the suitability for preparation.

The modified gelatin of the present invention is preferably represented by the formula (I). The formula (I) will now be described in detail.

In the formula (I), "Gel" represents gelatin. The kinds of the gelatin are as described above in this specification. The gelatin may be modified by a functional group other than the modifying groups in the general formula (I), if the chemical reactive group remains in the gelatin. Examples of such a functional group are water-soluble chain-extended gelatin, phthalated gelatin, succinated gelatin, trimellitated gelatin, pyromellitated gelatin, and enzyme-processed low-molecular weight gelatin (molecular weight 2000–100,000), which are prepared by use of a bis-(vinylsulfoniy) compound or a compound activating a carboxyl group so as to cross-link gelatin. A mixture of two or more kinds of these gelatins may be used.

$L^1$ represents a group selected from —C(=O)O—, —NH—, —N=, —N<, —O—, —S—, —NH—C(=$NH_2^+$)NH— or —NH—C(—NH)NH—, in the reactive groups existing in the gelatin. Specific examples of the chemical reactive groups contained in the gelatin molecules are groups derived from an amino group of a side chain of lysine, hydroxylysine or ornithine residue, a carboxyl group of a side chain of a glutamic acid and aspartic acid residue, a hydroxyl group of a side chain of a cerin, threonine, hydroxylysine or hydroxyproline residue, a mercapto group of a side chain of cysteine residue, phenolic hydroxyl group of a side chain of tyrosine residue, imidazole group of a side chain of histidine residue, guanidino group of a side chain of arginine residue, and amino group and carboxyl group of amino acid at an end of polypeptide. $L^1$ is preferably —NH—, —N=, —O—, more preferably —NH—, —N=, and most preferably —NH—.

$L^2$ represents a divalent or trivalent coupling group, preferably a divalent coupling group of carbon number 1–20. If $L^1$ is —N=, $L^2$ is a trivalent coupling group, and a coupling portion thereof to $L^1$ is =CH—, for example.

Specific examples of divalent coupling group represented by $L^2$ are alkylene group of carbon number 1–20 (such as methylene, ethylene, propylene, butylene, and xylylene), arylene group (such as phenylene and naphthylene), carbonyl group, sulfone group, sulfoxide group, ether group, ester group or amide group of carbon number 6–20, or a group obtained by combining two or more of the above groups.

$L^2$ is preferably an alkylene group of carbon number 1–12, and arylene group, carbonyl group, sulfone group, sulfoxide group, ether group, ester group, or amide group of carbon number 6–12, or a group obtained by combining two or more of the above groups. Specific examples thereof are shown as follows.

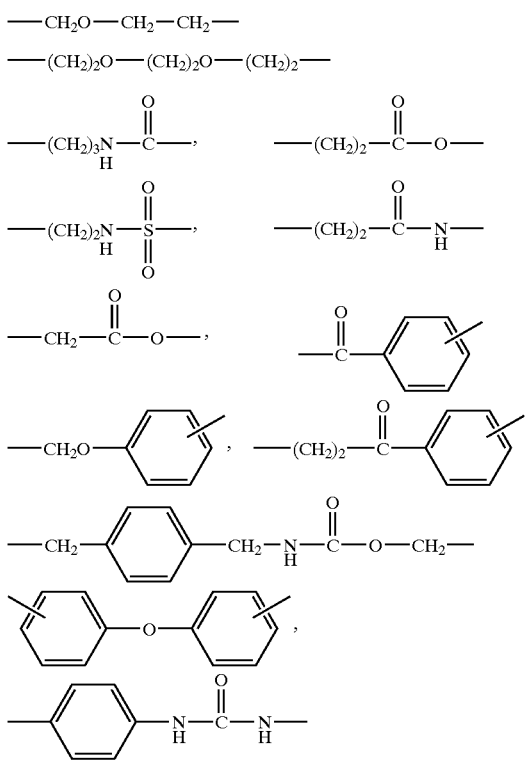

-continued

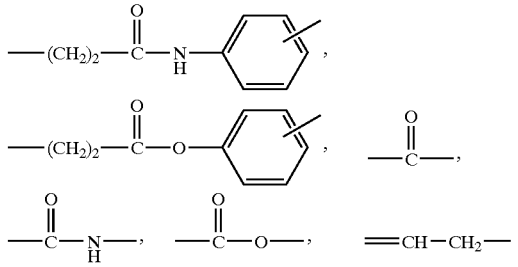

Although each of these groups may be bound to $L^1$ on either side (left and right), preferably the left side thereof is bound to $L^1$.

$L^2$, if possible, may further have a substituent. Examples of such a substituent are an alkyl group (preferably having carbon number 1–20, more preferably carbon number 1–12, and especially preferably carbon number 1–8, such as methyl, ethyl, iso-propyl, tert-butyl, n-octyl, n-decyl, n-hexadecyl, cyclopropyl, cyclopentyl, and cyclohexyl), alkenyl group (preferably having carbon number 2–20, more preferably carbon number 2–12, and especially preferably carbon number 2–8, such as vinyl, allyl, 2-butenyl and 3-pentenyl), alkynyl group (preferably having carbon number 2–12, more preferably carbon number 2–12, and especially preferably carbon number 2–8, such as propargyl and 3-pentynyl), aryl group (preferably having carbon number 6–30, more preferably carbon number 6–20, and especially preferably carbon number 6–12, such as phenyl, p-methylphenyl and naphthyl), substituted or non-substituted amino group (preferably having carbon number 0–20, more preferably carbon number 0–10, and more preferably carbon number 0–6, such as amino, methylamino, dimethylamino, diethylamino and dibenzylamino), alkoxy group (preferably having carbon number 1–20, more preferably carbon number 1–12, and especially preferably carbon number 1–8, such as methoxy, ethoxy and butoxy), aryloxy group (preferably having carbon number 6–20, more preferably carbon number 6–16, especially preferably carbon number 6–12, such as phenyloxy and 2-naphtyloxy), acyl group (preferably having carbon number 1–20, more preferably carbon number 1–16, and especially preferably carbon number 1–12, such as acetyl, benzoyl, formyl and pivaloyl), alkoxycarbonyl group (preferably having carbon number 2–20, more preferably carbon number 2–16, and especially preferably carbon number 2–12, such as methoxycarbonyl and ethoxycarbonyl), aryloxycarbonyl group (preferably having carbon number 7–20, more preferably carbon number 7–16 and especially preferably carbon number 7–10, such as phenyloxycarbonyl), acyloxy group (preferably having carbon number 2–20, more preferably carbon number 2–16, and especially preferably carbon number 2–10, such as acetoxy and benzoyloxy), acylamino group (preferably having carbon number 2–20, more preferably carbon number 2–16, and especially preferably carbon number 2–10, such as acetylamino and benzoylamino), alkokycarbonylamino group (preferably having carbon number 2–20, more preferably carbon number 2–16, and especially preferably carbon number 2–12, such as methoxycarbonylamino), aryloxycarbonylamino group (preferably having carbon number 7–20, more preferably carbon number 7–16, and especially preferably carbon number 7–12, such as phenyloxycarbonylamino), sulfonyl amino group (preferably having carbon number 1–20, more preferably carbon number 1–16, and especially preferably carbon number 1–12, such as methanesulfonylamino and benzenesulfonylamino), sulfamoyl group (preferably having carbon number 0–20, more preferably carbon number 0–16, and especially preferably carbon number 0–12, such as sulfamoyl, methylsulfamoyl, dimethylsulfamoyl, and phenylsulfamoyl), carbamoyl group (preferably having carbon number 1–20, more preferably carbon number 1–16, and especially preferably carbon number 1–12, such as carbamoyl, methylcarbamoyl, diethylcarbamoyl, and phenylcarbamoyl), alkylthio group (preferably having carbon number 1–20, more preferably carbon number 1–16, and especially preferably carbon number 1–12, such as methylthio and ethylthio), arylthio group (preferably having carbon number 6–20, more preferably carbon number 6–16, and especially preferably carbon number 6–12, such as phenylthio), sulfonyl group (preferably having carbon number 1–20, more preferably carbon number 1–16, and especially preferably carbon number 1–12, such as mesyl and tosyl), sulfinyl group (preferably having carbon number 1–20, more preferably carbon number 1–16, and especially preferably carbon number 1–12, such as methanesulfinyl and benzenesulfinyl), ureide group (preferably having carbon number 1–20, more preferably carbon number 1–16, and especially preferably carbon number 1–12, such as ureide, methylureide, and phenylureide), amide phosphate group (preferably having carbon number 1–20, more preferably carbon number 1–16, and especially preferably carbon number 1–12, such as amide diethylphosphate and phenyl phosphate amide), hydroxy group, mercapto group, halogen atom (such as fluorine atom, chlorine atom, bromine atom and iodine atom), cyano group, sulfo group, carboxyl group, nitro group, hydroxamic acid group, sulfino group, hydrazino group, imino group, heterocyclic group (preferably having carbon number 1–30, and more preferably carbon number 1–12. Preferable examples of heteroatom are a nitrogen atom, oxygen atom, and sulfur atom, and specific examples of the heterocyclic group are imidazolyl, pyridyl, quinolyl, furyl, piperidyl, morpholino, benzoxazolyl, benzimidazolyl, and benzthiazolyl), and silyl group (preferably having carbon number 3–40, more preferably carbon number 3–30, and especially preferably carbon number 3–24, such as trimethylsilyl, and triphenylsilyl). These substituents may be further substituted. Further, if there are two or more substituents, they may be the same substituent or different substituents. Further, if possible, the substituents may couple each other to form a ring.

n represents an integer of 1 or 2, preferably 1.

Z represents a nitrogenous aromatic heterocyclic group, specifically a monocyclic or condensed nitrogenous aromatic heterocycle, preferably 5 to 7-membered nitrogenous aromatic heterocycle, more preferably 5 to 6-membered nitrogenous aromatic heterocycle such as imidazole, pyrazole, triazole, tetrazole, thiazole, oxazole, selenazole, benztriazole, benzthiazole, benzoxazole, benzseleazole, thiadiazole, oxadiazole, naphthothiazole, naphthoxazole, azabenzimidazole, purine, pyridine, pyrazine, pyrimidine, pyridazine, triazine, triazaindene, and tetrazaindene, more preferably a 5-membered nitrogenous aromatic heterocycle such as imidazole, pyrazole, triazole, tetrazole, thiazole, oxazole, benztriazole, benzthiazole, benzoxazole, thiadiazole, and oxadiazole, especially preferably triazole and tetrazole, and most preferably tetrazole.

A nitrogenous aromatic heterocycle represented by Z may further have a substituent, if possible. The groups mentioned as the substituent of $L^2$ of the formula (I) are applicable as a substituent.

The introduction amount of a modifying group represented by $-L^2$-Z-SH— in the formula (I) is $1.0\times10^{-6}$ mol to $2.0\times10^{-3}$ mol to dried gelatin 100 g, preferably $1.0\times10^{-6}$ mol to $1.5\times10^{-3}$ mol, and more preferably $1.0\times10^{-6}$ mol to $1.0\times10^{3}$ mol. The introduction amount set to this range can inhibit rise in the fog density, without decreasing the sensitivity of the silver halide photographic light-sensitive material, and produces an effect of inhibiting aggregation of silver halide grains with a lapse of time after dissolution of the emulsion, which improves the problem of deterioration of the photographic property in coating and permits preparation of a silver halide emulsion excellent in the suitability for preparation.

Among the modified gelatins represented by the formula (I), modified gelatins represented by the following formula (II) are more preferable.

(II)

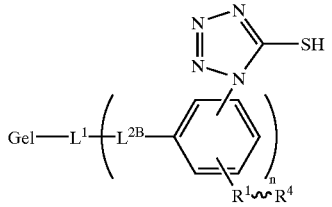

In the formula (II), Gel, $L^1$ and n have the same meanings as those in the formula (I), and their preferable ranges are also the same as in the formula (I).

In the formula (II), $L^{2B}$ represents a divalent or trivalent coupling group, and preferably a divalent coupling group of carbon number 1–14. Specifically, $L^{2B}$ is an alkylene group of carbon number 1–14 (such as methylene, ethylene, propylene, butylene and xylylene), arylene group of carbon number 6–14 (such as phenylene and naphthylene), carbonyl group, sulfone group, sulfoxide group, ether group, ester group or amide group, or a group obtained by two or more of the above groups. $L^{2B}$ is preferably an alkylene group of carbon number 1–12, arylene group of carbon number 6–12, carbonyl group, sulfone group, sulfoxide group, ether group, ester group, or amide group, or a group obtained by combining two or more of the above groups. Specifically, the groups mentioned with respect to the above $L^2$ are preferable examples of $L^{2B}$.

Each of $R^1$, $R^2$, $R^3$ and $R^4$ independently represents a hydrogen atom or a substituent. The groups mentioned as the substituents of $L^2$ in the formula (I) are applicable as the substituent.

Preferable examples of $R^1$, $R^2$, $R^3$ and $R^4$ are alkyl group, amino group, alkoky group, aryloxy group, acyl group, hydroxy group, fluorine atom, chlorine atom, bromine atom, iodine atom, cyano group, carboxyl group, nitro group and hydrogen atom, more preferably alkyl group, alkoky group, hydroxy group and hydrogen atom, and further preferably hydrogen atom.

In the formula (II), the introduction amount of the modifying group in parentheses is $1.0\times10^{-6}$ mol to $2.0\times10^{-3}$ mol to dried gelatin 10 g, preferably $1.0\times10^{-6}$ mol to $1.5\times10^{-3}$ mol, and more preferably $1.0\times10^{-6}$ mol to $1.0\times10^{-3}$ mol. The introduction amount set to this range can inhibit rise in the fog density, without decreasing the sensitivity of the silver halide photographic light-sensitive material, and produces an effect of inhibiting aggregation of silver halide grains with a lapse of time after dissolution of the emulsion, which improves the problem of deterioration of the photographic property in coating and permits preparation of a silver halide emulsion excellent in the suitability for preparation.

Next, there will now be described an example of a general synthesizing method of the modified gelatin (preferably a modified gelatin represented by the formula (I) or (II)) of the present invention. However, the present invention is not limited to it.

General Synthesizing Method of the Modified Gelatin of the Present Invention

The modified gelatin of the present invention can be synthesized by reacting a reactive group contained in gelatin or gelatin derivative (such as amino group, carboxyl group, hydroxyl group and mercapto group) with a compound having a group forming a covalent bond with the reactive group, in water or an organic solvent including water.

The reaction temperature is preferably 30–80° C., more preferably 30–70° C., further preferably 40–70° C., and especially preferably 45–65° C.

The reaction pH value is preferably 5.0–11.0, more preferably 5.0–10.0, further preferably 6.0–9.0, and especially preferably 6.5–8.5.

The reaction solvent is preferably a mixture of water with dimethylformamide, dimethylacetoamide, acetonitrile or acetone, or water.

The gelatin solid concentration in the reaction solvent is preferably 0.1–40 mass %, more preferably 0.5–30 mass %, further preferably 3–30 mass %, and especially preferably 5–30 mass %.

With respect to the group which can form covalent bond with the reactive group contained in gelatin, it is possible to refer to the description of JP-A-51-117619, T. H. James "THE THEORY OF THE PHOTOGRAPHIC PROCESS Fourth Edition" published by Macmillan Inc., New York, Chapter 2, Section III (1977), and A. G. Ward, A. Courts, "The Science and Technology of Gelatin" Chapter 7, published by Academic Press (1977).

Specific examples of the group which can form covalent bond with the reactive group contained in gelatin are an aldehyde group, acetal group, epoxy group, isocyanate group, activated halogen group (such as halogenomethylenecarbonyl group, halogenomethylenecarbonyloxy group, halogenomethylenecarbonamide group, halogenomethylenesulfonyl group, halogenomethylenesulfoneamide group, and dihalogeno-S-triazine group), activated ester (for example, the following group),

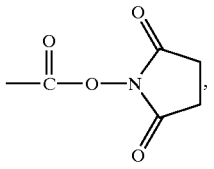

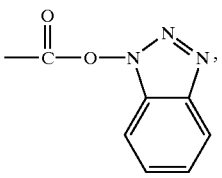

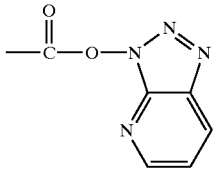

ethyleneimino group, active olefin group (such as vinylsulfonyl group, vinylsulfoneamide group, vinylcarbonyl group, vinylcarbonamide group, and vinylcarbonyloxy group), acid halide (such as carboxylic acid chrolide, and sulfonic acid chrolide), sulfonic acid ester, acid anhydride (such as succinic anhydride and phthalic anhydride), isothiocyanate group, carboxylic acid activated by a condensing agent, sulfonic acid activated by a condensing agent, and phosphoric acid activated by a condensing agent.

Examples of the condensing agent for activating carboxylic acid, sulfonic acid and phosphoric acid are carbodiimide <such as N,N'-dicyclohexylcarbodiimide (DCC), N,N-diisopropylcarbodiimide, 1-ethyl-3-(3-dimethylaminopropyl)carbodiimide hydrochloride (WSC), N-cyclohexyl-N'-[2-(N-methyl-piperidinoethyl)carbodiimide-meso-p-toluenesulfonic acid]>, carbonyldiimidazole, sulfonyl chloride (such as triisopropylbenzenesulfonyl chloride), formic acid chloride (such as chloroformic acid isobutyl, and chloroformic acid ethyl), phosphonyl chloride <such as benzotriazolyl-1-yloxytris-(dimethylamino) phosphoniumhexafluorophosphate (BOP reagent)>, uronium salt (such as O-benzotriazole-1-yl-N,N,N',N'-tetramethyluroniumhexafluorophosphate), carbamoyl ammonium salt <such as 4-(2-sulfonate ethyl)-1-morphonylcarbonylpyridinium>, carbenium chloride salt <such as chlorobis(morpholino)carbeniumchloridehexafluorophosphate>. However, any condensing agent can be used, as long as it can bind an acid such as carboxylic acid, sulfonic acid and phosphoric acid with an amino group or a hydroxyl group to form acid amide bonding or ester bonding. Further, these acids may be converted to another activated ester by using these condensing agents.

Such a condensing agent is preferably carbodiimide, more preferably water-soluble carbodiimide, and further preferably WSC.

The group which can form a covalent bonding with the reactive group contained in gelatin is preferably an epoxy group, active olefin group, activated ester group and carboxylic acid activated by a condensing agent, more preferably epoxy group, vinylsulfonyl group, vinylcarbonyl group, vinylcarbonamide group, vinylcarbonyloxy group, and carboxylic acid activated by using carbodiimide, and further preferably carboxylic acid activated by using carbodiimide.

The following are specific examples of compounds which directly react with the reactive group contained in gelatin to form the modified gelatin represented by the formula (I) or (II), or compounds which react with the reactive group contained in gelatin, after having been activated by a condensing agent, to form the modified gelatin represented by the formula (I) or (II). However, the compounds used in the present invention are not limited to the following compounds.

1

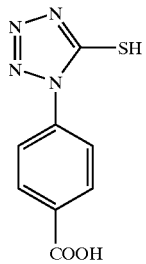

2

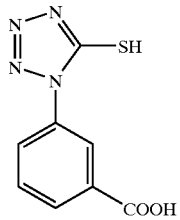

-continued
3
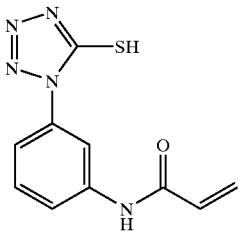
4
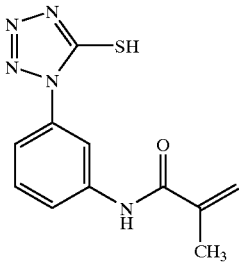
5
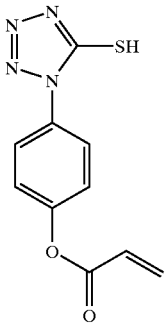
6
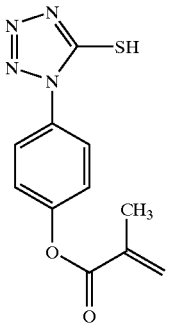
7
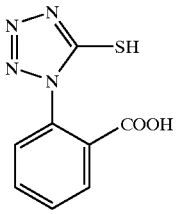
8
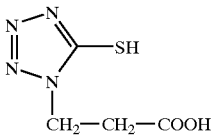
-continued
9
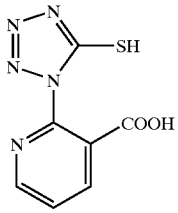
10
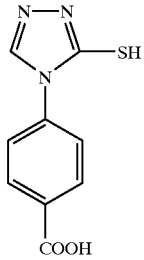
11
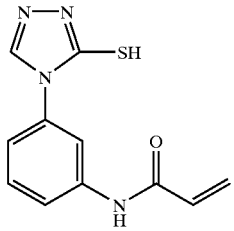
12
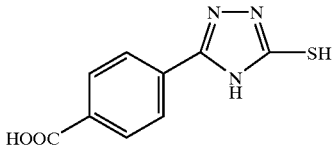
13
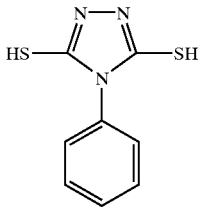
14
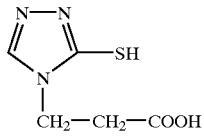
15
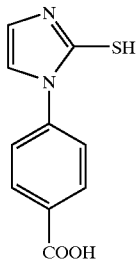

-continued

16

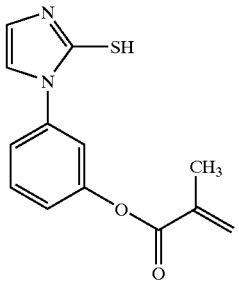

17

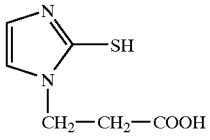

18

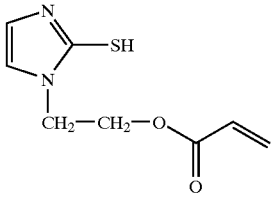

19

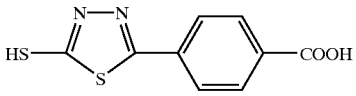

20

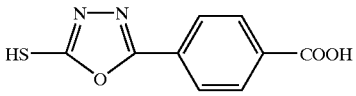

21

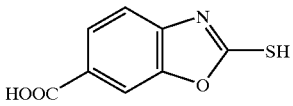

22

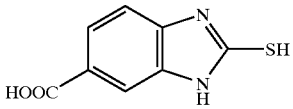

23

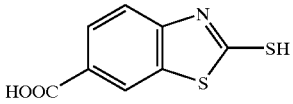

24

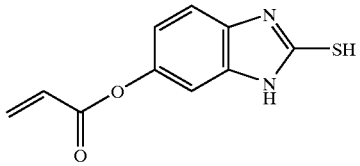

25

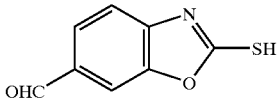

-continued

26

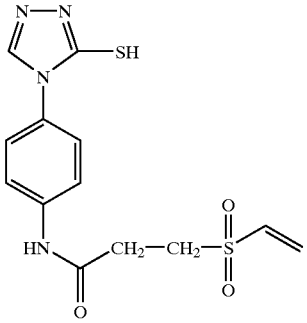

27

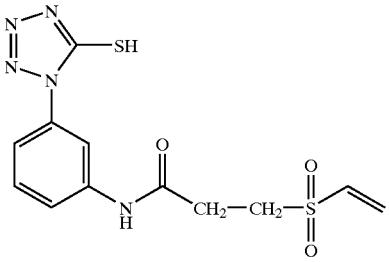

28

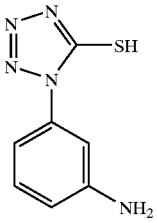

29

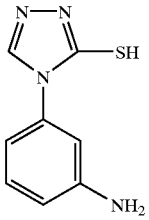

The modified gelatin of the present invention can be contained in at least one layer of hydrophilic colloidal layers (such as silver halide emulsion layers and non-light-sensitive hydrophilic colloidal layers) of a silver halide photographic light-sensitive material. The layer to contain the modified gelatin of the present invention is preferably at least one layer of silver halide emulsion layers and its adjacent hydrophilic colloidal layers, and especially preferably silver halide emulsion layers. Further, the modified gelatin of the present invention is more preferably added during preparation of the silver halide emulsion, and it may be added in any of a grain formation step, a chemical ripening step, and after completion of the chemical ripening. The modified gelatin is most preferably added in the grain formation step. The modified gelatin of the present invention is added in the state of being dissolved in water or a hydrophilic organic solvent (such as methanol and N,N-dimethylformamide).

Suitable silver halide photographic light-sensitive materials for which the modified gelatin of the present invention is used are materials having sensitivity to light, laser or X-ray irradiation, and selected from black-and-white reversal films, black-and-white negative films, color negative films, color reversal films, films formed by digital-scanning light-sensitive photographic components, black-and-white reversal paper, black-and-white paper, color paper, reversal color paper, and paper formed by sensitized by laser irradiation of light-sensitive photographic components from a digital data base. Color negative films are preferable as silver halide photographic light-sensitive materials, and its embodiments are described in JP-A-11-305396, for example.

The following is further detailed explanation of a silver halide emulsion containing the modified gelatin of the present invention (hereinafter also referred to as "emulsion of the present invention").

The silver halide grain emulsion used in the present invention has regular crystals such as cube, octahedron and tetradecahedral, irregular crystals such as spherical shape and plate-like shape, crystal defect such as twin face, or a complex of the above. In particular, tabular grains are more preferable form of the silver halide grain emulsion of the present invention.

The silver halide emulsion of the present invention preferably contains silver bromide, silver chloride, silver iodobromide, silver chloroiodobromide, and silver chlorobromide.

The emulsion of the present invention contains the above modified gelatin, and can be classified as follows by the form of silver halide grains occupying 50% or more of the total projected area of all the silver halide grains contained in the emulsion.

First, tabular silver halide grains of the first emulsion of the present invention will now be described. The tabular silver halide grains are formed of silver iodobromide or silver chloroiodobromide having a silver chloride content less than 10 mol %, and have parallel principal planes being (111) faces.

Each of the tabular silver halide grains is formed of opposing (111) principal planes and side faces connecting the main faces, and formed of silver iodobromide or silver chloroiodobromide. Although the grains may contain silver chloride, the silver chloride content is less than 10 mol %, preferably 8 mol % or less, more preferably 3 mol % or less, or 0 mol %. The silver iodide content is preferably 40 mol % or less, and more preferably 20 mol % or less. Each of the silver iodide content and silver bromide content is preferably 0.5 mol % or more.

Regardless of the silver iodide content, the coefficient of variation in the distribution of the silver iodide content among the grains is preferably 20% or less, and especially preferably 10% or less.

Silver iodide distribution preferably has a structure in a grain. In this case, the structure of the silver iodide distribution can be a double structure, triple structure, quadruplex structure and more multiplex structure. Further, the silver iodide content may continuously vary in a grain.

At least 50% of the total projected area of the tabular silver halide grains is occupied by grains having an aspect ratio of 2 or more. The projected areas and the aspect ratios of the tabular grains can be measured from electron micrographs which have been taken by carbon replica plating and shadowed together with a reference latex sphere. Each of the tabular grains is a hexagon, triangle or circle when it is viewed from the above, and the aspect ratio is a value obtained by dividing a diameter of a circle having an area equal to the projected area of the grain by the thickness. A tabular grain including hexagons at a high rate is more preferable, and the ratio of the length of adjacent sides of the hexagon is preferably 1:2 or less.

The equivalent circle diameter of a tabular grain is preferably 0.1 μm to 20.0 μm, and more preferably 0.2 μm to 10.0 μm. The term "equivalent circle diameter" indicates the diameter of a circle having an area equal to the projected area of a silver halide grain. The projected area of a grain can be obtained by measuring the area of the grain on electron micrographs and correcting the magnification. Further, the thickness of a tabular grain is 0.01 μm to 0.5 μm, preferably 0.02 μm to 0.4 μm. The term "thickness of a tabular grain" indicates a space between the two principal planes of the grain. The equivalent sphere diameter of each of the grains is preferably 0.1 μm to 5.0 μm, more preferably 0.2 μm to 3 μm. The term "equivalent sphere diameter" of a grain indicates the diameter of a sphere having a volume equal to that of the grain. Further, the aspect ratio of each of the grains is preferably 1 to 100, and more preferably 2 to 50. The term "aspect ratio" indicates a value obtained by dividing the projected area diameter of a grain by the thickness of the grain.

The silver halide grains contained in the first emulsion, and the second emulsion described below, of the present invention are preferably monodisperse. The coefficient of variation in the equivalent sphere diameters of all the silver halide grains contained in the first and second emulsions of the present invention is 30% or less, and preferably 25% or less. Further, in the case of tabular grains, the coefficient of variation in the projected area diameters is also important. The coefficient of variation in the projected area diameters of all the silver halide grains of the present invention is preferably 30% or less, preferably 25% or less, and further preferably 20% or less. Further, the coefficient of variation in the thickness of the tabular grains is preferably 30% or less, more preferably 25% or less, and further preferably 20% or less. The term "coefficient of variation" indicates a value obtained by dividing a standard deviation of the distribution of the projected area diameters of the silver halide grains by an average projected area diameter, or a value obtained by a standard deviation of the distribution of the thickness of the silver halide tabular grains by an average thickness.

The space between the twin faces of each of the tabular grains contained in the first and second emulsions of the present invention may be selected according to the objects. It may be set to 0.012 μm or less as described in U.S. Pat. No. 5,219,720, and the value obtained by dividing the distance between the (111) principal planes by the space between the twin faces may be 15 or more.

The higher the aspect ratio is, the more remarkable the effect is. Therefore, in the tabular grain emulsion, 50% or more of the total projected area of the tabular grains is preferably occupied by grains preferably having an aspect ratio of 5 or more, and more preferably having an aspect ratio of 8 or more. If the aspect ratio is too large, the above coefficient of variation in the grain size distribution becomes inclined to increase. Thus, generally the aspect ratio is preferably not exceeding 100.

The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method.

The greater the thickness of the above grains, the more difficult the transmission of electron beams. Therefore, the use of an electron microscope of high voltage type (at least 200 kV on the grains of 0.25 μm in thickness) is preferred for ensuring clearer observation The thus obtained photograph of grains enables determining the position and number of dislocation lines in each grain viewed in the direction perpendicular to the principal planes.

The number of dislocation lines of the tabular grains according to the present invention is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed.

Dislocation lines can be introduced in, for example, the vicinity of the periphery of tabular grains. In this instance, the dislocation is nearly perpendicular to the periphery, and each dislocation line extends from a position corresponding to x% of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel principal planes of tabular grains. In the case where dislocation lines are formed over the entire regions of the principal planes, the dislocation lines may crystallographically be oriented approximately in the (211) direction when viewed in the direction perpendicular to the principal planes, and the formation of the dislocation lines may be effected either in the (110) direction or randomly. Further, the length of each dislocation line may be random, and the dislocation lines may be observed as short lines on the principal planes or as long lines extending to the side (periphery). The dislocation lines may be straight or often meander. In many instances, the dislocation lines cross each other.

The silver iodide content on the grain surface of a tabular grain emulsion of the present invention is preferably 10 mol % or less, and particularly preferably, 5 mol % or less. The silver iodide content on the grain surface of the present invention is measured by using XPS (X-ray Photoelectron Spectroscopy). The principle of XPS used in an analysis of the silver iodide content near the surface of a silver halide grain is described in Junnich Aihara et al., "Spectra of Electrons" (Kyoritsu Library 16: issued Showa 53 by Kyoritsu Shuppan). A standard measurement method of XPS is to use Mg-Kα as excitation X-rays and measure the intensities of photoelectrons (usually I-3d5/2 and Ag-3d5/2) of iodine (I) and silver (Ag) released from silver halide grains in an appropriate sample form. The content of iodine can be calculated from a calibration curve of the photoelectron intensity ratio (intensity (I)/intensity (Ag)) of iodine (I) to silver (Ag) formed by using several different standard samples having known iodine contents. XPS measurement for a silver halide emulsion must be performed after gelatin adsorbed by the surface of a silver halide grain is decomposed and removed by, e.g., proteinase. A tabular grain emulsion in which the silver iodide content on the grain surface is 10 mol % or less is an emulsion whose silver iodide content is 10 mol % or less when the emulsion grains are analyzed by XPS. If obviously two or more types of emulsions are mixed, appropriate preprocessing such as centrifugal separation or filtration must be performed before one type of emulsion is analyzed.

The structure of a tabular grain emulsion of the present invention is preferably a triple structure of silver bromide/silver iodobromide/silver bromide or a higher-order structure. The boundary of silver iodide content between structures can be either a clear boundary or a continuously gradually changing boundary. Commonly, when measured by using a powder X-ray diffraction method, the silver iodide content does not show any two distinct peaks; it shows an X-ray diffraction profile whose tail extends in the direction of high silver iodide content.

In the present invention, the silver iodide content in a layer inside the surface is preferably higher than that on the surface; the silver iodide content in a layer inside the surface is preferably 5 mol % or more, and more preferably, 7 mol % or more.

Next, there will now be described the second emulsion of the present invention, which contains hexagonal silver halide grains having parallel principal planes being (111) faces, and 2 or less ratio of the length of a side having the minimum length to the length of a side having the maximum length, and the hexagonal silver halide grains have at least one epitaxial junction per grain on respective vertex portions, and/or side face portions, and/or principal plane portions. An epitaxial-junctioned grain means a grain having crystal portion (that is, epitaxial portion) junctioned with the grain, in addition to the silver halide grain main body, and the junctioned crystal portion generally projects from the silver halide grain main body. The rate of the junctioned crystal portion (epitaxial portion) to the total silver amount of the grain is preferably 2% to 30%, and more preferably 5% to 15%. Although epitaxial portions may exists on any parts of a grain main body, they preferably exists on grain principal plane portions, grain side face portions, and grain vertex portions. The number of epitaxial in a grain is preferably at least 1. Further, the composition of the epitaxial portions is preferably AgCl, AgBrCl, AgBrClI, AgBrI, AgI, and AgSCN, etc. If an epitaxial portion exists in a grain, dislocation lines may exist in the grain, and may not exist.

In the second emulsion, in the same manner as the first emulsion, the silver halide grains are formed of silver iodobromide or silver chloroiodobromide having the silver chloride contents of 10 mol % or less.

Next, the method of preparing emulsion silver halide grains of the first and second emulsions of the present invention will now be described.

The preparing method of the present invention comprises: (a) base grain formation step; and the grain formation step (step (b)) following the above step. Basically, although the step (a) is more preferably followed by the step (b), only the step (a) may be performed. The step (b) may be any of: (b1) dislocation introducing step; (b2) step of introducing dislocation limitedly into vertex portions; and (b3) epitaxial junction step. One of (b1)–(b3) may be selected, or two or more of them may be combined as step (b).

First, the step (a) base grain formation step will now be described. The base portions preferably occupy at least 50%, and more preferably at least 60%, of the total silver amount used for grain formation. Further, the average content of iodine to the silver amount of the base portions is 0 mol % to 30 mol %, and more preferably 0 mol % to 15 mol %. Furthermore, the base portions may have core-shell structures according to necessity. In this case, the core portion of each base portion is preferably 50% to 70% to the total silver amount of the base portion, and the average iodine composition of the core portion is preferably 0 mol % to 30 mol %, and more preferably 0 mol % to 15 mol %. The iodine composition of each shell portion is preferably 0 mol % to 3 mol %.

A general method of preparing a silver halide emulsion is a method of forming silver halide cores, and thereafter further growing the silver halide grains to obtain grains of a desired size. The present invention is also a similar method. Further, formation of tabular grains at least includes the steps of core formation, ripening and growth. These steps are detailed in U.S. Pat. No. 4,945,037.

1. Core Formation

For core formation of tabular grains, used is a double jetting method performed by adding a silver salt aqueous solution and an alkali halide aqueous solution to a reaction vessel containing a gelatin aqueous solution, or a single jetting method performed by adding a silver salt aqueous solution to a gelatin solution containing alkali halide. Further, it is possible to also use a method of adding an alkali halide aqueous solution to a gelatin solution containing silver salt, according to necessity. Furthermore, according to necessity, it is also possible to perform core formation of tabular grains by adding a gelatin solution, a silver salt solution and an alkali halide aqueous solution to the mixer disclosed in JP-A-2-44335 and immediately transferring the mixture to a reaction vessel. Moreover, as disclosed in U.S. Pat. No. 5,104,786, it is also possible to perform core formation by running an aqueous solution containing alkali halide and protective colloidal solution into a pipe and adding a silver salt aqueous solution thereto. It is also possible to adopt the core formation described in U.S. Pat. No. 6,022,681, wherein the chlorine content is 10 mol % or more to the silver amount used for the core formation.

In core formation, preferably gelatin is used as a dispersion medium, and the dispersion medium is formed under the condition that pBr is 1–4. The kinds of the gelatin which may be used are alkali-processed gelatin, low molecular-weight gelatin (molecular weight: 3000–40,000), acid-processed gelatin described in U.S. Pat. Nos. 4,713,320 and 4,942,120, and acid-processed gelatin of a low molecular weight. In particular, an acid-processed gelatin of a low molecular weight is preferably used.

The concentration of the dispersion medium is preferably 10 mass % or less, and more preferably 1 mass % or less.

The temperature in core formation is preferably 5–60', and more preferably 5–48° C. in the case of forming fine tabular grains having an average grain size of 0.5 $\mu$m or less.

The pH of the dispersion medium is preferably 1 to 10, and more preferably 1.5 to 9.

Further, it is possible to add the polyalkylene oxide compound described in U.S. Pat. Nos. 5,147,771, 5,147,772, 5,147,773, 5,171,659, 5,210,013, and 5,252,453, in the core formation step, or in the following ripening step and growth step.

2. Ripening

In the core formation in above item 1, fine grains other than tabular grains (in particular, octahedrons and single twinned crystal grains). It is necessary to extinguish grains other than tabular grains before the following growth step and to obtain cores having forms to be tabular grains and good monodisperse property. In order to make it possible, it is well known to perform Ostwald ripening in succession after core formation.

After adjustment of pBr directly after core formation, the temperature is raised to perform ripening until the ratio of the hexagonal tabular grains reaches the maximum value. In this step, more gelatin solution may be added. In this step, the concentration of the gelatin to the dispersion medium solution is preferably 10 mass % or less. The added gelatin used in this step is alkali-processed gelatin, the amino-group modified gelatin described in JP-A-11-143002 such as succinated gelatin and trimellitated gelatin whose amino groups are modified by 95% or more, imidazole group modified gelatin described in JP-A-11-143003, and acid-processed gelatin. In particular, succinated gelatin and trimellitated gelatin are preferably used.

The temperature of ripening is preferably 40–80° C., more preferably 50–80° C., and pBr is 1.2 to 3.0. Further, pH is preferably 1.5 to 9.

Furthermore, in this step, in order to promptly extinguish grains other than tabular grains, a silver halide solvent may be added. In this case, the concentration of the silver halide solvent is preferably 0.3 mol/liter (hereinafter also referred to as "L") or less, and more preferably 0.2 mol/L. If the emulsion is used as a direct reversal emulsion, a silver halide solvent such as a thioether compound used on the neutral and acid sides is more preferable as the silver halide solvent than $NH_3$ used on the alkali side.

Ripening is performed as described above such that tabular grains occupy almost 100% of the grains.

After completion of ripening, if the silver halide solvent is unnecessary in the following growth step, the silver halide solvent is removed as follows.

(i) if the silver halide solvent is an alkaline silver halide solvent such as $NH_3$, it is annulled by adding an acid having a large solubility product constant with $Ag^+$, such as $HNO_3$.

(ii) if the silver halide solvent is a thioether-based silver halide solvent, it is annulled by adding an oxidizing agent such as $H_2O_2$, as described in JP-A-60-136736.

3. Growth

The pBr in the crystal growth step following the ripening step is preferably maintained at 1.4 to 3.5.

If the gelatin concentration in the dispersion medium solution before entering the growth step is low (1 mass % or less), there are cases where gelatin is further added. In such cases, the gelatin concentration in the dispersion medium solution is preferably raised to 1–10 mass %. The gelatin used for this further addition is alkali-processed gelatin, succinated gelatin and trimellitated gelatin whose amino groups are modified by 95% or more, and acid-processed gelatin. In particular, succinated gelatin and trimellitated gelatin are preferably used.

The pH during the growth is preferably 2 to 10, and more preferably 4 to 8. However, if succinated gelatin and trimellitated gelatin exist, the pH is preferably 5 to 8. The addition speeds of $Ag^+$ and halogen ions in the crystal growth period are preferably set such that the crystal growth speed is 20–100%, preferably 30–100% of the crystal critical growth speed. In this case, the addition speeds of the silver ions and halogen ions are increased with crystal growth. In such a case, as described in JP-B-48-36890 and 52-16364, the addition speeds of the silver salt aqueous solution and halogen salt aqueous solution may be increased, or the concentrations of the aqueous solutions may be increased. Although the addition may be performed by a double jetting method of simultaneously adding the silver salt aqueous solution and the halogen salt aqueous solution, it is preferable to simultaneously add the silver nitrate aqueous solution, halogen aqueous solution containing a bromide, and silver iodide fine-grain emulsion described in U.S. Pat. Nos. 4,672,027 and 4,693,964. In this case, the temperature of growth is preferably 50 to 90° C, and more preferably 60 to 85° C. Further, the AgI fine-grain emulsion to be added may be prepared in advance, or may be added while being continuously prepared. JP-A-10-43570 can be referred to with respect to the method of preparation in such a case.

The average grain size of the AgI emulsion to be added is 0.005 μm to 0.1 μm, and preferably 0.007 μm to 0.08 μm. The iodine composition of the base grains can be changed according to the amount of the AgI emulsion to be added.

Further, instead of addition of a silver salt aqueous solution and halogen salt aqueous solution, silver iodobromide fine grains are preferably added. In such a case, it is possible to obtain base grains of a desired iodine composition, by equalizing the iodine amount of the fine grains with the iodine amount of the desired base grains. Although prepared silver iodobromide fine grains may be added, the silver iodobromide fine grains are preferably added while being continuously prepared. The size of the silver iodobromide fine grains to be added is 0.005 μm to 0.1 m, and preferably 0.01 μm to 0.08 μm. The temperature in growth is 50 to 90° C., and preferably 60 to 85° C.

Next, the step (b) will now be described.

First, the step (b1) will now be described. The step (b1) comprises the first shell step and the second shell step. A first shell is provided on each of the above-mentioned bases. The ratio of the first shells is preferably 1 mol % to 30 mol % to the total silver amount, and the average silver iodide contents of the first shells is 20 mol % to 100 mol %. The growth of the first shells to the bases is basically performed by adding a silver nitrate aqueous solution and a halogen aqueous solution containing an iodide and bromide by a double jetting method. It can be also performed by adding a silver nitrate aqueous solution and a halogen aqueous solution containing a bromide by a double jetting method, or adding a halogen aqueous solution containing an iodide by a single jetting method.

The growth may be performed by any of the above methods, or by a combination thereof. As is clear from the average silver iodide content of the first shells, in formation of the first shells, silver iodide can deposit in addition to silver iodobromide mixed crystals. In any cases, generally all the silver iodide changes to silver iodobromide mixed crystals during the following step of formation of second shells.

As a preferable method of forming the first shells, there is a method of adding silver iodobromide or a silver iodide fine-grain emulsion to perform ripening and dissolution. Further, there is a preferable method of adding a silver iodide fine-grain emulsion, and thereafter adding a silver nitrate aqueous solution or a silver nitrate solution and a halogen aqueous solution. In such a case, although dissolution of a silver iodide fine-grain emulsion is accelerated by addition of a silver nitrate aqueous solution, the first shells are made by using the silver amount of the added silver iodide fine-grain emulsion, and the silver iodide content of the first shells is regarded as 100 mol %. Further, the silver amount of the added silver nitrate aqueous solution is calculated as the second shells. The silver iodide fine-grain emulsion is preferably rapidly added.

"To add a silver iodide fine grain emulsion abruptly adding" is to add the silver iodide fine grain emulsion preferably within 10 minutes, and more preferably, within 7 minutes. This condition may vary in accordance with, e.g., the temperature, pBr, and pH of the system to which the emulsion is added, the type and concentration of a protective colloid agent such as gelatin, and the presence/absence, type, and concentration of a silver halide solvent. However, a shorter addition time is more preferable as described above. During the addition, it is preferable that an aqueous solution of silver salt such as silver nitrate is not substantially added. The temperature of the system during the addition is preferably 40° C. or more and 90° C. or less, and most preferably, 50° C. or more and 80° C. or less.

The silver iodide fine grain emulsion is not limited if it consists substantially of silver iodide, and may contain silver bromide and/or silver chloride as long as mixed crystals can be formed. Preferably, the silver halide composition of the silver iodide fine grain emulsion consists of 100% silver iodide. With respect to the crystalline structure, the silver iodide can have not only β form and γ form but also, as described in U.S. Pat. No. 4,672,026, a form or a structure similar thereto. In the present invention, although the crystalline structure is not particularly limited, it is preferred to employ a mixture of β form and γ form, more preferably β form only. Although the silver iodide fine grain emulsion may be one prepared immediately before the addition as described in, for example, U.S. Pat. No. 5,004,679, or one having undergone the customary washing, it is preferred in the present invention to employ the silver iodide fine grain emulsion having undergone the customary washing. The silver iodide fine grain emulsion can be easily prepared by the methods as described in, for example, U.S. Pat. No. 4,672,026. The method of adding an aqueous solution of silver salt and an aqueous solution of iodide by double jet, wherein the grain formation is carried out at a fixed pI value, is preferred. The terminology "pI" used herein means the logarithm of inverse of $I^-$ ion concentration of the system. Although there is no particular limitation with respect to the temperature, pI, pH, type of protective colloid agent such as gelatin, concentration thereof, presence of silver halide solvent, type and concentration thereof, etc., it is advantageous in the present invention that the grain size be 0.1 μm or less, preferably 0.07 μm or less. Although the grain configuration cannot be fully specified because of the fine grains, it is preferred that the variation coefficient of the grain size distribution be 25% or less. When it is 20% or less, the effect of the present invention is especially striking.

The size and size distribution of the silver iodide fine grain emulsion are determined by placing silver iodide fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of observed grain. With respect to the grain size distribution as well, it is determined by the use of the above diameter of a circle having the same projected area. In the present invention, the most effective silver iodide fine grains have a grain size of 0.06 to 0.02 μm and exhibit a variation coefficient of grain size distribution of 18% or less.

After the above grain formation, the silver iodide fine grain emulsion is preferably subjected to, as described in, for example, U.S. Pat. No. 2,614,929, the customary washing and the regulation of pH, pI and concentration of protective colloid agent such as gelatin and regulation of concentration of contained silver iodide. The pH is preferably in the range of 5 to 7. The pI value is preferably set at one minimizing the solubility of silver iodide or one higher than the same. Common gelatin having an average molecular weight of about 100 thousand is preferably used as the protective colloid agent. Also, low-molecular-weight gelatins having an average molecular weight of 20 thousand or less are preferably used. There are occasions in which the use of a mixture of such gelatins having different molecular weights is advantageous. The gelatin amount per kg of emulsion is preferably in the range of 10 to 10 g, more preferably 20 to 80 g. The silver quantity in terms of silver atom per kg of emulsion is preferably in the range of 10 to 100 g, more preferably 20 to 80 g. Although the silver iodide fine grain emulsion is generally dissolved prior to the addition, it is requisite that the agitating efficiency of the system be satisfactorily high at the time of the addition. The agitation rotating speed is preferably set higher than usual. The addition of an antifoaming agent is effective in preventing the foaming during the agitation. Specifically, use is made of antifoaming agents set forth in, for example, Examples of U.S. Pat. No. 5,275,929.

As a more preferable method for forming the first shell, it is possible to form a silver halide phase containing silver iodide while causing iodide ions to generate abruptly by using an iodide ion releasing agent described in U.S. Pat. No. 5,496,694, instead of the conventional iodide ion supply method (the method of adding free iodide ions).

The iodide ion-releasing agent releases iodide ions through its reaction with an iodide ion release control agent (a base and/or a nucleophilic reagent). Preferable examples of this nucleophilic reagent used include the following chemical species, e.g., hydroxide ion, sulfite ion, hydroxylamine, thiosulfate ion, metabisulfite ion, hydroxamic acids, oximes, dihydroxybenzenes, mercaptanes, sulfinate, carboxylate, ammonia, amines, alcohols, ureas, thioureas, phenols, hydrazines, hydrazides, semicarbazides, phosphines and sulfides.

The release rate and timing of iodide ions can be controlled through the control of the concentration and addition method of a base or a nucleophilic reagent or the control of the temperature of the reaction solution. A preferable base is alkali hydroxide.

To generate iodide ions abruptly, the concentrations of the iodide ion-releasing agent and iodide ion release control agent are preferably $1\times10^{-7}$ to 20 M, more preferably, $1\times10^{-5}$ to 10 M, further preferably, $1\times10^{-4}$ to 5 M, and particularly preferably, $1\times10^{-3}$ to 2 M.

If the concentration exceeds 20 M, the addition amounts of the iodide ion-releasing agent and iodide ion release control agent having large molecular weights adversely become too great compared to the capacity of the grain formation vessel.

If the concentration is less than $1\times10^{-7}$ M, the iodide ion-releasing reaction rate adversely becomes too low, and this makes it difficult to abruptly generate the iodide ion-releasing agent.

The temperature is preferably 30 to 80, more preferably, 35 to 75° C., and particularly preferably, 35 to 60° C.

At high temperatures exceeding 80° C., the iodide ion-releasing reaction rate generally becomes extremely high. At low temperatures below 30° C., the iodide ion-releasing reaction temperature generally becomes extremely low. Both cases are undesirable because the use conditions are restricted.

When a base is used to release iodide ions, a change in the solution pH can also be used. If this is the case, the pH range for controlling the rate and timing of releasing iodide ions is preferably 2 to 12, more. preferably 3 to 11, and particularly preferably 5 to 10. Most preferably, the pH after adjustment is 7.5 to 10.0. Under a neutral condition of pH 7, hydroxide ions having a concentration determined by the ion product of water function as control agents.

A nucleophilic reagent and a base can be used jointly. When this is the case, the pH can be controlled within the above range to thereby control the rate and timing of releasing iodide ions.

When iodine atoms are to be released in the form of iodide ions from the iodide ion-releasing agent, these iodine atoms may be entirely released or may partially remain without decomposition.

A second shell is provided on each of the tabular grains having respective bases and first shells. The ratio of the second shells to the total silver amount is preferably 10 mol % to 40 mol %, and the average silver iodide content of the second shells is 0 mol % to 5 mol %. More preferably, the ratio of the second shells is 15 mol % to 30 mol % to the total silver amount, and the average silver iodide content is 0 mol % to 3 mol %. The growth of the second shells on the tabular grains having respective bases and first shells may be made in a direction to raise the aspect ratio of the tabular grains, or to lower the aspect ratio. Basically, the second shells are grown by adding a silver nitrate aqueous solution and a halogen aqueous solution containing a bromide by a double jetting method. It also may be grown by adding a halogen aqueous solution containing a bromide, and thereafter adding a silver nitrate aqueous solution by a single jetting method. The temperature and pH the mixture, the kind and concentration of the protective colloidal agent such as gelatin, and presence/absence, kind and concentration of the silver halide solvent can be widely changed. With respect to pBr, in the present invention the pBr at the time of completion of formation of the layer is preferably higher than the pBr at the time of start of formation of the layer.

Preferably the pBr at the start of formation of the layer is 2.9 or less, and the pBr at the time of completion of formation of the layer is 1.7 or more. More preferably, the pBr at the start of formation of the layer is 2.5 or less, and the pBr at the time of completion of formation of the layer is 1.9 or more. Most preferably, the pBr at the start of formation of the layer is 1 to 2.3, and the pBr at the time of completion of formation of the layer is 2.1 to 4.5.

Dislocation lines preferably exist in the portions of step (b1). Dislocations lines preferably exist in the vicinity of the side face portions of the tabular grains. The term "vicinity of the side face portions" indicates the six sides and inside areas of the six sides of side face portions of the tabular grains, that is, the portions grown in the step (b1). The average number of dislocation lines existing in the side face portions is preferably 10 or more, and more preferably 20 or more per grain. If dislocation lines are densely present or they are observed to cross each other, it is sometimes impossible to correctly count dislocation lines per grain. Even in such situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines for 100 or more grains.

The dislocation line amount distribution is preferably uniform between tabular grains of the present invention. In an emulsion of the present invention, silver halide grains containing 10 or more dislocation lines per grain account for preferably 100 to 50% (number), more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

Next, the step (b2) will now be described.

The first example of the step (b2) is a method of dissolving only the vicinity of the vertexes of the grains by iodide ions, the second example is a method of simultaneously adding a silver salt solution and a iodide salt solution, the third example is a method of substantially dissolving only the vicinity of the vertexes by using a silver halide solvent, and the fourth example is a method of dissolving through halogen conversion.

The first example, the method of dissolution by iodide ions will now be described. Iodide ions are added to the base grains, and thereby the vicinity of each of the vertexes of the base grains dissolves to be rounded. Next, a silver nitrate solution and bromide solution, or a mixture solution of silver nitrate solution, bromide solution and iodide solution, are (is) simultaneously added, and thereby the grains further grow and dislocations are introduced in the vicinity of the vertexes. JP-A-4-149541 and JP-A-9-189974 can be referred to with respect to this method.

With respect to the total amount of the iodide ions added in this example, supposing that the value obtained by multiplying 100 by a value obtained by dividing the total molar number of the iodide ions by the total silver amount molar number of the base grains is $I_2$ (mol %) and the silver iodide content of the base grains is $I_1$ (mol %), $(I_2-I_1)$ is preferably 0 to 8 to obtain an effective dissolution according to the present invention, and more preferably 0 to 4.

A lower concentration of the iodide ions added in this example is more preferable. Specifically, the concentration is preferably 0.2 mol/L or less, and further preferably 0.1 mol/L.

Further, pAg at the time of addition of iodide ions is preferably 8.0 or more, and more preferably 8.5 or more.

After the dissolution of the vertex portions of the base grains by addition of iodide ions to the base grains, the grains are further grown by singly adding a nitrate solution, simultaneously adding a silver nitrate solution and bromide solution, or adding a mixture solution of silver nitrate solution, bromide solution and iodide solution, to introduce dislocations into the vicinities of the vertexes.

The second example, a method of dissolution by simultaneously addition of a silver salt solution and iodide salt solution, will now be described. A silver salt solution and iodide salt solution are rapidly added to the base grains, and thereby it is possible to epitaxial-grow silver iodide or silver halide having a high silver iodide content on the vertex portions of the grains. In this step, preferable addition speed of the silver salt solution and iodide salt solution is 0.2 minutes to 0.5 minutes, and more preferably 0.5 minutes to 2 minutes. This method is detailed in JP-A-4-149541, which can be referred to.

After dissolution of the vertex portions of the base grains by addition of iodide ions to the base grains, the grains are further grown by singly adding a nitrate solution, simultaneously adding a silver nitrate solution and bromide solution, or adding a mixture solution of a silver nitrate solution, bromide solution and iodide solution, to introduce dislocations in the vicinities of the vertexes.

The third example, a method of using a silver halide solvent will now be described.

After A silver halide solvent is added to a dispersion medium containing base grains, if a silver salt solution and iodide salt solution are simultaneously added, silver iodide or silver halide having a high silver iodide content preferentially grows on the vertex portions of the base grains dissolved by the silver halide solvent. In this step, it is not necessary to rapidly add the silver salt solution and iodide solution. This method is detailed in JP-A-4-149541, which can be referred to.

After dissolution of the base grains by addition of iodide ions to the base grains, the grains are further grown by singly adding a silver nitrate solution, simultaneously adding a silver nitrate solution and a bromide solution, or adding a mixture solution of silver nitrate solution, bromide solution and iodide solution, to introduce dislocations in the vicinities of the vertexes.

Next, the fourth example, a method of dissolution through halogen conversion will now be described.

This is a method wherein an epitaxial growth site director (hereinafter referred to as "site director") such as the sensitizing dye described in JP-A-58-108526 and water-soluble iodide is added to the base grains to form epitaxials of silver chloride on the vertex portions of the base grains, and then iodide ions are added to the grains to halogen-convert the silver chloride to silver iodide or silver halide having a high silver iodide content. Although a sensitizing dye, water-soluble thiocyanic acid ions and water-soluble iodide ions can be used as the site director, iodide ions are preferably used. The iodide ions are 0.0005 to 1 mol %, preferably 0.001 to 0.5 mol %, to the base grains. After addition of iodide ions of an optimum amount, a silver salt solution and a chloride salt solution are simultaneously added to the grains, and thereby epitaxials of silver chloride can be formed on the vertex portions of the base grains.

Halogen conversion of silver chloride by iodide ions will now be described. Silver chloride having a large solubility is converted to silver halide having a smaller solubility, by adding halogen ions which can form silver halide having a smaller solubility. This process is called halogen conversion, which is described in U.S. Pat. No. 4,142,900. Silver chloride which have been epitaxial-grown on the vertex portions of the base grains are selectively halogen-converted by iodide ions, and thereby silver iodide phases are formed on the vertex portions of the base grains. The details of this process are described in JP-A-4-149541.

After halogen conversion of silver chloride epitaxial-grown on the vertex portions into silver iodide phase by addition of iodide ions, the grains are further grown by singly adding a silver nitrate solution, or simultaneously adding a silver nitrate solution and a bromide solution, or adding a mixture solution of silver nitrate solution, bromide solution and iodide solution, to introduce dislocations in the vicinities of the vertexes.

Dislocation lines preferably exist in the portions of step (b2). Dislocations lines preferably exist in the vicinity of the vertex portions of the tabular grains. The term "vicinity of the vertex portions" indicates a three-dimensional portion enclosed by perpendicular lines and sides forming each vertex of the grain, each of the perpendicular lines being drawn from a point at a position of x% from the center of a straight line connecting the center of the grain and the vertex to the side forming the vertex. The value of x is preferably 50 to 100, and more preferably 75 to 100. The average number of the dislocation lines present in the side face portions is preferably 10 or more, and more preferably 20 or more per grain. If dislocation lines are densely present or they are observed to cross each other, it is sometimes impossible to correctly count dislocation lines per grain. Even in such situations, however, dislocation lines can be roughly counted to such an extent as in units of 10 lines, like 10, 20, or 30 dislocation lines, thereby making it possible to distinguish these grains from those in which obviously only a few dislocation lines are present. The average number of dislocation lines per grain is obtained as a number average by counting dislocation lines for 100 or more grains.

The dislocation line amount distribution is preferably uniform between tabular grains of the present invention. In an emulsion of the present invention, silver halide grains containing 10 or more dislocation lines per grain account for preferably 100 to 50% (number), more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

Next, the step (b3) will be described.

With respect to epitaxial formation of silver halide on the base grains, U.S. Pat. No. 4,435,501 discloses that silver salt epitaxials can be formed on selected sites, such as edges or vertexes of base grains, by a site director such as iodide ions, aminoazaindene or spectral sensitizing dye. Further, in JP-A-8-69069, silver salt epitaxials are formed on selected sites of ultrathin tabular grain base and the epitaxial phase is subjected to an optimum chemical sensitization to achieve high sensitivity.

Also in the present invention, it is very preferable to provide high sensitivity to the base grains of the present invention by using these methods. As a site director, amino azaindene or spectrum sensitizing dye may be used, or iodide ions or thicyanic acid ions can be used. These site directors can be used appropriately according to the object, and may be used in combination with each other.

The sites for forming silver salt epitaxials can be limited to the edges or vertexes of the base grains, by changing the amount of the sensitizing dye, and addition amount of iodide ions and thiocyanic acid ions. The amount of iodide ions to be added is 0.0005 to 1.0 mol % to the silver amount of the base grains, and preferably 0.001 to 0.5 mol %. Further, the amount of thiocyanic acid ions is 0.01 to 0.2 mol % to the silver amount of the base grains, and preferably 0.02 to 0.1 mol %. After addition of these site directors, a silver salt solution and a halogen salt solution are added to form silver salt epitaxials. The temperature at this step is preferably 40–70° C., and more preferably 45–60° C. Further, pAg in this step is preferably 7.5 or less, and more preferably 6.5 or less. By using the site directors, silver salt epitaxials are formed on the vertex portions, or side face portions of the base grains. Although an emulsion obtained by the above method may be sensitized by selectively performing chemical sensitization on the epitaxial phase as described in JP-A-8-69069, the grains may be further grown by simultaneously adding a silver salt solution and a halogen salt solution after silver salt epitaxial formation. The halogen salt solution to be added in this step is preferably a bromide salt solution, or a mixture solution of bromide salt solution and iodide salt solution. Further, the temperature in this step is 40–80° C., and more preferably 45–70° C. Further, pAg in this step is preferably 5.5 to 9.5, and more preferably 6.0 to 9.0.

The epitaxials formed in step (b3) is characterized in that a halogen composition different from the base grains is formed outside the base grains formed in the step (a). The composition of the epitaxials is preferably AgCl, AgBrCl, AgBrClI, AgBrI, AgI, and AgSCN, etc. Further, it is further preferable to introduce "dopant (metal complex)" as described in JP-A-8-69069 into the epitaxial layer. The location of the epitaxial growth may be at least one of the vertex portions, side face portions and principal plane portions of the base grains, or epitaxial growth may extend over plural portions. Epitaxial growth is preferably made only in the vertex portions, only in the side face portions, or in the vertex portions and side face portions.

Although dislocation lines may not exist in the grains in step (b2), it is more preferable that dislocations lines exist in the grains. Dislocation lines preferably exist in junction portions between the base grains and epitaxial growth portions. The average number of dislocation lines existing in the junction portions or epitaxial portions is preferably 10 or more per grain. More preferably, the number of dislocation lines is at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed. At the formation of epitaxial portions, it is preferred that the emulsion be doped with a 6-cyano metal complex.

Among the 6-cyano metal complex, hose containing iron, ruthenium, osmium, cobalt, rhodium, iridium or chromium are preferable. The addition amount of the metal salt is preferably within the range of $10^{-9}$ to $10^{-2}$ per mol of silver halide, and more preferably within the range of $10^{-8}$ to $10^{-4}$. The metal complex may be added by dissolving it to water or a organic solvent. The organic solvent is preferably miscible with water. As examples of the organic solvent, alcohols, ethers, glycols, ketons, esters, and amides are included.

As the metal complexes, 6-cyanometal complexes represented by the following formula (MA) is especially preferable. The 6-cyano metal complex has advantages of attaining high-sensitive light-sensitive material, and suppressing fogging from arising even when a raw photosensitive material is stored for a long period of time.

$$[M(CN)_6]^{n-} \quad \text{(MA)}$$

wherein M represents iron, ruthenium, osmium, cobalt, rhodium, iridium or chromium, and n represent 3 or 4.

Specific examples of the 6-cyano metal complexes are set forth below:

| | |
|---|---|
| (MA-1) | $[Fe(CN)_6]^{4-}$ |
| (MA-2) | $[Fe(CN)_6]^{3-}$ |
| (MA-3) | $[Ru(CN)_6]^{4-}$ |
| (MA-4) | $[Os(CN)_6]^{4-}$ |
| (MA-5) | $[Co(CN)_6]^{3-}$ |
| (MA-6) | $[Rh(CN)_6]^{3-}$ |
| (MA-7) | $[Ir(CN)_6]^{3-}$ |
| (MA-8) | $[Cr(CN)_6]^{4-}$ |

For the counter cations of the 6-cyano complex, those easily miscible with water, and suitable for precipitation procedure of a silver halide emulsion are preferably used. Examples of the counter ions includes alkali metal ions (e.g. sodium ion, potassium ion, rubidium ion, cesium ion and lithium ion), ammonium ion and alkylammonium ion.

The dislocation line amount distribution is preferably uniform between tabular grains of the present invention. In an emulsion of the present invention, silver halide grains containing 10 or more dislocation lines per grain account for preferably 100 to 50% (number), more preferably, 100 to 70%, and most preferably, 100 to 90%.

A percentage lower than 50% is undesirable in respect of homogeneity between grains.

To obtain the ratio of grains containing dislocation lines and the number of dislocation lines in the present invention, it is preferable to directly observe dislocation lines for 100 grains or more, more preferably 200 grains or more, and particularly preferably 300 grains or more.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein such as a gelatin derivative, a graft polymer of gelatin and another high polymer, albumin, and casein; cellulose derivatives such as hydroxyethylcellulose, carboxymethylcellulose, and cellulose sulfates; sugar derivatives such as soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Besides gelatin of the present invention and lime-processed gelatin, examples of gelatin are oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

Preferable gelatin is succinated gelatin whose amino groups are modified by 95% or more, and trimellitated gelatin, or acid-processed gelatin. Further, low-molecular weight gelatin, and low-molecular weight acid-processed gelatin are preferably used.

Further, gelatin containing 30 mass % or more, preferably 35 mass % or more, of components having the molecular weight distribution of 280,000 or more to the whole gelatin may be used. Lime-processed gelatin comprises sub a (having low molecular weight), α (having molecular weight of approximately 100,000), β (having molecular weight of approximately 200,000), γ (having molecular weight of approximately 300,000), and a large high-molecular weight portion (void: having molecular weight exceeding 300,000), classified based on the molecular weight. The ratio of each of the components, that is, the molecular weight distribution is measured by PAGI method which is internationally decided. A further detailed explanation and process are detailed in JP-A-11-237704.

It is preferable to wash with water an emulsion of the present invention to desalt, and disperse into a newly prepared protective colloid. In the system, the above hydrophilic colloid and gelatin can be used as protective colloid. And it is favorable that gelatin containing 30 mass % or more, preferably 35 mass % or more, of components having the molecular weight distribution of 280,000 or more is used. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

The third emulsion of the present invention will now be described.

In the third emulsion of the present invention, 50% or more of the total projected area is occupied with silver iodobromide or silver chloroiodobromide tabular grains having (111) faces as principal planes.

A tabular grain used in the present invention has one twin plane or two or more parallel twin planes. The twin plane is a (111) plane on the two sides of which ions at all lattice points have a mirror image relationship.

When viewed in a direction perpendicular to its principal planes, the tabular grain has a triangular shape, a hexagonal shape, or a rounded triangular or hexagonal shape. Each of these shapes has parallel outer surfaces.

In tabular grains of the present invention, 50% or more of the total projected area are accounted for by tabular grains having a thickness of less than 0.2 μm and an equivalent-circle diameter of 0.6 μm or more.

One example of an aspect ratio measurement method is to take a transmission electron micrograph by a replica method and obtain the equivalent-circle diameter and thickness of each individual grain. In this method, the thickness is easily calculated from the length of the shadow of a replica.

In the present invention, the aspect ratio of a tabular grain means a value obtained by dividing the equivalent-circle diameter of each silver halide grain by its thickness. The average aspect ratio means an average value of aspect ratio of all grains.

The equivalent-circle diameter of a tabular grain of the present invention is 0.6 μm or more, preferably, 1.0 μm or more, more preferably 1.5 μm or more, and most preferably, 2 μm or more. Also, the equivalent-circle diameter of a tabular grain is 10 μm or less.

The thickness of a tabular grain is less than 0.2 μm, preferably, 0.1 μm or less, more preferably, 0.05 μm or less. Also, the thickness of a tabular grain is 0.01 μm or more.

In the emulsion of the present invention, the variation coefficient of equivalent-circle diameter of all the grains is, preferably, 40% or less, more preferably, 25% or less, most preferably, 15% or less.

The tabular grain of the present invention is silver iodobromide or silver chloroiodobromide. Furthermore, other silver salts, such as silver rhodanate, silver sulfide, silver selenide, silver telluride, silver carbonate, silver phosphate and an organic acid salt of silver, may be contained in the form of other separate grains or as parts of silver halide grains.

The range of silver iodide content of the emulsion grains of the present invention is preferably 0.1 to 20 mol %, more preferably 0.3 to 15 mol %, and especially preferably 1 to 10 mol %, which may be selected according to the object. The content exceeding 20 mol % is not preferable since it reduces the developing speed.

The range of silver chloride content of the tabular grains of the present invention is preferably 0–20 mol %, more preferably 0–15 mol %, and especially preferably 0–7 mol %, which may be selected according to the object.

The aspect ratio of the tabular grains of the present invention is 3 or more, preferably 10 to 300, more preferably 10 to 100, and most preferably 15 to 100.

Each of the tabular grains of the present invention preferably has a silver iodobromide phase inside the grain. The wording "inside the grain" indicates an arbitrary region ranging from the center of the tabular grain to a position at 0.9L in the radial direction, when the length of a perpendicular line drawn from the center of the tabular grain to a side of the grain is L. If dislocation lines are viewed at the fringe portion of the grain, it indicates a region into which no dislocation lines are introduced.

The iodine content of the silver iodobromide phase is preferably 1 mol % to 40 mol %, more preferably 1 mol % to 20 mol %, and most preferably 1 mol % to 10 mol %.

Since thin tabular grains as in the present invention have large surface areas, twin crystal dislocation as described above causes great ineffectiveness.

It is possible to obtain tabular grains having no annual ring structure, by performing grain growth not by a common DJ method but a fine-grain addition growth method. A fine-grain addition growth method can be performed with reference to JP-A-10-43570, for example.

The surface iodine content of the emulsion of the present invention is preferably 0 mol % to 5 mol %. The surface iodine content can be measured by an ESCA (also called "XPS") method (a method of irradiating grains with X-rays and dispersing photoelectrons emitted from surfaces of the grains). The surface iodine content of the present invention is more preferably 4 mol % or less, and further preferably 3 mol % or less.

Dislocation lines can be introduced with reference to the description of the example of JP-A-3-175440, for example. Dislocation lines may be introduced into the fringe portions, or only into the vicinity of the vertexes of the grains. Further, it is also preferable to introduce dislocation lines by using the iodine emission agent described in JP-A-6-258745.

In the present invention, the principal planes of each of the tabular silver halide grains are preferably controlled to be (111) faces under the presence of at least one kind of crystal-habit control agent. In this specification, a compound having a character of adsorbing stronger to (111) faces of silver halide crystals is called "(111) crystal-habit control agent". If a compound of such a character is made exist at the time of formation of (111) principal plane-type tabular grains, the compound adsorbs to the principal planes of the tabular grains to inhibit growth of the tabular grains in the thickness direction, and consequently it is possible to obtain thinner tabular grains. The compounds represented by the formulae (III), (IV) or (V) are preferable as the (111) crystal-habit control agent.

In the formula (III), $R^{1'}$ represents an alkyl group, alkenyl group or aralkyl group, and preferable specific examples thereof are straight-chain, branched or annular alkyl group of carbon number 1–20 (such as methyl group, ethyl group, isopropyl group, tert-butyl group, n-octyl group, n-decyl group, n-hexadecyl group, cyclopropyl group, cyclopentyl group, and cyclohexyl group), alkenyl group of carbon number 2–20 (such as allyl group, 2-butenyl group and 3-pentenyl group), and aralkyl group of carbon number 7–20 (such as benzyl group and phenethyl group). The substituents represented by $R^1$ may be further substituted. The substituents used in such a case are the following substituents represented by $R^{2'}$ to $R^{6'}$.

Each of $R^{2'}$ to $R^{6'}$ independently represents a hydrogen atom or substituent. However, at least one of $R^{2'}$, $R^{3'}$, $R^{4'}$, $R^{5'}$ and $R^{6'}$ represents an aryl group. Examples of the above substituent are halogen atom, alkyl group, alkenyl group, alkynil group, aralkyl group, aryl group, heterocyclic compound (such as pyridyl group, furyl group, imidazolyl group, piperidyl group, and morpholino group), alkoky group, aryloxy group, amino group, acylamino group, ureide group, urethane group, sulfonylamino group, sulfamoyl group, carbamoyl group, sulfonyl group, sulfinyl group, alkyloxycarbonyl group, acyl group, acyloxy group, amide phosphate group, alkylthio group, arylthio group, cyano group, sulfo group, carboxy group, hydroxy group, phosphono group, nitro group, sulfino group, ammonio group (such as trimethylammonio group), phosphonio group, and hydrazino group. These groups may be further substituted. Further, each pair of $R^{2'}$ and $R^{3'}$, $R^{3'}$ and $R^{4'}$, $R^{4'}$ and $R^{5'}$, and $R^{5'}$ and $R^{6'}$ may be bound with each other and condensed to form a quinoline ring, isoquinoline ring, and acridine ring, for example.

In the formula (III), $X^-$ represents a counteranion. Examples of the counteranion are halogen ion (chloro ion, bromine ion), nitric acid ion, sulfuric acid ion, p-tluenesulfonic acid ion, and trifluoromethane sulfonic acid ion.

In a preferable example of the compounds represented by the formula (III), $R^{1'}$ represents an aralkyl group, $R^{4'}$ represents an aryl group, and $X^-$ represents a halogen ion. Next, the compounds of the formulae (IV) and (V) used in the present invention will now be described.

In the formulae (IV) and (V), each of $A^1$, $A^2$, $A^3$ and $A^4$ independently represents a nonmetallic atom group for completing a nitrogenous heterocycle. The nonmetallic atom group may contain an oxygen atom, nitrogen atom, and sulfur atom. Further, a benzene ring may be condensed with each of the nitrogenous heterocycles formed of $A^1$, $A^2$, $A^3$ and $A^4$. Furthermore, each of the nitrogenous heterocycles formed of $A^1$, $A^2$, $A^3$ and $A^4$ may have a substituent, and the nitrogenous heterocycles may have the same substituent, or different substituents. The substituent is an alkyl group, aryl group, aralkyl group, alkenyl group, halogen atom, acyl group, alkokycarbonyl group, aryloxycarbonyl group, sulfo group, carboxy group, hydroxy group, alkoky group, aryloxy group, amide group, sulfamoyl group, carbamoyl group, ureide group, amino group, sulfonyl group, cyano group, nitro group, mercapto group, alkylthio group or arylthio group. Each of the nitrogenous heterocycles formed of $A^1$, $A^2$, $A^3$ and $A^4$ is preferably 5 to 6-membered ring (such as pyridine ring, imidazole ring, thiozole ring, oxazole ring, pyrazine ring, and pyrimidine ring), and more preferably pyridine ring.

In the formulae (IV) and (V), B represents a coupling group. The coupling group is a group formed of alkylene, arylene, alkenylene, —$SO_2$—, —SO—, —O—, —S—, —CO—, or —N($R^3$)— ($R^3$ represents an alkyl group, aryl group or hydrogen atom), or a combination of two or more of these groups. B is preferably alkylene or alkenylene. In the formula (IV), m represents 0 or 1.

In the formula (IV), each of $R^{1''}$ and $R^{2''}$ independently represents an alkyl group. Each of $R^{1''}$ and $R^{2''}$ is an alkyl group of carbon number 1–20. The alkyl groups represented by $R^{1''}$ and $R^{2''}$ include substituted or non-substituted alkyl groups. The substituents of the alkyl groups are the same as those mentioned as the substituents of $A^1$, $A^2$, $A^3$ and $A^4$. Each of $R^{1''}$ and $R^{2''}$ is preferably an alkyl group of carbon number 4–10, and more preferably an aryl-substituted alkyl group (it may be substituted by a group other than aryl).

In the formulae (IV) and (V), $X^-$ represents an anion. Examples of $X^-$ are chlorine ion, bromine ion, iodine ion, nitric acid ion, sulfuric acid ion, p-tluenesulfonate, and oxalate. In the formulae (IV) and (V), n represents 0, 1 or 2. The compounds represented by the formulae (IV) and (V) may form an intramolecular salt, and in such a case n is 0 or 1.

As specific Examples of the compounds represented by the formula (III), (IV) or (V), in addition to the following, the crystal-habit control agents 1–29 described in JP-A-8-227117 can be mentioned with respect to the formula (III), and the compounds 1–42 disclosed in JP-A-2-32 can be mentioned with respect to the formulae (IV) and (V). However, the present invention is not limited to these compounds.

1

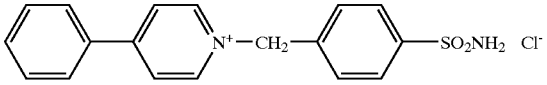

2

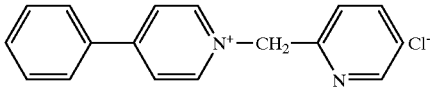

3

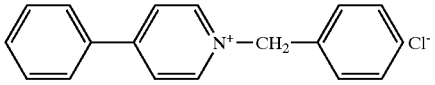

4

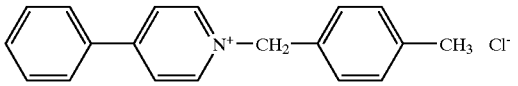

5

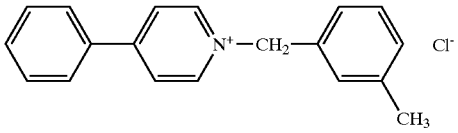

6

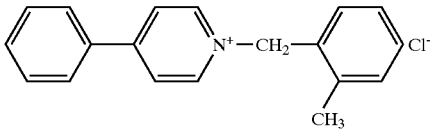

7

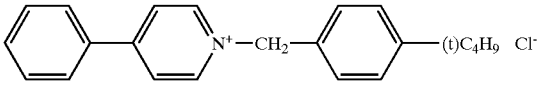

8

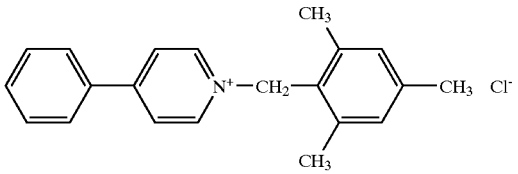

-continued

9

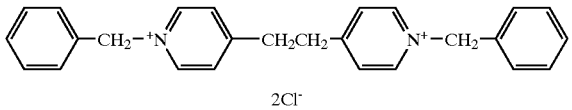

10

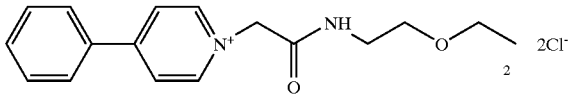

11

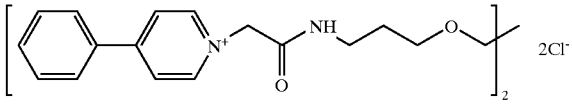

JP-A-10-104769 and Jpn. Pat. Appln. No. 11-255799 disclose a method of preparation of tabular grains using the (111) crystal-habit control agent represented by the formula (III), (IV) or (V). In the present invention, although the (111) crystal-habit control agent may made exist or may not made exist at the time of core formation, it is preferably not made exist but exist at the time of ripening and/or growth. More specifically, the (111) crystal-habit control agent is preferably added after completion of core formation, or in the following ripening step. Further, the (111) crystal-habit control agent is preferably made exist at the time of growth of tabular grains, and further added before the start of growth, or during growth, according to necessity. More preferably, the (111) crystal-habit control agent is continuously added during growth of tabular grains.

In the present invention, the compound represented by the formula (III), (IV) or (V) is preferably added by $10^{-5}$ mol to $10^{-1}$ mol per mol of silver halide, and especially preferably added in the amount of $10^{-4}$ mol to $10^{-1}$ mol.

The (111) face selective crystal-habit control effect which is useful for the present invention can be easily found by the following testing method. Specifically, a common alkali-processed bone gelatin is used as a dispersion medium, and grains are formed by a controlled double-jetting method at 75° C. and +90 mV, by using silver nitrate and potassium bromide for a silver electrode and using a saturated calomel electrode for a reference electrode, and thereby cubic silver bromide grains having (100) faces can be obtained. In this step, when a (111) crystal habit control agent is added in the middle of grain formation, (111) faces arise on the cubes to form tetradecahedral (the corner portions may be rounded), and further change to octahedrons whose all the faces are (111) faces, and thereby the effect of the (111) crystal-habit control agent can be clearly understood.

The fourth emulsion of the present invention and a photographic emulsion other than the present invention to be used together with the fourth emulsion will now be described.

In the fourth emulsion of the present invention, tabular silver halide grains having parallel principal planes being (100) faces, and formed of silver iodobromide or silver chloroiodobromide having a silver chloride content of less than 10 mol % are preferably used. This emulsion will now be described below.

With respect to the above emulsion, 50 to 100%, preferably 70 to 100%, and more preferably 90 to 100%, of the total projected area is occupied by tabular grains having (100) faces as principal planes and having an aspect ratio of 2 or more. The grain thickness is preferably in the range of 0.01 to 0.10 μm, more preferably 0.02 to 0.08 μm, and most preferably 0.03 to 0.07 μm. The aspect ratio is preferably in the range of 2 to 100, more preferably 3 to 50, and most preferably 5 to 30. The variation coefficient of grain thickness (percentage of "standard deviation of distribution/average grain thickness", hereinafter referred to as "COV") is preferably 30% or less, more preferably 25% or less, and most preferably 20% or less. The smaller this COV, the higher the monodispersity of grain thickness.

In the measuring the equivalent circle diameter and thickness of tabular grains, a transmission electron micrograph (TEM) thereof is taken according to the replica method, and the equivalent circle diameter and thickness of each individual grain are measured. In this method, the thickness of tabular grains is calculated from the length of shadow of the replica. In the present invention, the COV is determined as a result of measuring at least 600 grains.

The silver halide composition of the (100) tabular grains of the present invention is silver iodobromide or silver chloroiodobromide having a silver chloride content of less than 10 mol %. Furthermore, other silver salts, such as silver rhodanate, silver sulfide, silver selenide, silver telluride, silver carbonate, silver phosphate and an organic acid salt of silver, may be contained in the form of other separate grains or as parts of silver halide grains.

The X-ray diffraction method is known as means for investigating the halogen composition of AgX crystals. The X-ray diffraction method is described in detail in, for example, Kiso Bunseki Kagaku Koza 24 (Fundamental Analytical Chemistry Course 24) "X-sen Kaisetu (X-ray Diffraction)". In the standard method, Kβ radiation of Cu is used as a radiation source, and the diffraction angle of AgX (420) face is determined by the powder method.

When the diffraction angle 2θ is determined, the lattice constant (a) can be determined by Bragg's equation as follows:

$$2\,d\sin\theta=\lambda$$

$$d=a/(h^2+k^2+l^2)^{1/2},$$

wherein 20 represents the diffraction angle of (hkl) face; λ represents the wavelength of X rays; and d represents the spacing of (hkl) faces. Because, with respect to silver halide solid solutions, the relationship between the lattice constant (a) and the halogen composition is known (described in, for example, T. H. James "The Theory of the Photographic Process, 4th ed.", Macmillian, New York), determination of the lattice constant leads to determination of the halogen composition.

The halogen composition structure of (100) tabular grains according to the present invention is not limited. Examples thereof include grains having a core/shell double structure wherein the halogen compositions of the core and the shell are different from each other and grains having a multiple structure composed of a core and two or more shells. The core is preferably constituted of silver bromide, to which, however, the core of the present invention is not limited. With respect to the composition of the shell, it is preferred that the silver iodide content be higher therein than in the core.

It is preferred that the above (100) tabular grains have an average silver iodide content of 2.3 mol % or more and an average silver iodide content, at the surface of grains, of 8 mol % or more. The intergranular variation coefficient of silver iodide content is preferably less than 20%. The surface silver iodide content, can be measured by the above-mentioned XPS.

The above (100) tabular can be classified by shape into the following six types of grains. (1) Grains whose principal plane shape is a right-angled parallelogram. (2) Grains whose principal plane shape is a right-angled parallelogram having one or more, preferably 1 to 4 corners selected from four corners of which are non-equivalently deleted, namely, grains whose K1=(area of maximum deletion)/(area of minimum deletion) is 2 to 8. (3) Grains whose principal plane shape is a right-angled parallelogram having four corners of which are equivalently deleted (grains whose K1 is smaller than 2). (4) Grains whose 5 to 100%, preferably 20 to 100% of the side of faces in the deletions one (111) faces. (5) Grains having principal planes each with four sides, of which at least two sides opposite to each other are outward protrudent curves. (6) Grains whose principal plane shape is a right-angled parallelogram having one or more, preferably 1 to 4 corners selected from four corners of which are deleted in the shape of a right-angled parallelogram. These features of the grains can be identified by observation through an electron microscope.

With respect to the above (100) tabular grains, the ratio of (100) faces to surface crystal habits is 80% or more, preferably 90% or more. A statistical estimation of the ratio can be performed by the use of an electron micrograph of grains. When the (100) tabular face ratio of AgX grains of an emulsion is nearly 100%, the above estimate can be ascertained by the following method. The method is described in Journal of the Chemical Society of Japan, 1984 No. 6, page 942, which comprises causing a given amount of (100) tabular grains to adsorb varied amounts of benzothiacyanine dye at 40° C. for 17 hr, determining the sum total (S) of surface areas of all grains and the sum total (S1) of areas of (100) faces per unit emulsion from light absorption at 625 nm, and calculating the (100) face ratio by applying these sum total values to the formula: (S1/S)×100 (%).

The average equivalent sphere diameter of the above (100) tabular grains is preferably less than 0.35 μm. An estimate of grain size can be obtained by measuring the projected area and thickness according to the replica method.

An electron-trapping zone is preferably introduced in the above (100) tabular grains by doping with polyvalent metal ions during the grain formation. The electron-trapping zone refers to a portion wherein the polyvalent metal ion content is in the range of $1\times10^{-5}$ to $1\times10^{-3}$ mol/mol localized silver and which occupies 5 to 30% of the grain volume. It is preferred that the polyvalent metal ion content be in the range of $5\times10^{-5}$ to $5\times10^{-4}$ mol/mol localized silver. The terminology "mol localized silver" employed in specifying the polyvalent metal ion content means the silver quantity (mol) which is formed when the polyvalent metal ions are doped.

In the electron-trapping zone, it is requisite that the polyvalent metal ion content be uniform. The expression "being uniform" means that the introduction of polyvalent metal ions in grains is carried out at a fixed proportion per unit silver quantity and that polyvalent metal ions are introduced in a reaction vessel for grain formation simultaneously with the addition of silver nitrate for grain formation. A halide solution may also be added at the same time. A compound containing polyvalent metal ions according to the present invention may be added in the form of an aqueous solution, or fine grains doped with or adsorbing a compound convertible to polyvalent metal ions may be prepared and added. Examples of the polyvalent metals include iron, ruthenium, osmium, cobalt, rhodium, iridium and chromium.

The electron-trapping zone may be present at any internal part of grains. Two or more electron-trapping zones may be present in each grain.

Next, the fifth emulsion of the present invention will now be described.

In the silver halide emulsion of the invention, the silver halide grains have (111) faces or (100) faces as parallel principal planes, an aspect ratio of 2 or more and contain silver chloride in an amount of at least 80 mol. This tabular grains will be described below.

Special measures must be implemented for producing (111) grains of high silver chloride content. Use may be made of the method of producing tabular grains of high silver chloride content with the use of ammonia as described in U.S. Pat. No. 4,399,215 to Wey. Also, use may be made of the method of producing tabular grains of high silver chloride content with the use of a thiocyanate as described in U.S. Pat. No. 5,061,617 to Maskasky. Further, use may be made of the following methods of incorporating additives (crystal habit-controlling agents) at the time of grain formation in order to form grains of high silver chloride content having (111) faces as external surfaces:

| Patent No. | crystal habit-controlling agent | Inventor |
|---|---|---|
| U.S. Pat. No. 4,400,463 | azaindene + thioether peptizer | Maskasky |
| U.S. Pat. No. 4,783,398 | 2,4-dithiazolidinone | Mifune et al. |
| U.S. Pat. No. 4,713,323 | aminopyrazolopyrimidine | Maskasky |
| U.S. Pat. No. 4,983,508 | bispyridinium salt | Ishiguro et al. |
| U.S. Pat. No. 5,185,239 | triaminopyrimidine | Maskasky |
| U.S. Pat. No. 5,178,997 | 7-azaindole compound | Maskasky |
| U.S. Pat. No. 5,178,998 | xanthine | Maskasky |
| JP-A-64-70741 | dye | Nishikawa et al. |
| JP-A-3-212639 | aminothioether | Ishiguro |
| JP-A-4-283742 | thiourea derivative | Ishiguro |
| JP-A-4-335632 | triazolium salt | Ishiguro |
| JP-A-2-32 | bispyridinium salt | Ishiguro et al. |
| JP-A-8-227117 | monopyridinium salt | Ozeki et al. |

With respect to the formation of (111) tabular grains, although various methods of using crystal habit-controlling agents are known as listed in the above table, the compounds (compound examples 1 to 42) described in JP-A-2-32 are preferred, and the crystal habit-controlling agents 1 to 29 described in JP-A-8-227117 are especially preferred. However, the present invention is in no way limited to these.

The (111) tabular grains are obtained by forming two parallel twinned crystal faces. The formation of such twin faces is influenced by the temperature, dispersion medium (gelatin), halide concentration, etc., so that appropriate conditions must be set on these. In the presence of a crystal habit-controlling agent at the time of nucleation, the gelatin concentration is preferably in the range of 0.1 to 10%. The chloride concentration is 0.01 mol/liter or more, preferably 0.03 mol/liter (liter hereinafter referred to as "L") or more.

JP-A-8-184931 discloses that, for monodispersing grains, it is preferred not to use any crystal habit-controlling agent at the time of nucleation. When no crystal habit-controlling agent is used at the time of nucleation, the gelatin concentration is in the range of 0.03 to 10%, preferably 0.05 to 1.0%. The chloride concentration is in the range of 0.001 to 1 mol/L, preferably 0.003 to 0.1 mol/L. The nucleation temperature, although can arbitrarily be selected as long as it is in the range of 2 to 90° C., is preferably in the range of 5 to 80° C., more preferably 5 to 40° C.

Nuclei of tabular grains are formed at the initial stage of nucleation. However, a multiplicity of non-tabular grain nuclei are contained in the reaction vessel immediately after the nucleation. Therefore, such a technology that, after the nucleation, ripening is carried out to thereby cause only tabular grains to remain while other grains are eliminated is required. When the customary Ostwald ripening is performed, nuclei of tabular grains are also dissolved and eliminated, so that the number of nuclei of tabular grains is reduced with the result that the size of obtained tabular grains is increased. In order to prevent this, a crystal habit-controlling agent is added. In particular, the simultaneous use of gelatin phthalate enables increasing the effect of the crystal habit-controlling agent and thus enables preventing the dissolution of tabular grains. The pAg during the ripening is especially important, and is preferably in the range of 60 to 130 mV with silver/silver chloride electrodes.

The thus formed nuclei are subjected to physical ripening and are grown in the presence of a crystal habit-controlling agent by adding a silver salt and a halide thereto. In the system, the chloride concentration is 5 mol/L or less, preferably in the range of 0.05 to 1 mol/L. The temperature for grain growth, although can be selected from among 10 to 90° C., is preferably in the range of 30 to 80° C.

The total addition amount of crystal habit-controlling agent is preferably $6\times10^{-5}$ mol or more, more preferably in the range of $3\times10^{-4}$ to $6\times10^{-2}$ mol, per mol of silver halides of completed emulsion. The timing of addition of the crystal habit-controlling agent can be at any stage from the silver halide grain nucleation to physical ripening and during the grain growth. After the addition, the formation of (111) faces is started. Although the crystal habit-controlling agent may be placed in the reaction vessel in advance, in the formation of tabular grains of small size, it is preferred that the crystal habit-controlling agent be placed in the reaction vessel simultaneously with the grain growth so that the concentration thereof is increased.

When the amount of dispersion medium used at nucleation is short in growth, it is needed to compensate for the same by an addition. It is preferred that 10 to 100 g/L of gelatin be present for growth. The compensatory gelatin is preferably gelatin phthalate or gelatin trimellitate.

The pH at grain formation, although arbitrary, is preferably in the neutral to acid region.

Now, the (100) tabular grains will be described. The (100) tabular grains are tabular grains having (100) faces as principal planes. The shape of these principal planes is, for example, a right-angled parallelogram, or a tri- to pentagon corresponding to a right-angled parallelogram having one corner selected from the four corners of which has been deleted (deletion having the shape of a right-angled triangle composed of the corner apex and sides making the corner), or a tetra- to octagon corresponding to a right-angled parallelogram having two to four corners selected from the four corners of which have been deleted.

When a right-angled parallelogram having been compensated for the deletions is referred to as a compensated tetragon, the neighboring side ratio (length of long side/length of short side) of the right-angled parallelogram or compensated tetragon is in the range of 1 to 6, preferably 1 to 4, and more preferably 1 to 2.

The formation of tabular silver halide emulsion grains having (100) principal planes is performed by adding an aqueous solution of silver salt and an aqueous solution of halide to a dispersion medium such as an aqueous solution of gelatin under agitation and mixing them together. For example, JP-A's-6-301129, 6-347929, 9-34045 and 9-96881 disclose such a method that, at the formation, making silver iodide or iodide ions, or silver bromide or bromide ions, exist to thereby produce strain in nuclei due to a difference in size of crystal lattice from silver chloride so that a crystal defect imparting anisotropic growability, such as spiral dislocation, is introduced. When the spiral dislocation is introduced, the formation of two-dimensional nuclei at the surface is not rate-determining under low supersaturation conditions with the result that the crystallization at the surface is advanced. Thus, the introduction of spiral dislocation leads to the formation of tabular grains. Herein, the low supersaturation conditions preferably refer to 35% or less, more preferably 2 to 20%, of the critical addition. Although the crystal defect has not been ascertained as being a spiral dislocation, it is contemplated that the possibility of spiral dislocation is high from the viewpoint of the direction of dislocation introduction and the impartation of anisotropic growability to grains. It is disclosed in JP-A's-8-122954 and 9-189977 that, for reducing the thickness of tabular grains, retention of the introduced dislocation is preferred.

Moreover, the method of forming the (100) tabular grains by adding a (100) face formation accelerator is disclosed in JP-A-6-347928, in which use is made of imidazoles and 3,5-diaminotriazoles, and JP-A-8-339044, in which use is made of polyvinyl alcohols. However, the present invention is in no way limited thereto.

Although the grains of high silver chloride content refer to those having a silver chloride content of 80 mol % or more, it is preferred that 95 mol % or more thereof consist of silver chloride. The grains of the present invention preferably have a so-termed core/shell structure consisting of a core portion and a shell portion surrounding the core portion. Preferably, 90 mol % or more of the core portion consists of silver chloride. The core portion may further consist of two or more portions whose halogen compositions are different from each other. The volume of the shell portion is preferably 50% or less, more preferably 20% or less, of the total grain volume. The silver halide composition of the shell portion is preferably silver iodochloride or silver iodobromochloride. The shell portion preferably contains 0.5 to 13 mol %, more preferably 1 to 13 mol %, of iodide. The silver iodide content of a whole grain is preferably 5 mol % or less, more preferably 1 mol % or less.

Also, it is preferred that the silver bromide content be higher in the shell portion than in the core portion. The silver bromide content of a whole grain is preferably 20 mol % or less, more preferably 5 mol % or less.

The average grain size (equivalent sphere diameter in terms of volume) of silver halide grains, although not particularly limited, is preferably in the range of 0.1 to 0.8 μm, more preferably 0.1 to 0.6 μm.

The tabular grains of silver halides preferably have an equivalent circle diameter of 0.2 to 1.0 μm. Herein, the diameter of silver halide grains refers to the diameter of a circle having the same area as the projected area of each individual grain in an electron micrograph. The thickness of silver halide grains is preferably 0.2 μm or less, more preferably 0.1 μm or less, and most preferably 0.06 μm or less. In the present invention, 50% or more, in terms of a ratio to total projected area of all the grains, are occupied by silver halide grains having an aspect ratio (ratio of grain diameter/thickness) of 2 or more, preferably ranging from 5 to 20.

Generally, the tabular grains are of a tabular shape having two parallel surfaces. Therefore, the "thickness" of the present invention is expressed by the spacing of two parallel surfaces constituting the tabular grains.

The grain size distribution of silver halide grains of the present invention, although may be polydisperse or monodisperse, is preferably monodisperse. In particular, the variation coefficient of equivalent circle diameter of tabular grains occupying 50% or more of the total projected area is preferably 20% or less, ideally 0%.

When the crystal habit-controlling agent is present on the grain surface after the grain formation, it exerts influence on the adsorption of sensitizing dye and the development. Therefore, it is preferred to remove the crystal habit-controlling agent after the grain formation. However, when the crystal habit-controlling agent is removed, it is difficult for the (111) tabular grains of high silver chloride content to maintain the (111) faces under ordinary conditions. Therefore, it is preferable to retain the grain configuration by substitution with a photographically useful compound such as a sensitizing dye. This method is described in, for example, JP-A's-9-80656 and 9-106026, and U.S. Pat. Nos. 5,221,602, 5,286,452, 5,298,387, 5,298,388 and 5,176,992.

The crystal habit-controlling agent is desorbed from grains by the above method. The desorbed crystal habit-controlling agent is preferably removed out of the emulsion by washing. The washing can be performed at such temperatures that the gelatin generally used as a protective colloid is not solidified. For the washing, use can be made of various known techniques such as the flocculation method and the ultrafiltration method. The washing temperature is preferably 40° C. or higher.

The desorption of the crystal habit-controlling agent from grains is accelerated at low pH values. Therefore, the pH of the washing step is preferably lowered as far as excess aggregation of grains does not occur.

In the silver halide grains, use can be made of ions or complex ions of a metal selected from among metals of Group VIII of the periodic table, namely, osmium, iridium, rhodium, platinum, ruthenium, palladium, cobalt, nickel and iron either individually or in combination. Further, use can be made of a plurality of metals selected from among the above metals.

Compounds capable of providing the above metal ions can be incorporated in the silver halide grains of the present invention by various methods, for example, the method of adding such compounds to an aqueous solution of gelatin as a dispersion medium, an aqueous solution of halide, an aqueous solution of silver salt or other aqueous solutions at the time of formation of silver halide grains, or the method of adding such metal ions to the silver halide emulsion in the form of silver halide fine grains loaded with metal ions in advance and thereafter dissolving the emulsion. The incorporation of metal ions in the grains can be effected before, during or immediately after the grain formation. The incorporation timing can be varied depending on the position of grains where metal ions are incorporated and the amount of the metal ions.

It is preferred that 50 mol % or more, preferably 80 mol % or more, and more preferably 100 mol %, of the employed metal ion-providing compound be localized in a surface layer of silver halide grains which corresponds to 50% or less of the grain volume extending from the silver halide grain surface. The volume of the surface layer is preferably 30% or less of the grain volume. The localization of metal ions in the surface layer is advantageous for realizing high sensitivity while suppressing the increase of internal sensitivity. The concentrating of the metal ion-providing compound in the surface layer of silver halide grains can be accomplished by, for example, first forming silver halide grains (core), to which no surface layer is formed and thereafter adding a solution of water-soluble silver salt and an aqueous solution of halide for forming a surface layer while, simultaneously with the addition, feeding the metal ion-providing compound.

Various polyvalent metal ion impurities, other than the Group VIII metals, can be introduced in the silver halide emulsion in the emulsion grain formation or physical ripening step. The addition amount of compounds as polyvalent metal ion impurities, although widely varied depending on the purpose, is preferably in the range of $10^{-9}$ to $10^{-2}$ mol per mol of silver halides.

The silver halide emulsion may be further characterized according to the layer for which the emulsion is used. In particular, if the emulsion is used for a blue-sensitive layer, silver halide grains contained in the silver halide emulsion (the sixth emulsion of the present invention) preferably has an average silver iodide content of 3 mol % or more, and more preferably 5 mol % or more. Further, if the emulsion is used for a high-sensitive layer, the equivalent circle diameter is preferably 1 $\mu$m or more, and more preferably 2 $\mu$m or more.

Although the aspect ratio of tabular grains other than the first to sixth emulsion grains of the present invention may be discretionarily selected, it is preferably 10 to 300, more preferably 10 to 100, and most preferably 15 to 100.

Further, in order to provide the light-sensitive material with resistance to pressure, the following feature may be provided to the silver halide emulsion. With respect to the silver halide grains contained in the silver halide emulsion, grains having no dislocation lines in an area not exceeding 50%, preferably not exceeding 80%, of the whole area of the principal planes from the center of the principal planes when viewed by a transmission electron microscope preferably occupy at least 80%, more preferably at least 90%, of the projected areas of all the grains. The term "center of the principal plane" means the center of gravity in the area of the principal plane.

The details concerning the whole emulsion of the present invention will now be described.

The emulsions which can be used for the present invention can be prepared by using the methods described in: P. Glafkides, "Chemie et Phisique Photographique" published by Paul Montel, 1967; G. F. Duffin, "Photographic Emulsion Chemistry" Focal Press, 1966; and V. L. Zelikman et al., "Making and Coating Photographic Emulsion" Focal Press, 1964, etc. Specifically, any of acid process, neutral process and ammonia process may be used. Further, as a form of reacting water-soluble silver salt with water-soluble halogen salt, any of one-side mixing process, simultaneous mixing process, and a combination thereof may be used. It is also possible to use a process of forming grains under excess of silver ions (a so-called back mixing process). As a form of the simultaneous mixing process, it is also possible to use a method of maintaining a constant pAg in the liquid phase to generate silver halide, that is, so-called controlled double jetting method. According to this method, it is possible to obtain a silver halide emulsion having a regular crystal form and approximately uniform grain size. A method of adding silver halide grains, which are formed by precipitation in advance, to a reaction vessel for preparing an emulsion, and the methods described in U.S. Pat. Nos. 4,334,012, 4,301,241 and 4,150,994 are preferable according to circumstances. These can be used as seed crystals, and also effectively supplied as silver halide for growth. In the case of the latter, it is preferable to add an emulsion having a small grain size, and the addition method can be selected from methods such as adding the whole of them at a time, adding them several times separately, or continuously adding them. Further, it is effective according to circumstances to add grains of various halogen compositions to reform the surface.

U.S. Pat. Nos. 3,477,852 and 4,142,900, EPs 273,429 and 273,430, and West German Patent Publication No. 3,819,241 disclose a method of converting most of, or only a part of, the halogen composition of silver halide grains by a halogen conversion method, which is an effective grain formation method. A solution of soluble halogen or silver halide grains can be added to be converted to a more solution-retarded silver salt. A method of conversion can be selected from methods of converting at a time, converting several times separately, or continuously converting.

As a method of grain growth, in addition to a method of adding soluble silver salt and halogen salt at a constant concentration and constant flow speed, a grain formation method of changing the concentration, or changing the flow speed as described in GB Patent No. 1,469,480 and U.S. Pat. Nos. 3,650,757 and 4,242,445 is a preferable method. By increasing the concentration, or increasing the flow speed, it is possible to change the supplied silver halide amount by a linear function, quadratic function, or more complicated function. Further, it is preferable according to circumstances to reduce the supplied silver halide amount, if necessary. Further, it is also an effective method to add plural kinds of soluble silver salt having different solution compositions, or, when adding plural kinds of soluble halogen salt having different solution compositions, increasing one of the halogen salt and reducing the other halogen salt.

The mixing vessel used when reacting a soluble silver salt and soluble halogen salt can be selected from the methods described in U.S. Pat. Nos. 2,996,287, 3,342,605, 3,415,650 and 3,785,777, West German Patent Publications 2,556,885 and 2,555,364.

A silver halide solvent is useful for promoting ripening. For example, it is known to make halogen ions of excessive amount exist in a reaction vessel in order to promote ripening. Other ripening agents can also be used. These ripening agents can be blended in the whole amount into a dispersion medium in a reaction vessel before addition of silver and halide salts, or can be introduced into the reaction vessel simultaneously with addition of halide salt, silver salt or deflocculant. As another modified example, a ripening agent can be independently introduced at the step of addition of halide salt and silver salt.

Examples of the ripening agent are ammonia, thiocyanate (such as potassium rhodanide and ammonium rhodanide), organic thioether compound (such as the compounds described in U.S. Pat. Nos. 3,574,628, 3,021,215, 3,057,724, 3,038,805, 4,276,374, 4,297,439, 3,704,130 and 4,782,013, and JP-A-57-104926), thione compound (such as 4-substituted thiourea described in JP-A-53-82408 and 55-77737 and U.S. Pat. No. 4,221,863, and the compound described in JP-A-53-144319), a mercapto compound which can promote growth of silver halide grains described in JP-A-57-202531, and amine compound (such as the compound described in JP-A-54-100717).

There are cases where a method of adding a chalcogen compound as described in U.S. Pat. No. 3,772,031 during preparation of emulsion is also useful. In addition to S, Se and Te, cyanogen salt, thiocyanogen salt, selenocyanic acid, carbonate, phosphate and acetate may exist.

In the formation of silver halide grains of the present invention, at least one of chalcogenide sensitization such as sulfur sensitization, selenium sensitization, and tellurium sensitization; noble metal sensitization such as gold sensitization and palladium sensitization; and reduction sensitization can be performed at any point during the process of manufacturing a silver halide emulsion. The use of two or more different sensitizing methods is favored. Several different types of emulsions can be prepared by changing the timing at which this chemical sensitization is performed. The emulsion types are classified into: a type in which a chemical sensitization speck is embedded inside a grain; a type in which it is embedded in a shallow position from the surface of a grain; and a type in which it is formed on the surface of a grain. In an emulsion of the present invention, the position of a chemical sensitization speck can be selected in accordance with the intended use. However, it is generally preferable to form at least one type of a chemical sensitization speck near the surface.

One chemical sensitization which can be preferably performed for silver halide emulsion grains of the present invention is chalcogenide sensitization, noble metal sensitization, or the combination of the two. Sensitization can be performed by using an active gelation as described in T. H. James, The Theory of the Photographic Process, 4th ed., Macmillan, 1977, pages 67 to 76. Sensitization can also be performed by using any of sulfur, selenium, tellurium, gold, platinum, palladium, and iridium, or by using the combination of a plurality of these sensitizers at a pAg 5 to 10, a pH of 5 to 8, and a temperature of 30 to 80° C., as described in Research Disclosure (RD), Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755. In noble metal sensitization, salts of noble metals, such as gold, platinum, palladium, and iridium, can be used. In particular, gold sensitization, palladium sensitization, or the combination of the two is preferred. In gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferred palladium compound is represented by $R_2PdX_6$ or $R_2PdX_4$ wherein R represents a hydrogen atom, alkali metal atom, or ammonium group and X represents a halogen atom, i.e., a chlorine, bromine, or iodine atom.

More specifically, a palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is favorable that a gold compound and a palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. Chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for silver halide emulsions of the present invention.

The amount of gold sensitizer is preferably $1\times10^{-4}$ to $1\times10^{-7}$ mol, and more preferably, $1\times10^{-5}$ to $5\times10^{-7}$ mol.

A preferred amount of palladium compound is $1\times10^{-3}$ to $5\times10^{-7}$ mol. A preferred amount of thiocyan compound or selenocyan compound is $5\times10^{-2}$ to $1\times10^{-6}$ mol.

The amount of sulfur sensitizer used for silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization and tellurium sensitization are other favored sensitizing methods for silver halide emulsions of the present invention. Known labile selenium compounds are used in selenium sensitization. Practical examples of selenium compounds are colloidal metal selenium, selenoureas (e.g., N,N-dimethylselenourea and N,N-diethylselenourea), selenoketones, and selenoamides. It is sometimes favorable to perform selenium sensitization in combination with one or both of sulfur sensitization and noble metal sensitization.

Reduction sensitization is preferably performed during grain formation, after grain formation and before chemical sensitization, during chemical sensitization, or after chemical sensitization of the emulsion of the present invention.

Reduction sensitization can be selected from a method of adding reduction sensitizers to a silver halide emulsion, a method called silver ripening in which grains are grown in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers is preferred in that the level of reduction sensitization can be finely adjusted. Known examples of reduction sensitizers are thiourea dioxide, ascorbic acid and its derivative, amines and polyamines, a hydrazine derivative, dihydroxybenzenes and those derivatives (e.g., 4,5-dihydroxy-1,3-disodium benzenesulfonate), hydroxylamines and those derivatives, a silane compound, and a borane compound. In reduction sensitization of the present invention, it is possible to selectively use these known reduction sensitizers and to use two or more types of compounds together. Preferred compounds as reduction sensitizers are thiourea dioxide, ascorbic acid and its derivative, a hydrazine derivative, and dihydroxybenzens and those derivatives. Although the addition amount of reduction sensitizers must be so selected as to meet the emulsion manufacturing conditions, a preferred amount is $10^{-7}$ to $10^{-1}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

An oxidizer for silver is favorably used in the formation of tabular silver halide grains of the present invention.

An oxidizer for silver is a compound having an effect of converting metal silver into silver ion. A compound which converts very fine silver grains, formed as a by-product in the processes of formation and chemical sensitization of silver halide grains, into silver ion is particularly effective. The silver ion produced can form a silver salt sparingly soluble in water, such as a silver halide, silver sulfide, or silver selenide, or a silver salt readily soluble in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2\{Ti(O_2)C_2O_4\}.3H_2O$, $4K_2SO_4.Ti(O_2)OH.SO_4.2H_2O$, and $Na_3\{VO(O_2)(C_2H_4)_2.6H_2O\}$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferred oxidizers for use in tabular grains of the present invention are inorganic oxidizers such as hydrogen peroxide and its adduct, a halogen element, an oxo-acid salt of halogen and thiosulfonate, and organic oxidizers such as quinones. It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be selectively used in the grain formation step or the chemical sensitization step.

Photographic emulsions used in the present invention can contain various compounds in order to prevent fog during the manufacturing process, storage, or photographic processing of a light-sensitive material, or to stabilize photographic properties. Usable compounds are those known as an antifoggant or a stabilizer, for example, thiazoles, e.g., benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes such as triazaindenes, tetrazaindenes (particularly 4-hydroxy-substituted(1,3,3a,7)tetrazaindenes), and pentazaindenes. For example, compounds described in U.S. Pat. Nos. 3,954,474 and 3,982,947 and Jpn. Pat. Appln. KOKOKU Publication No. (hereinafter referred to as JP-B-) 52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during the preparation of an emulsion to achieve their original fog preventing effect and stabilizing effect. In addition, the antifoggants and the stabilizers can be used for various purposes of, e.g., controlling the crystal habit of grains, decreasing the grain size, decreasing the solubility of grains, controlling chemical sensitization, and controlling the arrangement of dyes.

Photographic emulsions used in the present invention are preferably subjected to spectral sensitization by methine dyes and the like in order to achieve the effects of the present invention. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. Any nucleus commonly used as a basic heterocyclic nucleus in cyanine dyes can be applied to these dyes. Examples of an applicable nucleus are a pyrroline nucleus, oxazoline nucleus, thiozoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1,344,281 and 1,507,803, JP-B-43-4936, JP-B-53-12375, JP-A-52-110618, and JP-A-52-109925.

Emulsions can contain, in addition to the sensitizing dyes, dyes having no spectral sensitizing effect or substances not essentially absorbing visible light and presenting supersensitization.

The sensitizing dyes can be added to an emulsion at any point in the preparation of an emulsion, which is conventionally known to be useful. Most ordinarily, the addition is performed after the completion of chemical sensitization and before coating. However, it is possible to perform the addition at the same timing as the addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before the completion of the formation of a silver halide grain precipitation to start spectral sensitization. Alternatively, as disclosed in U.S. Pat. No. 4,225,666, these compounds can be added separately; a portion of the compounds is added prior to chemical sensitization, while the remaining portion is added after that. That is, the compounds can be added at any timing during the formation of silver halide grains, including the method disclosed in U.S. Pat. No. 4,183,756.

The addition amount may be in the range of $4\times10^{-6}$ to $8\times10^{-3}$ mol, per mol of silver halide. However, it is more effective that the addition amount is in the range of about $5\times10^{-5}$ to $2\times10^{-3}$ mol, per mol of silver halide, when the silver halide grain size is in the range of 0.2 to 1.2 $\mu$m, more preferable size thereof.

The silver halide photographic light-sensitive material of the present invention comprises at least one light-sensitive layer containing the emulsion of the present invention. Further, the emulsion of the present invention has advantages of the present invention even if it is contained in any light-sensitive layers.

Techniques such as a layer arrangement technique, silver halide emulsions, dye forming couplers, functional couplers such as DIR couplers, various additives, and development usable in light-sensitive materials using emulsions of the present invention are described in European Patent No. 0565096A1 (laid open in Oct. 13, 1993) and the patents cited in it. The individual items and the corresponding portions are enumerated below.

1. Layer arrangements: page 61, lines 23–35, page 61, line 41–page 62, line 14
2. Interlayers: page 61, lines 36–40
3. Interimage effect donor layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54–page 63, line 5

12. Physical ripening and chemical ripening of emulsions: page 63, lines 6–9
13. Use of emulsion mixtures: page 63, lines 10–13
14. Fogged emulsions: page 63, lines 14–31
15. Non-photosensitive emulsions: page 63, lines 32–43
16. Silver coating amount: page 63, lines 49–50
17. Additives: Described in RD Nos. 17643 (December, 1978), 18716 (November, 1979) and 308119 (December, 1989). The locations where they are described will be listed below, the disclosures of which are incorporated herein by reference.

| Additives | RD17643 | RD18716 | RD308119 |
|---|---|---|---|
| 1. Chemical sensitizers | page 23 | page 648, right column | page 996 |
| 2. Sensitivity increasing agents | | page 648, right column | |
| 3. Spectral sensitizers, super sensitizers | pages 23–24 | page 648, right column to page 649, right column | page 996, right column to page 998, right column |
| 4. Brighteners | page 24 | page 647, right column | page 998, right column |
| 5. Antifoggants and stabilizers | pages 24–25 | page 649, right column | page 998, right column to page 1,000, right column |
| 6. Light absorbents, filter dyes, ultraviolet absorbents | pages 25–26 | page 649, right column to page 650, left column | page 1,003, left to right columns |
| 7. Stain preventing agents | page 25, right column | page 650, left to right columns | page 1,002, right column |
| 8. Dye image stabilizers | page 25 | | page 1,002, right column |
| 9. Hardening agents | page 26 | page 651, left column | page 1,004, right column to page 1,005, left column |
| 10. Binders | page 26 | page 651, left column | page 1,003, right column to page 1,004, right column |
| 11. Plasticizers, lubricants | page 27 | page 650, right column | page 1,006, left to right columns |
| 12. Coating aids, surface active agents | pages 26–27 | page 650, right column | page 1,005, left column to page 1,006, left column |
| 13. Antistatic agents | page 27 | page 650, right column | page 1,006, right column to page 1,007, left column |
| 14. Matting agents | | | page 1,008, left column to page 1,009, left column |

-continued

| | Additives | RD308119 |
|---|---|---|
| 1. | Chemical sensitizers | page 996 |
| 2. | Sensitivity increasing agents | |
| 3. | Spectral sensitizers, super sensitizers | page 996, right column to page 998, right column |
| 4. | Brighteners | page 998, right column |
| 5. | Antifoggants and stabilizers | page 998, right column to page 1,000, right column |
| 6. | Light absorbents, filter dyes, ultraviolet absorbents | page 1,003, left to right columns |
| 7. | Stain preventing agents | page 1,002, right column |
| 8. | Dye image stabilizers | page 1,002, right column |
| 9. | Hardening agents | page 1,004, right column to page 1,005, left column |
| 10. | Binders | page 1,003, right column to page 1,004, right column |
| 11. | Plasticizers, lubricants | page 1,006, left to right columns |
| 12. | Coating aids, surface active agents | page 1,005, left column to page 1,006, left column |
| 13. | Antistatic agents | page 1,006, right column to page 1,007, left column |
| 14. | Matting agents | page 1,008, left column to page 1,009, left column |

18. Formaldehyde scavengers: page 64 lines 54 to 57,
19. Mercapto antifoggants: page 65 lines 1 to 2,
20. Fogging agent, etc. release agents: page 65 lines 3 to 7,
21. Dyes: page 65, lines 7 to 10,
22. Color coupler summary: page 65 lines 11 to 13,
23. Yellow, magenta and cyan couplers: page 65 lines 14 to 25,
24. Polymer couplers: page 65 lines 26 to 28,
25. Diffusive dye forming couplers: page 65 lines 29 to 31,
26. Colored couplers: page 65 lines 32 to 38,
27. Functional coupler summary: page 65 lines 39 to 44,
28. Bleaching accelerator release couplers: page 65 lines 45 to 48,
29. Development accelerator release couplers: page 65 lines 49 to 53,
30. Other DIR couplers: page 65 line 54 to page 66 to line 4,
31. Method of dispersing couplers: page 66 lines 5 to 28,
32. Antiseptic and mildewproofing agents: page 66 lines 29 to 33,
33. Types of sensitive materials: page 66 lines 34 to 36,
34. Thickness of lightsensitive layer and swellinh speed: page 66 line 40 to page 67 line 1,
35. Back layers: page 67 lines 3 to 8,
36. Development processing summary: page 67 lines 9 to 11,
37. Developers and developing agents: page 67 lines 12 to 30,
38. Developer additives: page 67 lines 31 to 44,
39. Reversal processing: page 67 lines 45 to 56,
40. Processing solution open ratio: page 67 line 57 to page 68 line 12,
41. Development time: page 68 lines 13 to 15,
42. Bleach-fix, bleaching and fixing: page 68 line 16 to page 69 line 31,
43. Automatic processor: page 69 lines 32 to 40,
44. Washing, rinse and stabilization: page 69 line 41 to page 70 line 18,
45. Processing solution replenishment and recycling: page 70 lines 19 to 23,
46. Developing agent built-in sensitive material: page 70 lines 24 to 33,
47. Development processing temperature: page 70 lines 34 to 38, and
48. Application to film with lens: page 70 lines 39 to 41.

The present invention will be described in more detail below by way of its examples. However, the present invention is not limited to these examples.

EXAMPLE 1

Synthesis of Modified Gelatin 1a to 1g and 2a

As non-modified alkali-processed original gelatin 1, a common alkali-processed ossein gelatin made from cattle bone. The physical property values of original gelatin 1 are as follows.

Water content: 11.4%

Isoelectric point: 5.0

Mass average molecular weight: 164000 (the molecular weight was measured on the basis of a PAGI method)

In the molecular weight distribution measured by the PAGI method, the high-molecular-weight component is 2.5%, and the low-molecular-weight component is 60.0%. Void/α ratio: 0.13 <the ratio of the height of void portions (having a molecular weight of about 2,000,000 or more) to the height of α chain (having a molecular weight of 100,000) in the exclusion limit of the column (GS-620) used in the GPC profile>

1-1 Synthesis of Modified Gelatin 1a to 1g and Comparative Gelatin 1

Synthesis of Modified Gelatin 1b 836.4 g of water was added to original gelatin 1 <113.6 g (dried mass: 100.0 g)> to swell the gelatin at a room temperature for 30 minutes, and then the gelatin was heated to 60° C. and dissolved. Then, the gelatin was controlled to have ph 8.0 by 5 mol/l of NaOH, and then a mixture made by dissolving 222 mg (1.0 millimole) of 4-(5-mercapto-1-tetrazolyl)benzoic acid (the example compound 1), 115 mg (1.0 millimole) of N-hydroxysuccineimide (NHS) and 191 mg (1.0 millimole) of WSC (N-ethyl-N,N-dimethylaminopropylcarbodiimide hydrochloride) in 50 mL of N,N-dimethylformamide and stirring it at a room temperature for 3 hours was dropped into the gelatin aqueous solution for 30 minutes. After completion of dropping, the gelatin solution was further stirred for 30 minutes while being maintained at 60° C. After completion of reaction, the gelatin solution was controlled to have pH of 8.0 again by 5 mol/l of NaOH, and then dialysis (55° C., 72 hours) was performed. Thereafter, concentration (55° C., 130 hPa) was performed to control the solid concentration of the gelatin solution to be 10 mass %. Then, the gelatin was cooled to 5° C. to obtain 1 kg of modified gelatin 1b as a gelatin set.

Further, modified gelatins (modified gelatins 1a, 1c and 1d) with different chemical modification rates (%) of 4-(5-mercapto-1-tetrazolyl)benzoic acid to the gelatin were synthesized under the same conditions except that the addition amounts of the 4-(5-mercapto-1-tetrazolyl)benzoic acid, WSC and NHS were changed.

Furthermore, for comparison, a modified gelatin (modified gelatin 1g) with a less introduction amount of 4-(5-mercapto-1-tetrazolyl)benzoic acid, modified gelatins (modified gelatins 1e to 1f) with more introduction amount, and the gelatin (comparative gelatin 1) described in the Example of JP-A-3-37643 were synthesized.

1-2 Synthesis of Modified Gelatin 2a 760 mL of water was added to original gelatin 1 (113.6 g) to swell the gelatin at a room temperature for 30 minutes, and then the gelatin was heated to 60° C. and dissolved. Then, the gelatin was controlled to have pH 6.8 by 5 mol/l of NaOH, and thereafter 71.4 mL (H-II-4: 2.2 millimole) of 1% aqueous solution of hardening agent H-II-4 was dropped for 1 hours and the gelatin solution was stirred at 60° C. for 3 hours. In this step, the gelatin was bridged to have a high molecular weight. In the molecular weight distribution measured by the PAGI method, the high-molecular-weight component was 11.8%, and the low-molecular-weight component was 42.5%. Further, the pH of the gelatin solution was controlled to be 8.0 by 5 mol/l of NaOH, and thereafter a mixture obtained in advance by dissolving 133 mg (0.5 millimole) of 4-(5-mercapto-1-tetrazolyl)benzoic acid (the example compound 1) disodium salt, 58 mg (0.5 millimole) of N-hydroxysuccineimide (NHS) and 96 mg (0.5 millimole) of WSC (N-ethyl-N,N-dimethylaminopropylcarbodiimide hydrochloride) in 50 mL of N,N-dimethylformamide and stirring it at a room temperature for 3 hours was dropped into the gelatin aqueous solution for 30 minutes. After completion of dropping, the gelatin solution was further stirred for 30 minutes while being maintained at 60° C. After completion of reaction, dialysis (55° C., 72 hours) was performed. Thereafter, concentration (55° C., 130 hPa) was performed to control the solid concentration of the gelatin solution to be 10 mass %. Then, the gelatin was cooled to 5° C. to obtain 1 kg of modified gelatin 2a as a gelatin set.

The introduction amounts of 4-(5-mercapto-1-tetrazolyl) benzoic acid of modified gelatin 1a to 1g and 2a and comparative gelatin 1 were quantified by UV absorption. The results are shown in Table 1.

TABLE 1

| Modified gelatin | Addition molar number of 4-(5-mercapto-1-tetrazolyl) benzoic acid, NHS and WSC* | Introduction molar number of compound 1** | Remarks |
|---|---|---|---|
| Modified gelatin 1a | 0.5 millimole | 0.2 millimole | Inv. |
| Modified gelatin 1b | 1 millimole | 0.4 millimole | Inv. |
| Modified gelatin 1c | 2 millimole | 0.9 millimole | Inv. |
| Modified gelatin 1d | 2.5 millimole | 1.0 millimole | Inv. |
| Modified gelatin 1e | 5 millimole | 2.1 millimole | Comp. |
| Modified gelatin 1f | 10 millimole | 3.8 millimole | Comp. |
| Modified gelatin 1g | $1 \times 10^{-6}$ mole | Less than $1 \times 10^{-6}$ mole | Comp. |
| Modified gelatin 2a | 0.5 millimole | 0.11 millimole | Inv. |
| Comparative gelatin 1 | — | 6.3 millimole | Comp. |

*Addition amount to dried gelatin 100 g

**Introduction amount to dried gelatin 100 g

EXAMPLE 2

The effects of the first emulsion in claim 3 and the modified gelatin of the present invention will be shown.

Gelatin 1-4 used for the dispersing medium in the emulsion preparation set forth below have the following characteristics:

Gelatin-1: Conventional alkali-processed ossein gelatin made from bovine bones. No —$NH_2$ group in the gelatin was chemically modified. Gelatin-1 is the same as the original gelatin used in Example 1.

Gelatin-2: Gelatin formed by adding phthalic anhydride to an aqueous solution of gelatin-1 at 50° C. and pH 9.0 to cause chemical reaction, removing the residual phthalic acid, and drying the resultant material. The ratio of the number of chemically modified —$NH_2$ groups in the gelatin was 95%.

Gelatin-3: Gelatin formed by adding trimellitic anhydride to an aqueous solution of gelatin-1 at 50° C. and pH 9.0 to cause chemical reaction, removing the residual trimellitic acid, and drying the resultant material. The ratio of the number of chemically modified —$NH_2$ groups in the gelatin was 95%.

Gelatin-4: Gelatin formed by decreasing the molecular weight of gelatin-1 by allowing enzyme to act on it such that the average molecular weight was 15,000, deactivating the enzyme, and drying the resultant material. No —$NH_2$ group in the gelatin was chemically modified.

All of gelatin-1 to gelatin-4 described above were deionized and so adjusted that the pH of an aqueous 5% solution at 35° C. was 6.0.

(Preparation of Emulsion A-1)

1,300 mL of an aqueous solution containing 1.0 g of KBr and 1.1 g of gelatin-4 described above was stirred at 35° C. (1st solution preparation). 38 mL of an aqueous solution Ag-1 (containing 4.9 g of $AgNO_3$ in 100 mL), 29 mL of an aqueous solution X-1 (containing 5.2 g of KBr in 100 mL), and 8.5 mL of an aqueous solution G-1 (containing 8.0 g of gelatin-4 described above in 100 mL) were added over 30 sec at fixed flow rates by the triple jet method (addition 1). After that, 6.5 g of KBr were added, and the temperature was raised to 75° C. After a ripening step was performed for 12 min, 300 mL of an aqueous solution G-2 (containing 12 g of gelatin-1 described above in 100 mL) were added. Subsequently, 4.2 g of 4,5-dihydroxy-1,3-disodium benzenedisulfonate-monohydrate was added.

Next, 157 mL of an aqueous solution Ag-2 (containing 22.1 g of $AgNO_3$ in 100 mL) and an aqueous solution X-2 (containing 15.5 g of KBr in 100 mL) were added over 28 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 7.52 (addition 2). Subsequently, 329 mL of an aqueous solution Ag-3 (containing 32.0 g of $AgNO_3$ in 100 mL) and an aqueous solution X-3 (containing 21.5 g of KBr and 1.2 g of KI in 100 mL) were added over 53 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 7.52 (addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate. The addition of the aqueous solution X-3 was so performed that the pAg of the bulk emulsion solution in the reaction vessel was held at 7.52 (addition 4).

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. 73.9 g of an AgI fine grain emulsion (containing 13.0 g of AgI fine grains having an average grain size of 0.047 $\mu$m in 100 g) were added. Two minutes after that, 249 mL of the aqueous solution Ag-4 and the aqueous solution X-4 were added by the double jet method.

The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4 (addition 5). After that, desalting was performed by normal flocculation. Water, NaOH, and gelatin-1 described above were added under stirring, and the pH and the pAg were adjusted to 6.4.and 8.6, respectively, at 56° C.

The thus prepared emulsion had an average quivalent sphere diameter of 0.99 $\mu$m, an average aspect ratio of 3.1, and were occupied by silver halide grains having an aspect ratio of 2.5 or more and 4.5 or less in an amount of 60% or more of the total projected area, had an average AgI content of 3.94 mol %, were comprised of tabular silver halide grains whose parallel principal planes were (111) plane, and had the AgI content measured by XPS of the silver halide grain surface of 2.6 mol %. Further, AgCl content was 0 mol %.

Subsequently, the following sensitizing dye ExS-1, potassium thiocyanate, chloroauric acid, sodium thiosulfate, N,N-dimethylselenourea and the following compound RS-1 were sequentially added to thereby attain the optimum chemical sensitization. Thereafter, a 4:1 mixture of the following water-soluble mercapto compounds ExA-1 and ExA-2 were added in a total amount of $3.6\times10^{-4}$ mol per mol of silver halides to thereby complete the chemical sensitization. With respect to the emulsion A-1, the optimum chemical sensitization was attained when the addition amount of ExS-1 was $3.65\times10^{-4}$ mol per mol of silver halides.

Sensitizing dye ExS-1

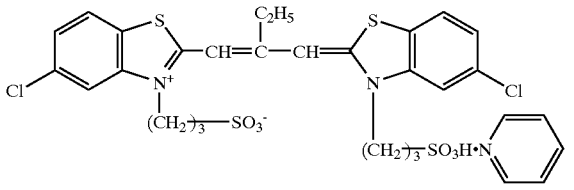

Compound RS-1

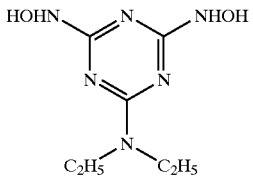

ExA-1

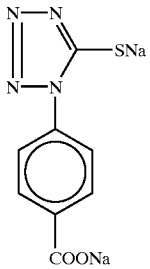

ExA-2

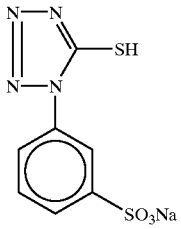

(Preparation of Emulsion A-2)

Emulsion A-2 was prepared under preparation conditions obtained by changing the preparation conditions of the emulsion A-1 as follows.

(i) The gelatin in the G-2 aqueous solution to be added after 12 minutes of ripening step after rising the temperature to 75° C. was changed from the gelatin-1 to gelatin-2.

(ii) In the addition of the Ag-2 aqueous solution in the (Addition 2), the addition flow rate was changed so that the addition time was reduced to 22.4 minutes while the addition liquid amount was maintained at 157 mL. The flow rate was accelerated so that the last flow rate was 3.4 times as much as that of the initial flow rate. Further, the X-2 aqueous solution was added so that pAg of the bulk emulsion solution in the reaction vessel was maintained at 7.83.

(iii) In the addition of the Ag-3 aqueous solution in the (Addition 3), the addition flow rate was changed so that the addition time was reduced to 42.4 minutes while the addition liquid amount was maintained at 329 mL. The flow rate was accelerated so that the final flow rate was 1.6 times as much as the initial flow rate. Further, X-3 aqueous solution was added so that pAg of the bulk emulsion solution in the reaction vessel was maintained at 7.83.

The thus prepared emulsion had an average quivalent sphere diameter of 0.99 μm, an average aspect ratio of 6.9, and were occupied by silver halide grains having an aspect ratio of 5.0 or more and 8.0 or less in an amount of 60% or more of the total projected area, had an average AgI content of 3.94 mol %, were comprised of tabular silver halide grains whose parallel principal planes were (111) plane, and had the AgI content measured by XPS of the silver halide grain surface of 2.4 mol %. Further, AgCl content was 0 mol %. With respect to the emulsion A-2, the optimum chemical sensitization was attained when the addition amount of ExS-1 was $4.60\times10^{-4}$ mol per mol of silver halides.

(Preparation of Emulsion A-3)

Emulsion A-3 was prepared under preparation conditions obtained by changing the preparation conditions of the emulsion A-1 as follows.

(i) The gelatin in the G-2 aqueous solution to be added after 12 minutes of ripening step after rising the temperature to 75° C. was changed from the gelatin-1 to gelatin-3.

(ii) In the addition of the Ag-2 aqueous solution in the (Addition 2), the addition flow rate was changed so that the addition time was reduced to 14 minutes while the addition liquid amount was maintained at 157 mL. The flow rate was accelerated so that the last flow rate was 3.4 times as much as that of the initial flow rate. Further, the X-2 aqueous solution was added so that pAg of the bulk emulsion solution in the reaction vessel was maintained at 8.30.

(iii) In the addition of the Ag-3 aqueous solution in the (Addition 3), the addition flow rate was changed so that the addition time was reduced to 27 minutes while the addition liquid amount was maintained at 329 mL. The flow rate was accelerated so that the final flow rate was 1.6 times as much as the initial-flow rate. Further, X-3 aqueous solution was added so that pAg of the bulk emulsion solution in the reaction vessel was maintained at 8.30.

The thus prepared emulsion had an average quivalent sphere diameter of 0.99 μm, an average aspect ratio of 12.5, and were occupied by silver halide grains having an aspect ratio of 9.0 or more and 15.0 or less in an amount of 60% or more of the total projected area, had an average AgI content of 3.94 mol %, were comprised of tabular silver halide grains whose parallel principal planes were (111) plane, and had the AgI content measured by XPS of the silver halide grain surface of 2.6 mol %. Further, AgCl content was 0%. With respect to the emulsion A-3, the addition amount of sensitizing dye ExS-1 was changed to $6.42\times10^{-4}$ mol per mol of silver halides.

The above emulsions A-1 to A-3 were observed by the use of a 400 kV transmission electron microscope at liquid nitrogen temperature. As a result, it was found that each individual grain thereof had 10 or more dislocation lines at fringe portions of tabular grains thereof.

Further, the emulsions A-1 to A-3 were subjected to reduction sensitization by adding 4,5-dihydroxy-1,3-benzenedisulfonate disodium monohydrate, just before the (Addition 2) in the emulsion preparation process.

(Preparation of Emulsions A-4 to A-6)

Emulsions A-4 to A-6 were prepared in the same manner as emulsions A-1 to A-3 respectively, except that gelatin 1 used in the emulsion preparation step was substituted by the same quantity of the modified gelatin 1b of the present invention.

(Preparation of Emulsions A-7 to A-13 and A-15)

Each of emulsions A-7 to A-13 and A-15 was prepared following the same procedures as for the emulsion A-3 except that the gelatin 1 used in the emulsion preparation step was changed to the modified gelatins, shown in table 2, of an equal quantity thereof.

TABLE 2

| Emulsion | Aspect ratio | Gelatin in grain formation step | Sample No. | Sensitivity | photographic property change after lapse of time (change difference of lapse (i) and lapse (ii)) | Sample No. | Granularity after lapse of time of dissolution (RMS × 1000) | Remarks |
|---|---|---|---|---|---|---|---|---|
| A-1 | 3.1 | Original gelatin 1 | 101 | 100 | +17 | 201 | 20 | Comp. |
| A-2 | 6.9 | Original gelatin 1 | 102 | 122 | +20 | 202 | 25 | Comp. |
| A-3 | 12.5 | Original gelatin 1 | 103 | 161 | +25 | 203 | 28 | Comp. |
| A-4 | 3.1 | Modified gelatin 1b | 104 | 100 | +8 | 204 | 18 | Inv. |
| A-5 | 6.9 | Modified gelatin 1b | 105 | 122 | +6 | 205 | 20 | Inv. |
| A-6 | 12.5 | Modified gelatin 1b | 106 | 160 | +5 | 206 | 21 | Inv. |
| A-7 | 12.5 | Modified gelatin 1a | 107 | 160 | +6 | 207 | 21 | Inv. |
| A-8 | 12.5 | Modified gelatin 1c | 108 | 160 | +5 | 208 | 21 | Inv. |
| A-9 | 12.5 | Modified gelatin 1d | 109 | 160 | +5 | 209 | 21 | Inv. |
| A-10 | 12.5 | Modified gelatin 1e | 110 | 149 | +15 | 210 | 25 | Comp. |
| A-11 | 12.5 | Modified gelatin 1f | 111 | 139 | +14 | 211 | 29 | Comp. |
| A-12 | 12.5 | Modified gelatin 1g | 112 | 160 | +23 | 212 | 28 | Comp. |
| A-13 | 12.5 | Comparative gelatin1 | 113 | 131 | +14 | 213 | 32 | Comp. |
| A-14 | 12.5 | Original gelatin 1* | 114 | 159 | +24 | 214 | 28 | Comp. |
| A-15 | 12.5 | Modified gelatin 2a | 115 | 160 | +4 | 215 | 18 | Inv. |

*4-(5-mercapto-l-tetrazolyl)benzonic acid was added by 1 time mol as much as the molar number of the modified gelatin contained in the emulsion A-9 in the emulsion preparation step.

(Preparation of Emulsion A-14)

Emulsion A-14 was prepared in the same manner as emulsion A-3, except that 4-(5-mercapto-1-tetrazolyl) benzoic acid was added by 1 time mol as much as the molar number of that contained in the emulsion A-9 in the emulsion preparation step.

Each of the emulsions A-1 to A-15 was coated on a cellulose triacetate film base provided with a substratum, under the following coating conditions. The coated samples are called samples 101–115 as shown in Table 2.

(Emulsion Coating Conditions)

With respect to the silver halide, the coating amount in terms of silver is shown.

| | |
|---|---|
| 1) Emulsion layer | |
| various emulsion silver | 1.76 g/m$^2$ |
| magenta dye formation coupler (M-1) | 1.58 g/m$^2$ |
| tricresyl phosphate | 1.32 g/m$^2$ |
| gelatin | 3.24 g/m$^2$ |
| 2) Protective layer | |
| 4-dichloro-6-hydroxy-s-triazinesodium salt | 0.08 g/m$^2$ |
| gelatin | 1.80 g/m$^2$ |

Further, a surface-active agent is contained according to necessity in order to enhance coating property.

Magenta Dye Forming Coupler M-1

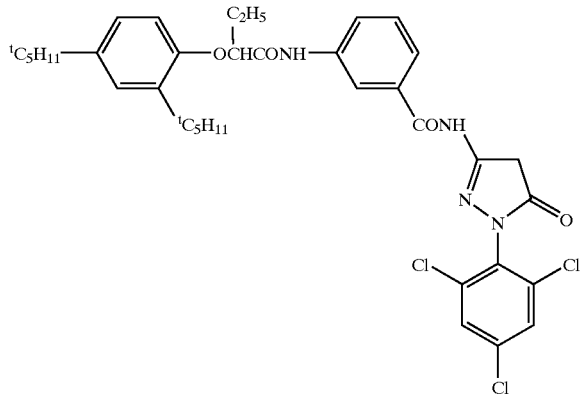

These samples were subjected to a film hardening process at 40° C. and a relative humidity of 70% for 14 hr. The resultant samples were exposed for 1/100 sec through the SC-50 gelatin filter, a long wave length light-transmitting filter having a cut off wave length of 500 nm, manufactured by Fuji Photo Film Co., Ltd. and a continuous wedge. The sensitivity is indicated by the relative value of the reciprocal of an exposure amount required to reach magenta density of fog density plus 0.2. The sensitivity of sample 101 is assumed to 100.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | Temperature | Replenishment rate* |
|---|---|---|---|
| Color development | 2 min. 45 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

| (Bleaching solution) common to tank solution and replenisher | (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Ammonia water (27%) | 15.0 mL |
| Water to make | 1.0 L |
| pH (adjusted by ammonia water and nitric acid) | 6.3 |

| (Bleach-fix bath) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0.05 |
| 1,2,4-triazole | 1.3 |
| 1,4-bis(l,2,4-triazole-l-ylmethyl) piperazine | 0.75 |
| Water to make | 1.0 L |
| pH | 8.5 |

(Evaluation of Change of Photographic Property Due to Lapse of Time)

The change in the sensitivity due to lapse of time after exposure of the coated samples was evaluated by the following method.

The samples 101 to 115 were subjected to exposure for 1/100 second through a continuous optical wedge in the same manner as the above, and then one of each of the samples was kept. at −20° C. for 14 days [lapse (i)] and the other of each of the samples was kept at 40° C. and with the relative humidity of 40% [lapse (ii)]. Thereafter, the samples were subjected to the development with color development time of 1 minute and 45 seconds, and the sensitivity of each of the samples was determined by a relative value of logarithm of a reciprocal number of exposure, which is indicated by a lux and seconds to provide a magenta density equal to a fog density plus 0.5 by a green filter. Further, the sensitivity change differences of lapse (i) and lapse (ii) were compared, and the obtained value were used as values indicating the photographic property change after lapse of time. A smaller value is more preferable since it indicates a small change in photographic property.

(Evaluation of Deterioration of Graininess Due to Grain Aggregation at the Time of Coating)

In the samples 101–115, each of the emulsions was dissolved at 40° C., kept for 8 hours, and thereafter samples 201–205 were prepared under the same coating conditions as those of samples 101–115. These samples 101–115 and 201–215 were left for 14 hours under the conditions of 40° C. and the relative humidity of 70%, and then subjected to the same development as the above, and the RMS granularity of each sample at a density equal to the fog density plus 0.5 was measured. Aggregation of grains deteriorates graininess and increases the value of the RMS granularity.

All the results of the photographic properties are shown in Table 2.

As shown in Table 2, in the emulsions A-1 to A-3, since the grains becomes to be ready to aggregate as the aspect ratio increases, the "RMS granularity after lapse of time after dissolution" deteriorated. If the modified gelatin of the present invention was used, aggregation of grains was inhibited to show the original granularity of grains with no aggregation. Further, as well as the granularity, the present invention is more effective for improving the "change in the photographic property after lapse of time" in the grains having a larger aspect ratio. The effect on the "RMS granularity after lapse of time after dissolution" and "change in the photographic property after lapse of time" is very insufficient as in the emulsion A-12, if the introduction amount of the mercapto compound is less than that of the present invention. Further, simply adding a mercapto compound does not produce the effect, as shown in the emulsion A-14. In the emulsions A-10 and A-11 using modified gelatins with more introduction amounts of mercapto compound than that of the present invention, the effect of preventing aggregation is very insufficient. Further, in the emulsion A-13 using the comparative gelatin 1 described in the example of JP-A-3-37643 with a further more introduction amount, aggregation rather deteriorated. As described above, the introduction amount of silver-affinity group in the modified gelatin of the present invention is indispensable for achieving photographic property excellent in all of the sensitivity, graininess and change in photographic property after lapse of time. Further, the table shows that the emulsion A-15 using the modified gelatin 2a made by introducing silver-affinity group beforehand into macromolecular gelatin produces a great effect in each of the graininess and the change in photographic property after lapse of time.

EXAMPLE 3

The effects of the second emulsion of claim 4 and the modified gelatin of the present invention will be shown. Host silver halide emulsions Em-A and Em-B were prepared by the following process.

(Preparation of Seed Emulsion a)

1164 mL of an aqueous solution containing 0.017 g of KBr and 0.4 g of acid-processed gelatin having an average molecular weight of 20000 was stirred while being maintained at 30. Then an $AgNO_3$ (1.6 g) aqueous solution, KBr aqueous solution and acid-processed gelatin (2.1 g) of an average molecular weight of 20000 ere added to the above solution by a triple jetting method for 30 minutes. The concentration of the $AgNO_3$ solution was 0.2 mol/l. In this step, the silver potential was maintained at 15 mV to a saturated calomel electrode. A KBr aqueous solution was added to change the silver potential to −60 mV, and thereafter the temperature was raised to 75° C. 21 g of succinated gelatin having an average molecular weight of 100000 was added. Then, an $AgNO_3$ (206.3 g) aqueous solution and KBr aqueous solution were added for 61 minutes by a double jetting method with the flow rate accelerated.

In this step, the silver potential was maintained at −40 mV to the saturated calomel electrode. After the solution was desalted, succinated gelatin having an average molecular weight of 100000 was added, and the solution was controlled at 40° C. to have pH 5.8 and pAg 8.8 to obtain a seed emulsion. This seed emulsion contains 1 mol of Ag and 80 g of gelatin per kg of the emulsion, and comprises tabular grains having an equivalent circle diameter of 1.60 μm, coefficient of variation of the equivalent circle diameter of 22%, average thickness of 0.043 μm, and average aspect ratio of 37.

(Preparation of Host Tabular Grain Emulsion Em-A)

1200 mL of an aqueous solution containing 134 g of the above seed emulsion a, 1.9 g of KBr, and 22 g of succinated gelatin having an average molecular weight of 100000 was stirred while being maintained at 75° C. An $AgNO_3$ (137.5 g) aqueous solution, KBr aqueous solution and acid-processed gelatin having a molecular weight of 20000 were mixed just before addition in another chamber having the magnetic coupling induction type stirring apparatus described in JP-A-10-43570, and the mixture was added to the above solution for 25 minutes. In this step, the silver potential was maintained at −40 mV to the saturated calomel electrode. Thereafter, an $AgNO_3$ (30.0 g) aqueous solution, KBr aqueous solution and prepared AgI ultrafine-grain emulsion were added by a triple jetting method for 30 minutes with a constant flow rate. The addition amount of the AgI ultrafine-grain emulsion was adjusted so that the silver iodide content becomes 15 mol %. Further, the AgI ultrafine-grain emulsion has an equivalent circle diameter of 0.03 μm, coefficient of variation of the equivalent circle diameter of 17%, and uses trimellitated gelatin as a dispersion gelatin. In the middle of the step, iridium potassium hexachloride and benzene thiosulfonic acid sodium were added. In this step, the silver potential was maintained at −20 mV to the saturated calomel electrode. Thereafter, an $AgNO_3$ (36.4 g) aqueous solution, KBr aqueous solution and prepared AgI ultrafine-grain emulsion were added for 40 minutes with a constant flow rate. The addition amount of the AgI ultrafine-grain emulsion was adjusted so that the silver iodide content becomes 15 mol %. In this step, the silver potential was maintained at +80 mV to the saturated calomel electrode. Then, a normal washing was performed, gelatin 1 was added, and the emulsion was controlled to have pH 5.8 and pBr 4.0 at 40. This emulsion was used as emulsion Em-A. The emulsion Em-A comprises tabular grains having an equivalent circle diameter of 4.2 μm, coefficient of variation of the equivalent circle diameter of 19%, average thickness of 0.062 μm, and average aspect ratio of 68. Further, grains occupying 90% or more of the total projected area had an equivalent circle diameter of 3.0 μm or more, and thickness of 0.07 μm or less. Furthermore, at least 90% of the total projected area was occupied by hexagonal tabular grains having a 1.4 or less ratio of the length of a side having a maximum length to the length of a side having a minimum length. As a result of observation by a transmission electron microscope at a low temperature, no dislocations lines are observed in grains occupying 90% or more of the total projected area. Further, the (111) face ratio of the edges was 68%.

(Preparation of Host Tabular Grain Emulsions Em-B and Em-C)

Host tabular grain emulsions Em-B and C were prepared in the same manner as the emulsion Em-A, except that the gelatin 1 used in the emulsion preparation step in the emulsion Em-A was substituted by the same quantity of the modified gelatin 1c and 2a respectively disclosed in Example 1 of the present invention.

(Epitaxial Deposition and Chemical Sensitization)

The host tabular grain emulsions Em-A, Em-B and Em-C were subjected to the following epitaxial depositions (i) to (iii).

(i) Each of the host tabular grain emulsions was dissolved at 40° C., and a KI aqueous solution was added in the amount of $3\times10^{-3}$ mol per mol of the silver amount of the host tabular grains. Sensitizing dyes I, II and III with the mol ratio of 6:3:1 were added at the rate of 70% of a saturation coating amount. However, the sensitizing dyes were used as solid fine dispersion substances prepared in the method described in JP-A-11-52507. Specifically, 0.8 parts by mass of sodium nitrate and 3.2 parts by mass of sodium sulfate were dissolved in 43 parts of ion-exchanged water. Further, 13 parts by mass of a sensitizing dye was added to the mixture, and dispersed for 20 minutes under the condition of 60° C. by using dissolver wings at 2000 rpm, and thereby a solid dispersion substance of the sensitizing dye was obtained. $3.1\times10^{-6}$ mol (per mol of the silver amount of the host tabular grains, the same is applicable hereinafter) of hexacyanoruthenium (ii) acid potassium was added, and thereafter $1.5\times10^{-2}$ mol of a KBr aqueous solution was added. Then, $3.0\times10^{-2}$ mol of silver nitrate aqueous solution of 1 mol/l and $2.7\times10^{-2}$ mol of NaCl aqueous solution were added by a double jetting method for 10 minutes at a constant flow rate. The silver potential after completion of addition was +85 mV to the saturated calomel electrode. After $2\times10^{-5}$ mol of antifoggant ExA-3 was added, the temperature of the emulsion was raised to 50° C., and potassium thiocyanate, chloroauric acid, sodium thiosulfate and N,N-dimethylselenourea were added to perform optimum chemical sensitization. Then, $5\times10^{-4}$ mol of the mercapto compound ExA-1 of Example 2 was added, and the chemical sensitization was completed.

Sensitizing dye I

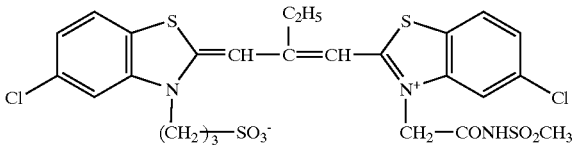

Sensitizing dye II

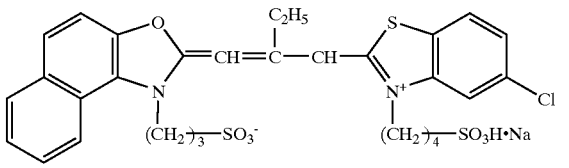

Sensitizing dye III

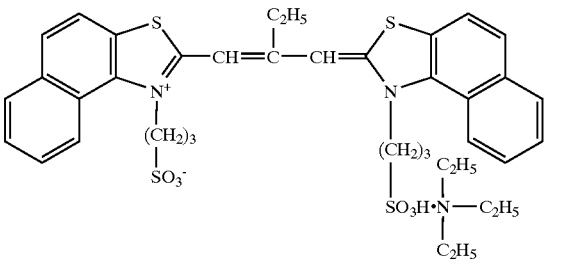

Antifoggant ExA-3

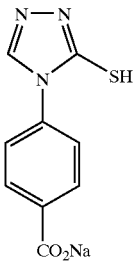

(ii) The host tabular grain emulsion was dissolved at 40° C., and the above AgI ultrafine grain emulsion was added in an amount of $3\times10^{-3}$ mol per mol of silver contained in the host tabular grains. A 6:3:1 in molar ratio mixture of sensitizing dyes I, II and III was added in an amount of 70% based on saturated coating amount. These sensitizing dyes were added in the form of a solid fine dispersion as prepared in the manner described in JP-A-11-52507. Specifically, 0.8 part by mass of sodium nitrate and 3.2 parts by mass of sodium sulfate were dissolved in 43 parts of ion-exchanged water. 13 parts by mass of the sensitizing dyes were added thereto and dispersed at 60° C. with the use of a dissolver blade, rotated at 2000 rpm, for 20 min. Thus, there was obtained a solid dispersion of sensitizing dyes. $3.1\times10^{-6}$ mol (per mol of silver contained in the host tabular grains, also applicable hereinafter) of potassium hexacyanoruthenate (II) and $1.5\times10^{-2}$ mol of an aqueous solution of KBr were sequentially added. Subsequently, $2.7\times10^{-2}$ mol of an aqueous solution of NaCl was added. Thereafter, $3.0\times10^{-2}$ mol of a 0.1 mol/L aqueous solution of silver nitrate was added at constant flow rates over a period of 1 min. The silver potential at the completion of addition was +85 mV against saturated calomel electrode. $2\times10^{-5}$ mol of antifoggant ExA-3 was added, and the temperature of the emulsion was raised to 50° C., and potassium thiocyanate, chloroauric acid, sodium thiosulfate and N,N-dimethylselenourea were added to thereby attain the optimum chemical sensitization. $5\times10^{-4}$ mol of compound ExA-1 was added to thereby complete the chemical sensitization.

(iii) The host tabular grain emulsion was dissolved at 40° C., and the above AgI ultrafine grain emulsion was added in an amount of $3\times10^{-3}$ mol per mol of silver contained in the host tabular grains. A 6:3:1 in molar ratio mixture of sensitizing dyes I, II and III was added in an amount of 70% based on saturated coating amount. These sensitizing dyes were added in the form of a solid fine dispersion as prepared in the manner described in JP-A-11-52507. Specifically, 0.8 part by mass of sodium nitrate and 3.2 parts by mass of sodium sulfate were dissolved in 43 parts of ion-exchanged water. 13 parts by mass of the sensitizing dyes were added thereto and dispersed at 60° C. with the use of a dissolver blade, rotated at 2000 rpm, for 20 min. Thus, there was obtained a solid dispersion of sensitizing dyes. $3.1\times10^{-6}$ mol (per mol of silver contained in the host tabular grains, also applicable hereinafter) of potassium hexacyanoruthenate (II) and $1.5\times10^{-2}$ mol of an aqueous solution of KBr were sequentially added. Thereafter, $3.0\times10^{-2}$ mol of a 0.1 mol/L aqueous solution of silver nitrate and 0 $2.7\times10^{-2}$ mol of an aqueous solution of NaCl were added by the double jet method at constant flow rates over a period of 2 min. The silver potential at the completion of addition was +85 mV against saturated calomel electrode. $2\times10^{-5}$ mol of antifoggant ExA-3 was added, and an aqueous solution of KBr was added to thereby adjust the silver potential to +20 mV against saturated calomel electrode. The temperature of the emulsion was raised to 50° C., and potassium thiocyanate, chloroauric acid, sodium thiosulfate and N,N-dimethylselenourea were added to thereby attain the optimum chemical sensitization. $5\times10^{-4}$ mol of compound ExA-1 was added to thereby complete the chemical sensitization.

With respect to each of the emulsions prepared by performing the above epitaxial deposition on the host tabular grain emulsions, distribution of silver iodide content and silver chloride content between the grains were measured by using an EPMA method. Further, the state of the epitaxial deposition was observed by an electron microscope with a replica. The results in the host tabular grain emulsion Em-A are shown in Table 3 together. The same results were obtained with respect to the host tabular grain emulsions Em-B and C. Each of these 9 kinds of emulsions comprised tabular silver halide grains formed of silver iodobromide having a silver chloride content of 1.2 mol % and silver iodide content of 4.5 mol %.

TABLE 3

| Epitaxial deposition method | Hexagonal tabular ratio (%) | (111) face ratio of side surface | Complete epitaxial emulsion ratio (%) |
|---|---|---|---|
| (i) | 95 | 68 | 85 |
| (ii) | 95 | 68 | 90 |
| (iii) | 95 | 68 | 95 |

Each of the 9 kinds of emulsions was coated in the same manner as Example 2. The coated samples were called samples 301 to 309. Experiments were carried out also with respect to the sensitivity, by performing exposure and development in the same manner as Example 1, regarding the sensitivity of sample 301 as 100. Evaluation of change in the photographic property due to lapse of time was performed in the same manner as Example 2 by using samples 301 to 309.

Further, samples 311 to 319 were prepared by dissolving the 9 kinds of emulsions at 40° C., keeping for 8 hours and then coating them on samples in the same coating conditions as those of samples 301 to 309 respectively. In the same manner as Example 2, their sensitivities and RMS granularities were compared with samples 301 to 309 to evaluate the deterioration in graininess due to aggregation of the grains at the time of coating.

The results are shown in Table 4 together.

As shown in Table 4, the second emulsion of claim 4 the present invention can also reduce the change in the photographic property, without deteriorating the sensitivity. Further, it can also prevent aggregation of the grains at the time of coating and provide an emulsion having an excellent graininess.

EXAMPLE 4

The effects of the third emulsion of claim 5 and the modified gelatin of the present invention will be shown.

(Preparation of Emulsion EM-A1)

(1st Solution Preparation)

1,300 mL of an aqueous solution containing 0.6 g of KBr and 1.1 g of gelatin-4 described above was stirred at 35° C.

(Addition 1)

24 mL of an aqueous solution Ag-1 (containing 4.9 g of $AgNO_3$ in 100 mL), 24 mL of an aqueous solution X-1 (containing 4.1 g of KBr in 100 mL), and 24 mL of an aqueous solution G-1 (containing 1.8 g of gelatin-4 described above in 100 mL) were added over 30 sec at fixed flow rates by the triple jet method. After that, 1.3 g of KBr were added, and the temperature was raised to 75° C. After a ripening step was performed for 12 min, 300 mL of an aqueous solution G-2 (containing 12.7 g of gelatin-3 described above in 100 mL) were added. After that, 8.4 g of 4,5-dihydroxy-1,3-disodium benzenedisulfonate-monohydrate and 0.002 g of thiourea dioxide were sequentially added at an interval of 1 min.

TABLE 4

| Emulsion No. | Host tabular grain emulsion | Epitaxial deposition method | Gelatin in grain formation step | Sensitivity | photographic property change after lapse of time (change difference of lapse (i) and lapse (ii)) | Granularity (RMS × 1000) | Remarks |
|---|---|---|---|---|---|---|---|
| 301 | Em-A | (i) | Original gelatin 1 | 100 | +14 | 31 | Comp. |
| 302 | Em-A | (ii) | Original gelatin 1 | 105 | +15 | 31 | Comp. |
| 303 | Em-A | (iii) | Original gelatin 1 | 108 | +17 | 30 | Comp. |
| 304 | Em-B | (i) | Modified gelatin 1c | 100 | +3 | 31 | Inv. |
| 305 | Em-B | (ii) | Modified gelatin 1c | 105 | +3 | 31 | Inv. |
| 306 | Em-B | (iii) | Modified gelatin 1c | 108 | +3 | 30 | Inv. |
| 307 | Em-C | (i) | Modified gelatin 2a | 100 | +1 | 31 | Inv. |
| 308 | Em-C | (ii) | Modified gelatin 2a | 105 | +1 | 31 | Inv. |
| 309 | Em-C | (iii) | Modified gelatin 2a | 108 | +1 | 30 | Inv. |
| 311 | Em-A | (i) | Original gelatin 1 | 91 | — | 38 | After lapse of time of emulsion dissolution |
| 312 | Em-A | (ii) | Original gelatin 1 | 92 | — | 38 | After lapse of time of emulsion dissolution |
| 313 | Em-A | (iii) | Original gelatin 1 | 94 | — | 38 | After lapse of time of emulsion dissolution |
| 314 | Em-B | (i) | Modified gelatin 1c | 99 | — | 33 | After lapse of time of emulsion dissolution |
| 315 | Em-B | (ii) | Modified gelatin 1c | 105 | — | 31 | After lapse of time of emulsion dissolution |
| 316 | Em-B | (iii) | Modified gelatin 1c | 108 | — | 31 | After lapse of time of emulsion dissolution |
| 317 | Em-C | (i) | Modified gelatin 2a | 100 | — | 31 | After lapse of time of emulsion dissolution |
| 318 | Em-C | (ii) | Modified gelatin 2a | 105 | — | 31 | After lapse of time of emulsion dissolution |
| 319 | Em-C | (iii) | Modified gelatin 2a | 108 | — | 30 | After lapse of time of emulsion dissolution |

(Addition 2)

Next, 157 mL of an aqueous solution Ag-2 (containing 22.1 g of $AgNO_3$ in 100 mL) and an aqueous solution X-2 (containing 15.5 g of KBr in 100 mL) were added over 14 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30.

(Addition 3)

Subsequently, 329 mL of an aqueous solution Ag-3 (containing 32.0 g of $AgNO_3$ in 100 mL) and an aqueous solution X-3 (containing 21.5 g of KBr and 1.6 g of KI in 100 mL) were added over 27 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 8.30.

(Addition 4)

Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate. The addition of the aqueous solution X-3 was so performed that the pAg of the bulk emulsion solution in the reaction vessel was held at 8.30.

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. 73.9 g of an AgI fine grain emulsion (containing 13.0 g of AgI fine grains having an average grain size of 0.047 $\mu$m in 10 g) were added.

(Addition 5)

Two minutes after that, 249 mL of the aqueous solution Ag-4 and the aqueous solution X-4 were added by the double jet method. The addition of the aqueous solution Ag-4 was performed at a fixed flow rate over 16 min. The addition of the aqueous solution X-4 was performed such that the pAg was held at 9.10.

(Addition 6)

In the first 5 minutes, an aqueous solution of yellow prussiate of potash was added with a fixed quantity so as to be $5\times10^{-6}$ mol/mol Ag to the total silver amount. In the following 10 minutes, addition was performed so that the pAg of the bulk emulsion solution in the reaction vessel becomes 7.5.

After that, desalting was performed by normal flocculation. Water, NaOH, and gelatin-1 described above were added under stirring, and the pH and the pAg were adjusted to 5.8 and 8.9, respectively, at 56° C.

The thus prepared emulsion were occupied by silver halide grains having an equivalent circle diameter of 1.2 $\mu$m or more and a grain thickness of less than 0.2 $\mu$m in an amount of 50% or more of the total projected area, had an average aspect ratio of all the grains of 6.0, had an average AgI content of 3.94 mol %, were comprised of tabular silver halide grains whose parallel principal planes were (111) plane, and had the AgI content measured by XPS of the silver halide grain surface of 2.1 mol %. The variation coefficient of equivalent-circle diameter of all the grains was 24%. Further, AgCl content was 0 mol %.

(Preparation of EM-A2 and EM-A3)

Tabular grain emulsions having different grain thickness were prepared by appropriately changing the grain growth conditions, etc. of the emulsion EM-1. In EM-A2, the thickness of grains occupying at least 50% of the total projected area was 0.10 $\mu$m or less, and 0.07 $\mu$m or less in EM-A3. The properties of EM-A2 and EM-A3 other than the grain thickness, such as the equivalent circle diameter and AgI content, are the same as that of the emulsion EM-A1.

(Preparation of EM-A4 to EM-A6)

Each of EM-A4 to EM-A6 was prepared in the same manner as EM-A1 to EM-A3, except that gelatin 1 in the emulsion preparing step was substituted by the modified gelatin 1b of the present invention so as to have the same amount.

(Preparation of EM-A7 to EM-A9)

Each of EM-A7 to EM-A9 was prepared in the same manner as EM-A1 to EM-A3, except that gelatin 1 in the emulsion preparing step was substituted by the modified gelatin 2a of the present invention so as to have the same amount.

(Observation of Tabular Grains by the Use of a Transmission Electron Microscope)

In each emulsion of EM-A1 to EM-A9, it was found that each individual grain thereof had ten or more dislocation lines at fringe portions of tabular grains thereof.

(Chemical Sensitization)

The sensitizing dye Exs-1 and the following sensitizing dye 1, sensitizing dye 2, sensitizing dye 3, the following compound ExA-4, potassium thiocyanate, chloroauric acid, sodium thiosulfate and N,N-dimethylselenourea were successively added to each of the EM-A1 to EM-A9 to perform optimum chemical sensitization. Thereafter, chemical sensitization was completed by adding the water-soluble mercapto compound ExA-1 and the compound ExA-3 of Example 3 with the ratio of 4:1 in the total amount of $3.6\times10^{-4}$ mol per mol of the silver halide.

Sensitizing dye 1

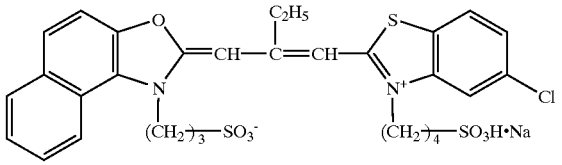

Sensitizing dye 2

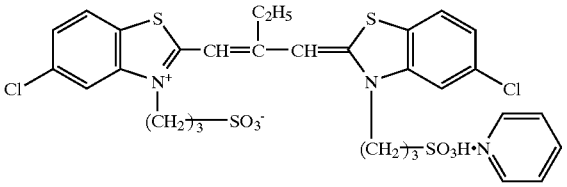

-continued

Sensitizing dye 3

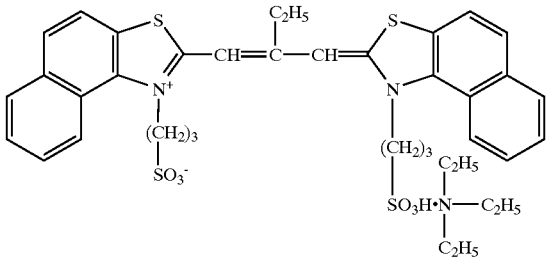

Compound ExA-4

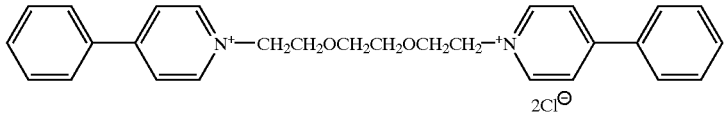

The properties of the emulsions used in this Example are shown in Table 5.

TABLE 5

| Emulsion name | Average iodine (mol %) | Equivalent-sphere diameter (μm) | Aspect ratio | Equivalent-circle diameter (μm) | Grain thickness (μm) | Grain shape |
|---|---|---|---|---|---|---|
| EM-A1 | 3.94 | 0.76 | 6.0 | 1.2 | 0.20 | Tabular |
| EM-B | 5 | 0.8 | 12 | 1.6 | 0.13 | Tabular |
| EM-C | 4.7 | 0.51 | 7 | 0.85 | 0.12 | Tabular |
| EM-D | 3.9 | 0.37 | 2.7 | 0.4 | 0.15 | Tabular |
| EM-E | 5 | 0.92 | 14 | 2 | 0.14 | Tabular |
| EM-F | 5.5 | 0.8 | 12 | 1.6 | 0.13 | Tabular |
| EM-G | 4.7 | 0.51 | 7 | 0.85 | 0.12 | Tabular |
| EM-H | 3.7 | 0.49 | 3.2 | 0.58 | 0.18 | Tabular |
| EM-I | 2.8 | 0.29 | 1.2 | 0.27 | 0.23 | Tabular |
| EM-J | 5 | 0.8 | 12 | 1.6 | 0.13 | Tabular |
| EM-K | 3.7 | 0.47 | 3 | 0.53 | 0.18 | Tabular |
| EM-L | 5.5 | 1.4 | 9.8 | 2.6 | 0.27 | Tabular |
| EM-M | 8.8 | 0.64 | 5.2 | 0.85 | 0.16 | Tabular |
| EM-N | 3.7 | 0.37 | 4.6 | 0.55 | 0.12 | Tabular |
| EM-O | 1.8 | 0.19 | — | — | — | Cubic |

In Table 5, if a high-voltage electron microscope is used also with respect to the tabular grains other than those of the emulsion EM-A1, dislocation lines as described in JP-A-3-237450 are observed.

Table 6 shows the kinds and addition amounts of the sensitizing dyes used for the emulsions used in this Example.

TABLE 6

| Emulsion name | Sensitizing dye | Addition amount (mol/silver mol) |
|---|---|---|
| EM-A1 to EM-A9 (Common) | Sensitizing dye 1 | $8.60 \times 10^{-4}$ |
| | Sensitizing dye 2 | $4.48 \times 10^{-4}$ |
| | Sensitizing dye 3 | $1.32 \times 10^{-5}$ |
| EM-B | Sensitizing dye 1 | $6.50 \times 10^{-4}$ |
| | Sensitizing dye 2 | $3.40 \times 10^{-4}$ |
| | Sensitizing dye 3 | $1.00 \times 10^{-5}$ |
| EM-C | Sensitizing dye 1 | $7.80 \times 10^{-4}$ |
| | Sensitizing dye 2 | $4.08 \times 10^{-4}$ |
| | Sensitizing dye 3 | $1.20 \times 10^{-5}$ |
| EM-D | Sensitizing dye 1 | $5.44 \times 10^{-4}$ |
| | Sensitizing dye 2 | $2.35 \times 10^{-4}$ |
| | Sensitizing dye 3 | $7.26 \times 10^{-6}$ |
| EM-E | Sensitizing dye 4 | $7.73 \times 10^{-4}$ |
| | Sensitizing dye 5 | $1.65 \times 10^{-4}$ |

TABLE 6-continued

| Emulsion name | Sensitizing dye | Addition amount (mol/silver mol) |
|---|---|---|
| | Sensitizing dye 6 | $6.20 \times 10^{-5}$ |
| EM-F | Sensitizing dye 4 | $8.50 \times 10^{-4}$ |
| | Sensitizing dye 5 | $1.82 \times 10^{-4}$ |
| | Sensitizing dye 6 | $6.82 \times 10^{-5}$ |
| EM-G | Sensitizing dye 4 | $1.00 \times 10^{-3}$ |
| | Sensitizing dye 5 | $2.15 \times 10^{-4}$ |
| | Sensitizing dye 6 | $8.06 \times 10^{-5}$ |
| EM-H | Sensitizing dye 4 | $6.52 \times 10^{-4}$ |
| | Sensitizing dye 5 | $1.35 \times 10^{-4}$ |
| | Sensitizing dye 6 | $2.48 \times 10^{-5}$ |
| EM-I | Sensitizing dye 8 | $6.09 \times 10^{-4}$ |
| | Sensitizing dye 13 | $1.26 \times 10^{-4}$ |
| | Sensitizing dye 4 | $2.32 \times 10^{-5}$ |
| EM-J | Sensitizing dye 7 | $7.65 \times 10^{-4}$ |
| | Sensitizing dye 8 | $2.74 \times 10^{-4}$ |
| EM-K | Sensitizing dye 4 | $6.27 \times 10^{-4}$ |
| | Sensitizing dye 5 | $2.24 \times 10^{-4}$ |
| EM-L | Sensitizing dye 9 | $1.42 \times 10^{-4}$ |
| | Sensitizing dye 10 | $1.18 \times 10^{-4}$ |
| | Sensitizing dye 11 | $1.03 \times 10^{-5}$ |
| EM-M | Sensitizing dye 9 | $2.43 \times 10^{-4}$ |
| | Sensitizing dye 10 | $2.43 \times 10^{-4}$ |
| | Sensitizing dye 11 | $2.43 \times 10^{-4}$ |

TABLE 6-continued

| Emulsion name | Sensitizing dye | Addition amount (mol/silver mol) |
|---|---|---|
| EM-N | Sensitizing dye 9 | $3.28 \times 10^{-4}$ |
| | Sensitizing dye 10 | $3.28 \times 10^{-4}$ |
| | Sensitizing dye 11 | $3.28 \times 10^{-4}$ |
| EM-O | Sensitizing dye 10 | $3.37 \times 10^{-4}$ |
| | Sensitizing dye 11 | $3.37 \times 10^{-4}$ |
| | Sensitizing dye 12 | $3.37 \times 10^{-4}$ |

Sensitizing dye 4

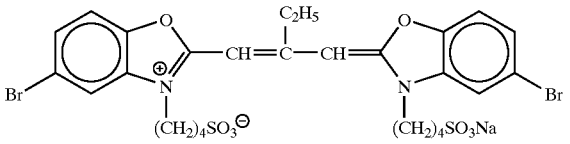

Sensitizing dye 5

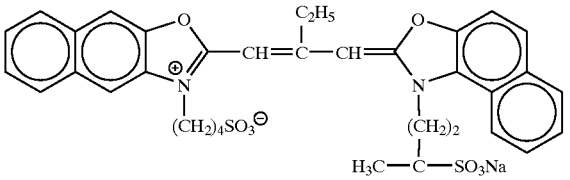

Sensitizing dye 6

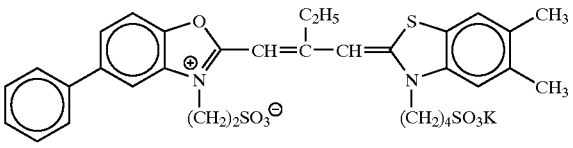

Sensitizing dye 7

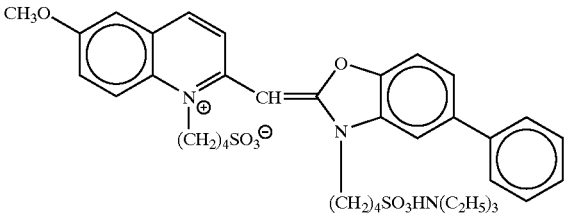

Sensitizing dye 8

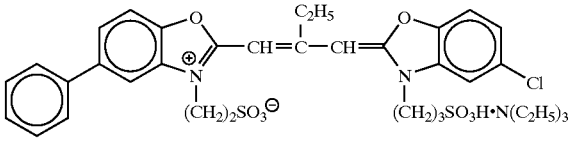

Sensitizing dye 9

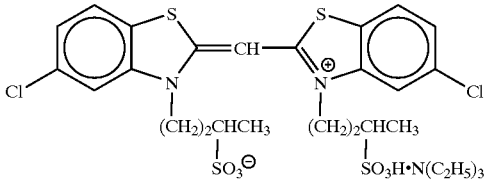

-continued

Sensitizing dye 10

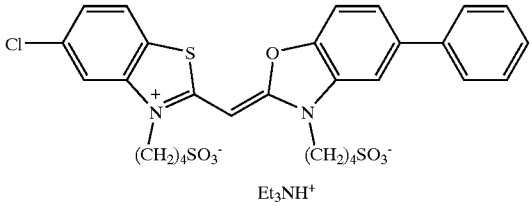

Sensitizing dye 11

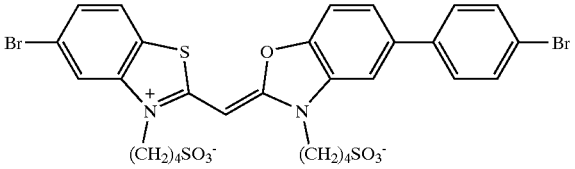

Sensitizing dye 12

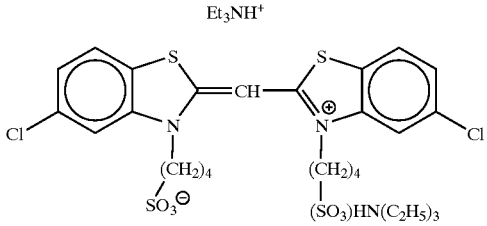

Sensitizing dye 13

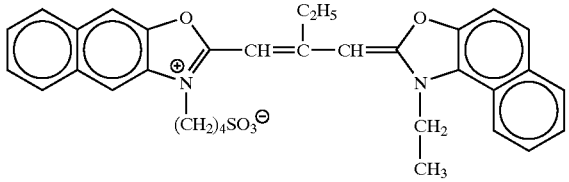

1) Support

A support used in this example was formed by the following method.

(i) First Layer and Undercoat Layer

Glow discharge was performed on the two surfaces of a 90-$\mu$m thick polyethylenenaphthalate support at a processing ambient pressure of 2.66×10 Pa, an $H_2O$ partial pressure in the ambient gas of 75%, a discharge frequency of 30 kHz, an output of 2,500 W, and a processing intensity of 0.5 kV·A·min/m$^2$. One surface (back surface) of this support was coated with 5 mL/m$^2$ of a coating solution having the following composition as a first layer by using a bar coating method described in JP-B-58-4589, the disclosure of which is incorporated herein by reference.

| | |
|---|---|
| Conductive fine-grain dispersion (a water dispersion having an $SnO_2/Sb_2O_5$ grain concentration of 10%, a secondary aggregate having a primary grain size of 0.005 $\mu$m and an average grain size of 0.05 $\mu$m) | 50 parts by mass |
| Gelatin | 0.5 parts by mass |
| Water | 49 parts by mass |
| Polyglycerolpolyglycidyl ether | 0.16 parts by mass |
| Poly(polymerization degree 20) oxyethylenesorbitanmonolaurate | 0.1 part by mass |

In addition, after the first layer was formed by coating, the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 mL/$m^2$ of a coating solution having the following composition as an undercoat layer for emulsions, by using a bar coating method.

| | |
|---|---|
| Gelatin | 1.01 parts by mass |
| Salicylic acid | 0.30 parts by mass |
| Resorcin | 0.40 parts by mass |
| Poly(polymerization degree 10) oxyethylenenonylphenyl ether | 0.11 parts by mass |
| Water | 3.53 parts by mass |
| Methanol | 84.57 parts by mass |
| n-Propanol | 10.08 parts by mass |

Furthermore, second and third layers to be described later were formed in this order on the first layer by coating. Subsequently, the opposite side (emulsion surface side) was coated with multiple layers of a color negative light-sensitive material having a composition to be described later, thereby making a transparent magnetic recording medium having silver halide emulsion layers.

(ii) Second layer (transparent magnetic recording layer)

(1) Dispersion of Magnetic Substance 1,100 parts by mass of a Co-deposited $\gamma$-$Fe_2O_3$ magnetic substance (average long axis length: 0.25 $\mu$m, $S_{BET}$: 39 $m^2$/g, Hc: $6.56\times10^4$ A/m, $\sigma s$: 77.1 $Am^2$/kg, $\sigma r$: 37.4 $Am^2$/kg), 220 parts by mass of water, and 165 parts by mass of a silane coupling agent [3-(poly(polymerization degree 10)oxyethynyl)oxypropyl trimethoxysilane] were added and well kneaded for 3 hr by an open kneader. This coarsely dispersed viscous solution was dried at 70° C. for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethylketone | 136.3 g |
| Cyclohexanone | 136.3 g |

The resultant material was finely dispersed at 2,000 rpm for 4 hr by the following formulation by using a sand mill (¼ G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(2) Formation of Magnetic Substance-containing Intermediate Solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An $\alpha$-alumina polishing material dispersion of the present invention was formed by the following formulation.

(a) Sumicorundum AA-1.5 (Average Primary Grain Size 1.5 $\mu$m, Specific Surface Area 1.3 $m^2$/g)

Formation of Grain Dispersion

| | |
|---|---|
| Sumikorandom AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/cyclohexanone = 1/1) | 227.52 g |

The above formulation was finely dispersed at 800 rpm for 4 hr by using a ceramic-coated sand mill (¼ G sand mill). Zirconia beads 1 mm in diameter were used as media.

(b) Colloidal Silica Grain Dispersion (Fine Grains)

"MEK-ST" manufactured by Nissan Chemical Industries, Ltd. was used.

"MEK-ST" was a colloidal silica dispersion containing methylethylketone as a dispersion medium and having an average primary grain size of 0.015 $\mu$m. The solid content is 30%.

(3) Formation of Second Layer Coating Solution

| | |
|---|---|
| Above-mentioned magnetic substance-containing intermediate solution | 19,053 g |
| Diacetylcellulose solution (solid content 4.5%, solvent: methylethylketone/cyclohexanone = 1/1) | 264 g |
| Colloidal silicon dispersion "MEK-ST" [dispersion b] (solid content 30%) | 128 g |
| AA-1.5 dispersion [dispersion a] | 12 g |
| Millionate MR-400 (manufactured by Nippon Polyurethane K.K.) diluted solution (solid content 20%, diluent solvent: methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 mL/$m^2$ by using a wire bar. The solution was dried at 110° C. The thickness of the dried magnetic layer was 1.0 $\mu$m.

(iii) Third Layer (Higher Fatty Acid Ester Slipping Agent-containing Layer)

(1) Formation of Undiluted Dispersion

A solution A presented below was dissolved at 100° C. and added to a solution B. The resultant solution mixture was dispersed by a high-pressure homogenizer to form an undiluted dispersion of a slipping agent.

| | |
|---|---|
| Solution A | |
| Compound below $C_6H_{13}CH(OH)(CH_2)_{10}COOC_{50}H_{101}$ | 399 parts by mass |
| Compound below $n\text{-}C_{50}H_{101}O(CH_2CH_2O)_{16}H$ | 177 parts by mass |
| Cyclohexanone | 830 parts by mass |
| Solution B | |
| Cyclohexanone | 8,600 parts by mass |

(2) Formation of Spherical Inorganic Grain Dispersion

A spherical inorganic grain dispersion [c1] was formed by the following formulation.

| | |
|---|---|
| Isopropyl alcohol | 93.54 parts by mass |
| Silane coupling agent KBM903 (manufactured by Shin-Etsu Silicone) compound 1-1 : $(CH_3O)_3Si—(CH_2)_3—NH_2$) | 5.53 parts by mass |
| Compound 1-2 | 2.93 parts by mass |
| Compound 1-2 | |

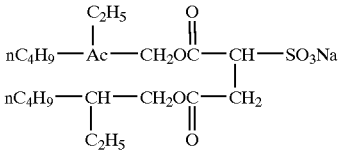

| | |
|---|---|
| SEAHOSTAR KEP50 (amorphous spherical silica, average grain size 0.5 μm, manufactured by NIPPON SHOKUBAI Co., Ltd.) | 88.00 parts by mass |

The above formulation was stirred for 10 min, and the following was further added.

Diacetone alcohol 252.93 parts by mass

Under ice cooling and stirring, the above solution was dispersed for 3 hr by using the "SONIFIER450 (manufactured by BRANSON K.K.)" ultrasonic homogenizer, thereby completing the spherical inorganic grain dispersion c1.

(3) Formation of Spherical Organic Polymer Grain Dispersion

A spherical organic polymer grain dispersion [c2] was formed by the following formulation.

| | |
|---|---|
| XC99-A8808 (manufactured by TOSHIBA SILICONE K.K., spherical crosslinked polysiloxane grain, average grain size 0.9 μm) | 60 parts by mass |
| Methylethylketone | 120 parts by mass |
| Cyclohexanone (solid content 20%, solvent: methylethylketone/cyclohexanone = 1/1) | 120 parts by mass |

Under ice cooling and stirring, the above solution was dispersed for 2 hr by using the "SONIFIER450 (manufactured by BRANSON K.K.)" ultrasonic homogenizer, thereby completing the spherical organic polymer grain dispersion c2.

(4) Formation of Third Layer Coating Solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEEHOSTA KEP50 dispersion [c1] | 53.1 g |
| Above-mentioned spherical organic polymer grain dispersion [c2] | 300 g |
| FC431 (manufactured by 3M K.K., solid content 50%, solvent: ethyl acetate) | 2.65 g |
| BYK310 (manufactured by BYK Chemi Japan K.K., solid content 25%) | 5.3 g |

The above third layer coating solution was coated in an amount of 10.35 mL/$m^2$ on the second layer, dried at 110° C., and further dried at 97° C. for 3 min.

2) Coating of Light-sensitive Layers

The opposite side of the back layers obtained as above was coated with a plurality of layers having the following compositions to make a color negative film (sample 001).

(Compositions of Light-sensitive Layers)

The main materials used in the individual layers are classified as follows.

ExC: Cyan coupler
ExM: Magenta coupler
ExY: Yellow coupler
UV: Ultraviolet absorbent
HBS: High-boiling organic solvent
H: Gelatin hardener (In the, following description, practical compounds have numbers attached to their symbols. Formulas of these compounds will be presented later.)

The number corresponding to each component indicates the coating amount in units of g/$m^2$. The coating amount of a silver halide is indicated by the amount of silver.

| | | |
|---|---|---|
| **1st layer (1st antihalation layer)** | | |
| Black colloidal silver | silver | 0.122 |
| 0.07-μm silver iodobromide emulsion | silver | 0.01 |
| Gelatin | | 0.919 |
| ExM-1 | | 0.066 |
| ExC-1 | | 0.002 |
| ExC-3 | | 0.002 |
| Cpd-2 | | 0.001 |
| F-8 | | 0.010 |
| HBS-1 | | 0.005 |
| HBS-2 | | 0.002 |
| **2nd layer (2nd antihalation layer)** | | |
| Black colloidal silver | silver | 0.055 |
| Gelatin | | 0.425 |
| ExF-1 | | 0.002 |
| F-8 | | 0.012 |
| Solid disperse dye ExF-7 | | 0.120 |
| HBS-1 | | 0.074 |
| **3rd layer (Interlayer)** | | |
| ExC-2 | | 0.050 |
| Cpd-1 | | 0.090 |
| Polymethylacrylate latex | | 0.200 |
| HBS-1 | | 0.100 |
| Gelatin | | 0.700 |

-continued

| | | |
|---|---|---|
| 4th layer (Low-speed red-sensitive emulsion layer) | | |
| EM-D | silver | 0.577 |
| EM-C | silver | 0.347 |
| ExC-1 | | 0.188 |
| ExC-2 | | 0.011 |
| ExC-3 | | 0.075 |
| ExC-4 | | 0.121 |
| ExC-5 | | 0.010 |
| ExC-6 | | 0.007 |
| ExC-8 | | 0.050 |
| ExC-9 | | 0.020 |
| Cpd-2 | | 0.025 |
| Cpd-4 | | 0.025 |
| HBS-1 | | 0.114 |
| HBS-5 | | 0.038 |
| Gelatin | | 1.474 |
| 5th layer (Medium-speed red-sensitive emulsion layer) | | |
| EM-B | silver | 0.435 |
| EM-C | silver | 0.432 |
| ExC-1 | | 0.154 |
| ExC-2 | | 0.068 |
| ExC-3 | | 0.018 |
| ExC-4 | | 0.103 |
| ExC-5 | | 0.023 |
| ExC-6 | | 0.010 |
| ExC-8 | | 0.016 |
| ExC-9 | | 0.005 |
| Cpd-2 | | 0.036 |
| Cpd-4 | | 0.028 |
| HBS-1 | | 0.129 |
| Gelatin | | 1.086 |
| 6th layer (High-speed red-sensitive emulsion layer) | | |
| EM-A1 | silver | 1.112 |
| ExC-1 | | 0.175 |
| ExC-3 | | 0.038 |
| ExC-6 | | 0.029 |
| ExC-8 | | 0.112 |
| ExC-9 | | 0.020 |
| Cpd-2 | | 0.064 |
| Cpd-4 | | 0.033 |
| HBS-1 | | 0.329 |
| HBS-2 | | 0.120 |
| Gelatin | | 1.245 |
| 7th layer (Interlayer) | | |
| Cpd-1 | | 0.094 |
| Cpd-9 | | 0.369 |
| Solid disperse dye ExF-4 | | 0.030 |
| HBS-1 | | 0.049 |
| Polyethylacrylate latex | | 0.088 |
| Gelatin | | 0.886 |
| 8th layer (layer for donating interlayer effect to red-sensitive layer) | | |
| EM-J | silver | 0.293 |
| EM-K | silver | 0.030 |
| ExM-2 | | 0.120 |
| ExM-3 | | 0.016 |
| ExM-4 | | 0.026 |
| ExY-1 | | 0.016 |
| ExY-4 | | 0.036 |
| ExC-7 | | 0.026 |
| HBS-1 | | 0.090 |
| HBS-3 | | 0.003 |
| HBS-5 | | 0.030 |
| Gelatin | | 0.610 |
| 9th layer (Low-speed green-sensitive emulsion layer) | | |
| EM-H | silver | 0.329 |
| EM-G | silver | 0.333 |
| EM-I | silver | 0.08 |
| ExM-2 | | 0.378 |
| ExM-3 | | 0.047 |
| ExY-1 | | 0.017 |
| ExC-7 | | 0.007 |
| HBS-1 | | 0.098 |

-continued

| | | |
|---|---|---|
| HBS-3 | | 0.010 |
| HBS-4 | | 0.077 |
| HBS-5 | | 0.548 |
| Cpd-5 | | 0.010 |
| Gelatin | | 1.470 |
| 10th layer (Medium-speed green-sensitive emulsion layer) | | |
| EM-F | silver | 0.457 |
| ExM-2 | | 0.032 |
| ExM-3 | | 0.029 |
| ExM-4 | | 0.029 |
| ExY-3 | | 0.007 |
| ExC-6 | | 0.010 |
| ExC-7 | | 0.012 |
| ExC-8 | | 0.010 |
| HBS-1 | | 0.065 |
| HBS-3 | | 0.002 |
| HBS-5 | | 0.020 |
| Cpd-5 | | 0.004 |
| Gelatin | | 0.446 |
| 11th layer (High-speed green-sensitive emulsion layer) | | |
| EM-E | silver | 0.794 |
| ExC-6 | | 0.002 |
| ExC-8 | | 0.010 |
| ExM-1 | | 0.013 |
| ExM-2 | | 0.011 |
| ExM-3 | | 0.030 |
| ExM-4 | | 0.017 |
| ExY-3 | | 0.003 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethylacrylate latex | | 0.099 |
| Gelatin | | 0.939 |
| 12th layer (Yellow filter layer) | | |
| Cpd-1 | | 0.094 |
| Solid disperse dye ExF-2 | | 0.150 |
| Solid disperse dye ExF-5 | | 0.010 |
| Oil-soluble dye ExF-6 | | 0.010 |
| HBS-1 | | 0.049 |
| Gelatin | | 0.630 |
| 13th layer (Low-speed blue-sensitive emulsion layer) | | |
| EM-O | silver | 0.112 |
| EM-M | silver | 0.320 |
| EM-N | silver | 0.240 |
| ExC-1 | | 0.027 |
| ExC-7 | | 0.013 |
| ExY-1 | | 0.002 |
| ExY-2 | | 0.890 |
| ExY-4 | | 0.058 |
| ExC-9 | | 0.012 |
| Cpd-2 | | 0.100 |
| Cpd-3 | | 0.004 |
| HBS-1 | | 0.222 |
| HBS-5 | | 0.074 |
| Gelatin | | 2.058 |
| 14th layer (High-speed blue-sensitive emulsion layer) | | |
| EM-L | silver | 0.714 |
| ExY-2 | | 0.211 |
| ExY-4 | | 0.068 |
| Cpd-2 | | 0.075 |
| Cpd-3 | | 0.001 |
| HBS-1 | | 0.071 |
| Gelatin | | 0.678 |
| 15th layer (1st protective layer) | | |
| 0.07-μm silver iodobromide emulsion | silver | 0.301 |
| UV-1 | | 0.211 |
| UV-2 | | 0.132 |
| UV-3 | | 0.198 |
| UV-4 | | 0.026 |

-continued

| | |
|---|---|
| F-18 | 0.009 |
| S-1 | 0.086 |
| HBS-1 | 0.175 |
| HBS-4 | 0.050 |
| Gelatin | 1.984 |
| 16th layer (2nd protective layer) | |
| H-1 | 0.400 |
| B-1 (diameter 1.7 μm) | 0.050 |
| B-2 (diameter 1.7 μm) | 0.150 |
| B-3 | 0.050 |
| S-1 | 0.200 |
| Gelatin | 0.750 |

In addition to the above components, to improve the storage stability, processability, resistance to pressure, antiseptic and mildewproofing properties, antistatic properties, and coating properties, the individual layers contained W-1 to W-6, B-4 to B-6, F-1 to F-19, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total | 7.210 kg |

(pH was adjusted to 7.2 by NaOH)

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid fine-grain dispersion. The average grain size of the fine dye grains was 0.29 μm.

Following the same procedure as above, solid dispersions of ExF-4 and ExF-7 were obtained. The average grain sizes of the fine dye grains were 0.28 and 0.49 μm, respectively. ExF-5 was dispersed by a microprecipitation dispersion method described in Example 1 of EP549,489A, the disclosure of which is incorporated herein by reference. The average grain size was found to be 0.06 μm.

Compounds used in the formation of each layer were as follows.

ExC-1

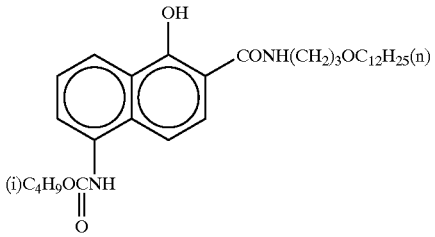

ExC-2

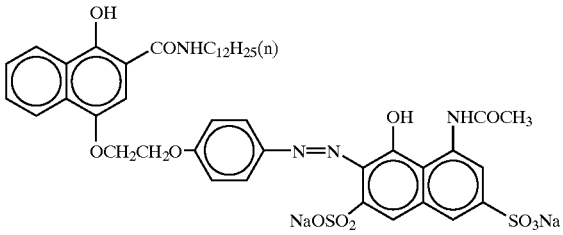

ExC-3

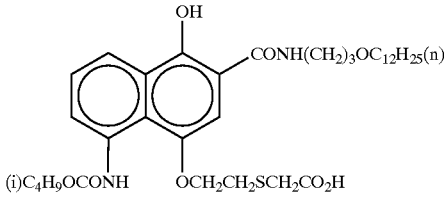

ExC-4

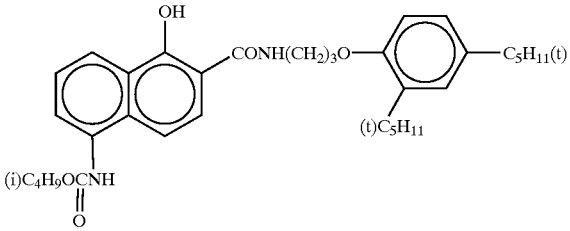

ExC-5

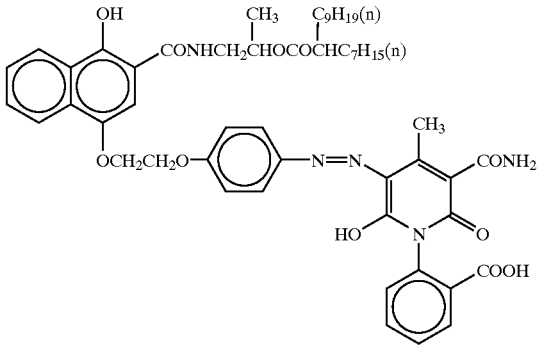

ExC-6

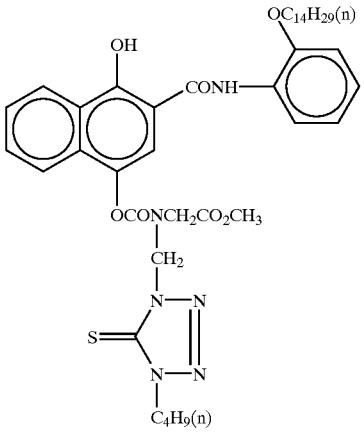

-continued
ExC-7
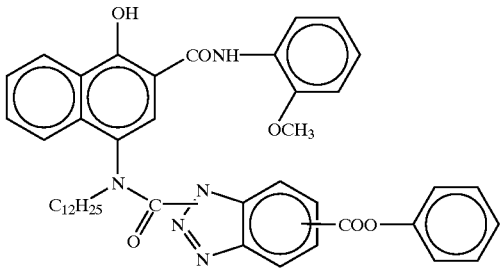
ExC-8
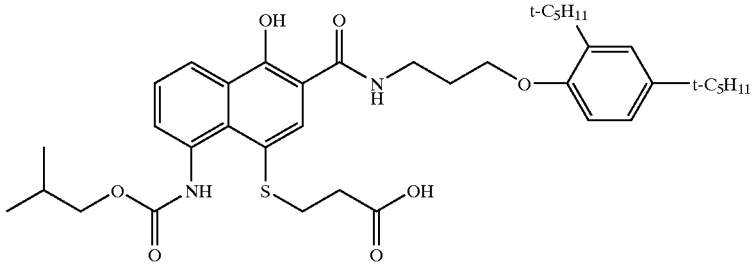
ExC-9
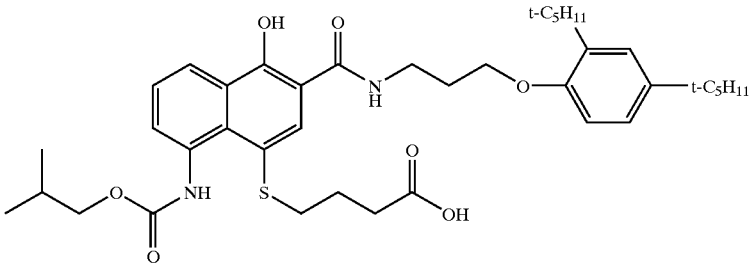
ExM-1
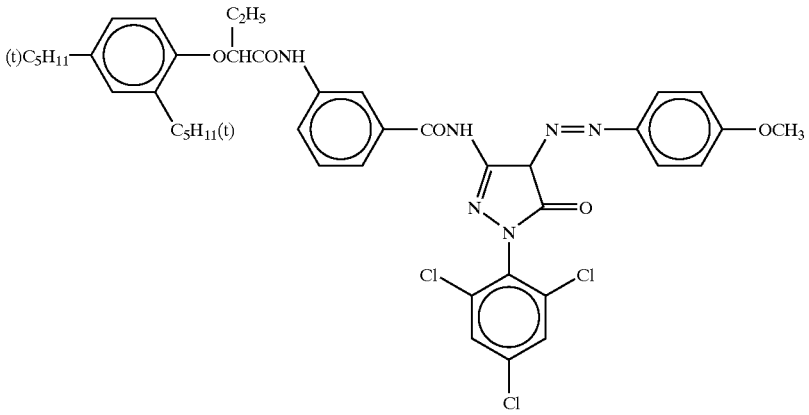
ExM-2
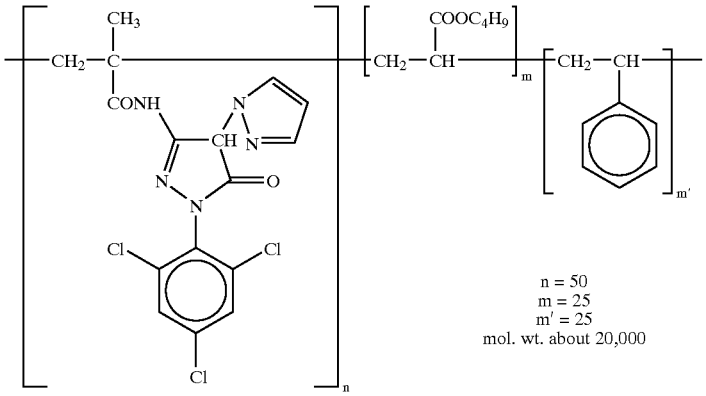
n = 50
m = 25
m′ = 25
mol. wt. about 20,000

-continued
ExM-3
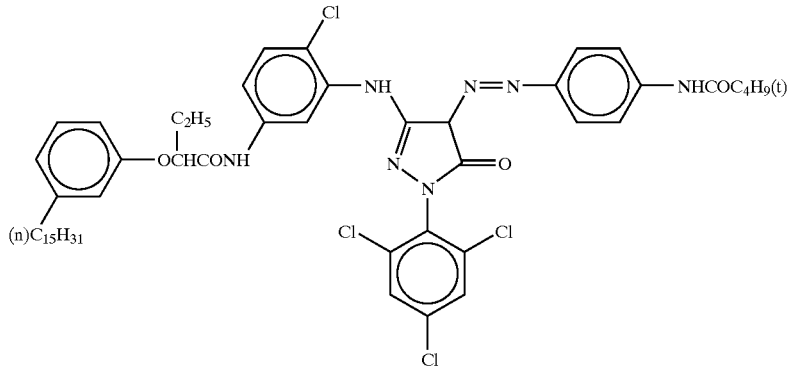
ExM-4
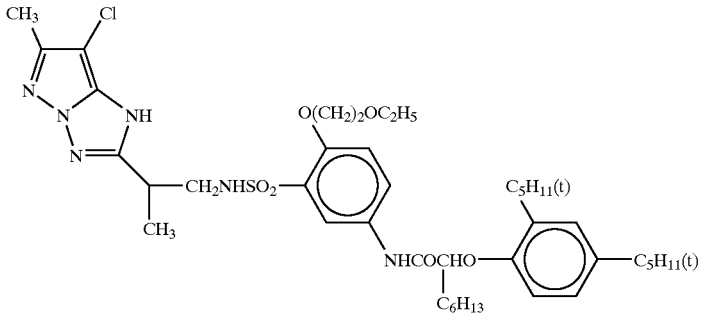
ExY-1
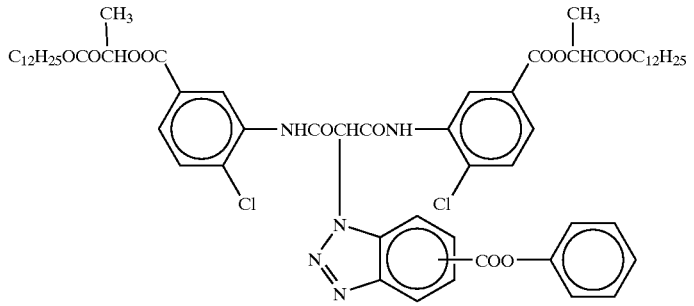
ExY-2
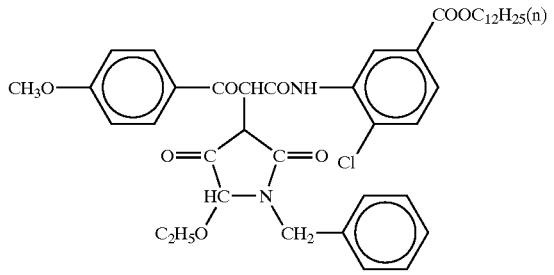
ExY-3
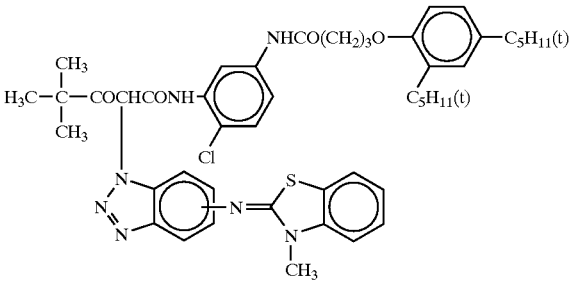
ExY-4
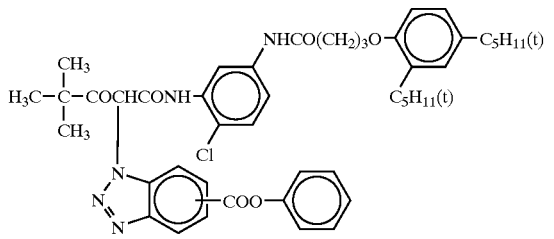
Cpd-1
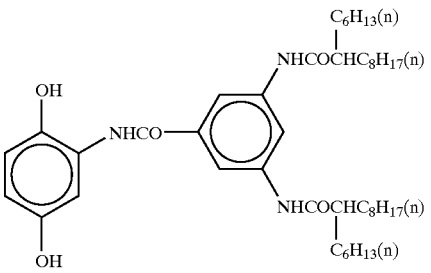

-continued
Cpd-2
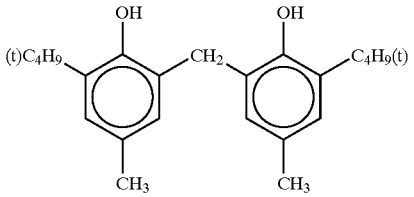
Cpd-3
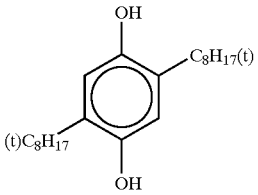
Cpd-4
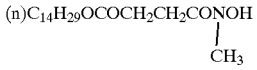
Cpd-5
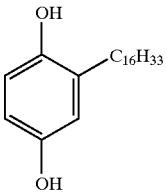
Cpd-6
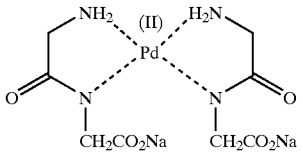
UV-1
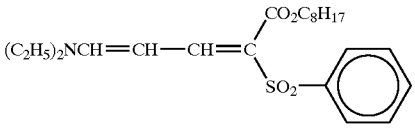
UV-2
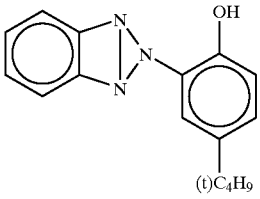
UV-3
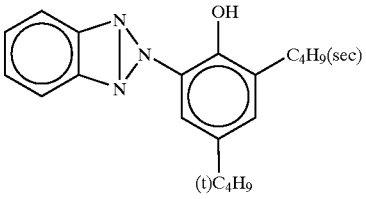
UV-4
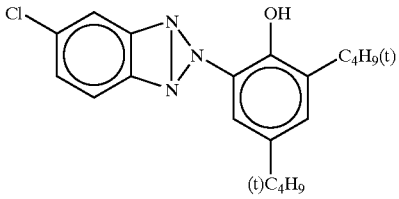
B-1
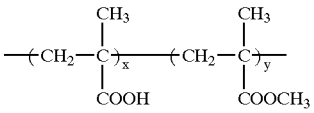
x/y = 10/90 (mass ratio)
average molecular weight:
about 35,000
B-2
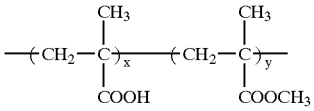
x/y = 40/60 (mass ratio)
average molecular weight:
about 20,000
B-3
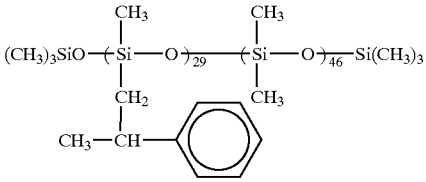
(mol ratio)
average molecular weight:
about 8,000
HBS-1
tricresyl phosphate
HBS-2
di-n-butyl phthalate
HBS-3
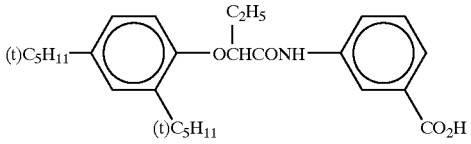
HBS-4
tri(2-ethylhexyl)phosphate -continued
HBS-5
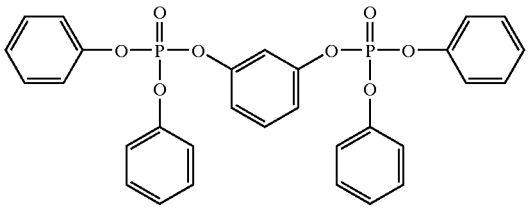
S-1
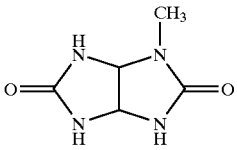
H-1
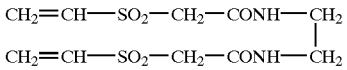
F-1
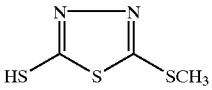
F-2
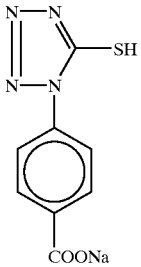
F-3
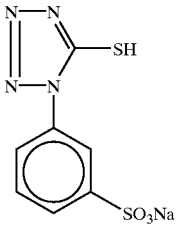
F-4
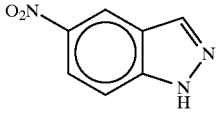
F-5
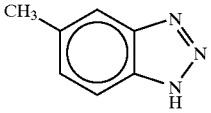
F-6
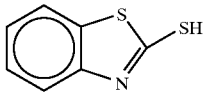
F-7
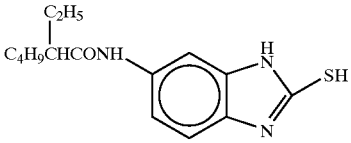
F-8
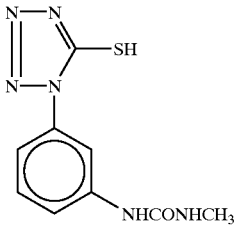
F-9
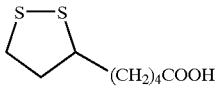
F-10
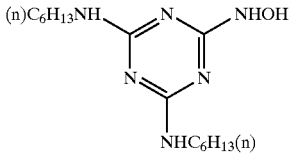
F-11
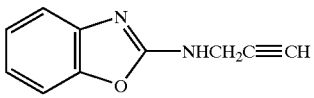
F-12
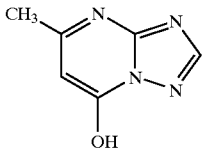
F-13
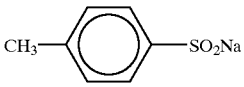
F-14
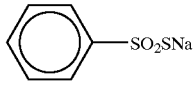
F-15
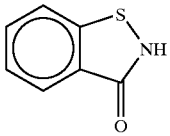

-continued
F-16
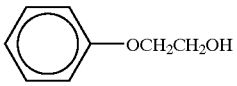
F-17
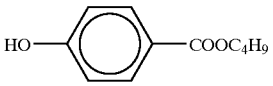
F-18
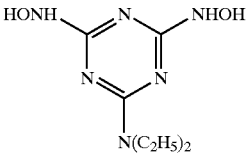
F-19
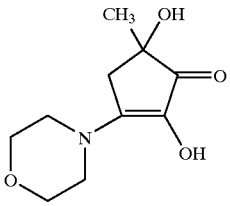
W-1
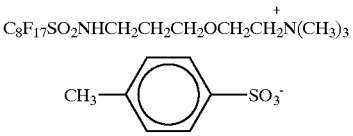
W-2
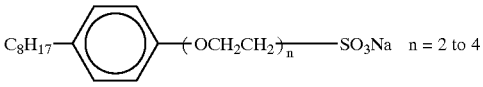
W-3
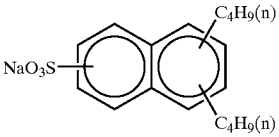
W-4
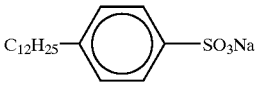
W-5
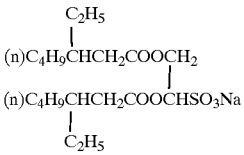
W-6
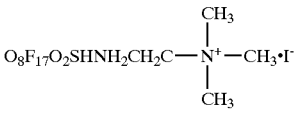
B-4
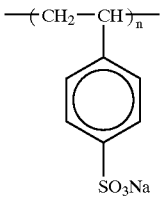
average molecular weight:
about 750,000
B-5
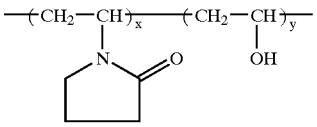
x/y = 70/30 (mass ratio)
average molecular weight:
about 17,000
B-6
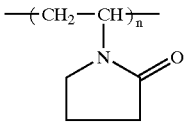
average molecular weight:
about 10,000
ExF-1
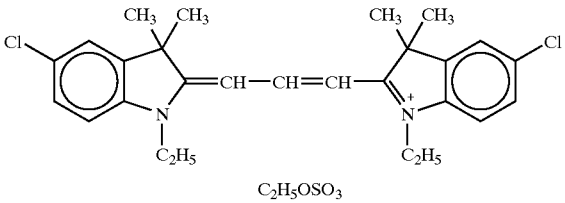
ExF-2
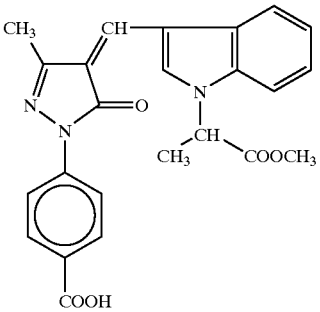
ExF-4
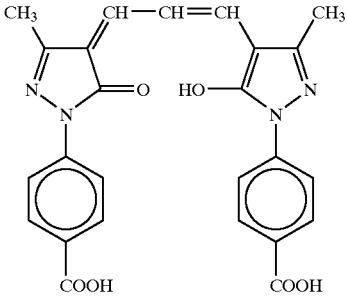

-continued

ExF-5

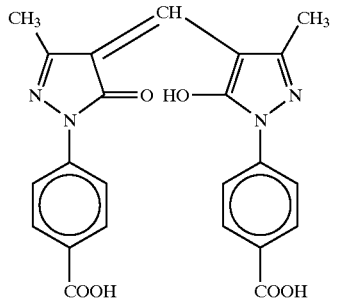

ExF-6

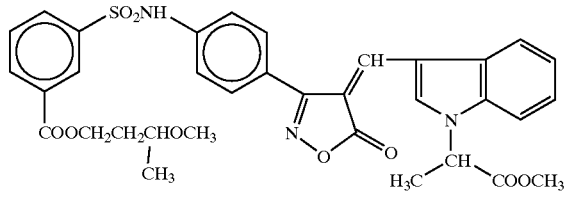

ExF-7

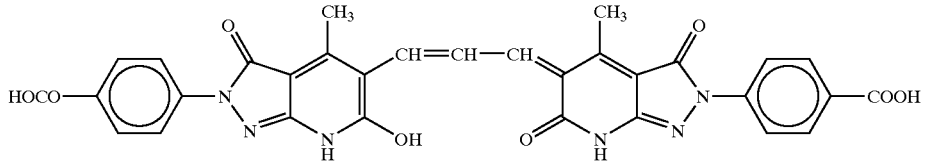

The above silver halide color photographic light-sensitive material is regarded as sample 401.

(Preparation of Samples 402 and 403)

Samples 402 and 403 were prepared in the same manner as sample 401, except that the EM-A1 of the emulsion of the sixth layer in sample 401 was substituted by emulsion EM-A2 or EM-A3 so as to have the same silver amount.

(Preparation of Samples 404–406)

Samples 404–406 were prepared in the same manner as samples 401–403 respectively, except that the emulsions EM-A1 to EM-A3 in the sixth layers of samples 401–403 were substituted by emulsions EM-A4 to EM-A6 respectively, to which the modified gelatin of the present invention was added, so as to have the same silver amount.

Each of these samples was left for 14 hours under the conditions of 40° C. and a relative humidity of 70%, and then subjected to exposure for 1/100 second through a continuous wedge at a color temperature of 4800-K. Thereafter, the samples were left for 14 days [lapse (i)], and then subjected to the following color development. The concentrations of the processed samples were measured by a red filter to evaluate the photographic property. The sensitivity of each sample was indicated by a relative value of logarithm of a reciprocal of an exposure which is indicated by lux and seconds for providing a cyan density equal to the fog density plus 0.2. (The sensitivity of sample 401 was regarded as 100.)

Development was performed as follows by using the FP-360B automatic processor manufactured by Fuji Photo Film Co., Ltd. Note that the FP-360B was modified such that the overflow solution of the bleaching bath was entirely discharged to a waste solution tank without being supplied to the subsequent bath. This FP-360B includes an evaporation correcting means described in JIII Journal of Technical Disclosure No. 94-4992, the disclosure of which is incorporated herein by reference.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | 5 mL | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | 17 mL | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide light-sensitive material (equivalent to one 24 Ex. 1)

The stabilizer and fixer were returned from (2) to (1) by counterflow, and the overflow of washing water was entirely introduced to the fixing bath (2). Note that the amounts of the developer, bleaching solution, and fixer carried over to the bleaching step, fixing step, and washing step were 2.5 mL, 2.0 mL, and 2.0 mL, respectively, per 1.1 m of a 35-mm wide light-sensitive material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixing (1) Tank Solution)

A 5:95 (volume ratio) mixture of the above bleaching tank solution and the following fixing tank solution (pH 6.8).

| (Fixing (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher (g) | |
|---|---|
| Sodium p-toluenesulfinate | 0.03 |
| Polyoxyethylene-p-monononylphenylether (average polymerization degree 10) | 0.2 |
| 1,2-benzoisothiazoline-3-one · sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

(Evaluation of Change in Photographic Property Due to Lapse of Time)

The change in the sensitivity of each coated sample due to lapse of time after exposure was evaluated by the following method.

The samples 401–406 were subjected to exposure for 1/100 second through a continuous wedge in the same manner as the above, and maintained under two conditions, that is, one of each sample was maintained for 14 days at −20° C. <lapse (i)>, and the other of each sample was maintained for 14 days at 40° C. with a relative humidity of 40% <lapse (ii)>. Thereafter, each sample was subjected to the above development, and the sensitivity of each of the samples was determined by a relative value of logarithm of a reciprocal number of exposure, which is indicated by a lux and seconds to provide a magenta density equal to a fog density plus 0.5 by a red filter. Further, the sensitivity change differences of lapse (i) and lapse (ii) were compared, and the obtained value were used as values indicating the photographic property change after lapse of time.

(Evaluation of Deterioration in the Graininess Due to Aggregation of Grains at the Time of Coating)

In the samples 401 to 409, the emulsion of sixth layer of each sample was dissolved at 40° C. and maintained for 8 hours. Thereafter, samples 411–419 were prepared under the same coating conditions as those of samples 401–409 respectively. These samples were left for 14 hours under the conditions of 40° C. and a relative humidity of 70%, and then subjected to exposure for 1/100 second through a continuous wedge in the same manner as the above and subjected to color development. The concentrations of the processed samples were measured by a red filter. The sensitivity of each sample was indicated by a relative value of logarithm of a reciprocal of an exposure which is indicated by lux and seconds for providing a cyan density equal to the fog density plus 0.2. (The sensitivity of sample 401 was regarded as 100.)

Further, the RMS granularity of each of samples 401–409 and 411–419 at a density equal to the fog density plus 0.2 was measured. The results are shown in Table 7.

TABLE 7

| Sample No. | Emulsion of sixth layer | Grain thickness (μm) | Gelatin in grain formation step | Sensitivity | photographic property change after lapse of time (change difference of lapse (i) and lapse (ii)) | Granularity (RMS × 1000) | Remarks |
|---|---|---|---|---|---|---|---|
| 401 | EM-A1 | 0.20 | Original gelatin 1 | 100 | +12 | 16 | Comp. |
| 402 | EM-A2 | 0.10 | Original gelatin 1 | 100 | +13 | 14 | Comp. |
| 403 | EM-A3 | 0.07 | Original gelatin 1 | 105 | +15 | 12 | Comp. |
| 404 | EM-A4 | 0.20 | Modified gelatin 1b | 100 | +5 | 16 | Inv. |
| 405 | EM-A5 | 0.10 | Modified gelatin 1b | 100 | +5 | 14 | Inv. |
| 406 | EM-A6 | 0.07 | Modified gelatin 1b | 105 | +5 | 12 | Inv. |
| 407 | EM-A7 | 0.20 | Modified gelatin 2a | 100 | +3 | 16 | Inv. |
| 408 | EM-A8 | 0.10 | Modified gelatin 2a | 100 | +3 | 14 | Inv. |
| 409 | EM-A9 | 0.07 | Modified gelatin 2a | 105 | +3 | 12 | Inv. |

| Emulsion No. | Host tabular grain emulsion | Epitaxial deposition method | Gelatin in grain formation step | Sensitivity | photographic property change after lapse of time (change difference of lapse (i) and lapse (ii) | Granularity (RMS × 1000) | Remarks |
|---|---|---|---|---|---|---|---|
| 411 | EM-A1 | 0.20 | Original gelatin 1 | 85 | — | 22 | After lapse of time of emulsion dissolution |
| 412 | EM-A2 | 0.10 | Original gelatin 1 | 82 | — | 22 | After lapse of time of emulsion dissolution |
| 413 | EM-A3 | 0.07 | Original gelatin 1 | 87 | — | 23 | After lapse of time of emulsion dissolution |
| 414 | EM-A4 | 0.20 | Modified gelatin 1b | 99 | — | 17 | After lapse of time of emulsion dissolution |
| 415 | EM-A5 | 0.10 | Modified gelatin 1b | 98 | — | 17 | After lapse of time of emulsion dissolution |
| 416 | EM-A6 | 0.07 | Modified gelatin 1b | 98 | — | 15 | After lapse of time of emulsion dissolution |
| 417 | EM-A7 | 0.20 | Modified gelatin 2a | 99 | — | 16 | After lapse of time of emulsion dissolution |
| 418 | EM-A8 | 0.10 | Modified gelatin 2a | 99 | — | 16 | After lapse of time of emulsion dissolution |
| 419 | EM-A9 | 0.07 | Modified gelatin 2a | 102 | — | 14 | After lapse of time of emulsion dissolution |

As shown in Table 7, the third emulsion of claim 5 of the present invention can reduce change in the photographic property without deteriorating the sensitivity. In particular, it is effective in a tabular grain emulsion having a grain thickness being 0.1 μm or less. Further, the emulsion can prevent aggregation of the grains at the time of coating, and provide a silver halide light-sensitive material excellent in the graininess.

EXAMPLE 5

The effect of the modified gelatin of the present invention in a multi-layer color light-sensitive material will now be shown.

The silver halide emulsion EM-A11 was prepared according to the following method.

(Preparation of EM-A11)

1200 mL of an aqueous solution containing 1.0 g of low-molecular weight gelatin having a molecular weight of 15000 and 1.0 g of KBr was agitated while being maintained at 35° C. Then, 30 mL of an aqueous solution containing 1.9 g of $AgNO_3$ and 30 mL of an aqueous solution containing 1.5 g of KBr and 0.7 g of low-molecular weight gelatin having a molecular weight of 15000 were added by a double jetting method for 30 seconds to perform core formation. In this step, the excess concentration of KBr was maintained at a fixed value. Thereafter, 6 g of KBr was added, and the temperature of the solution was raised to 75° C. to perform ripening. After completion of ripening, 35 g of succinated gelatin was added, and pH was controlled to 5.5. Then, 150 mL of an aqueous solution containing 30 g of $AgNO_3$ and a KBr aqueous solution were added by a double jetting method for 16 minutes. In this step, the silver potential was maintained at −25 mV to the saturated calomel electrode. Further, an aqueous solution containing 10 g of $AgNO_3$ and a KBr aqueous solution were added by a double jetting method for 15 minutes with flow rate accelerated such that the final flow rate is 1.2 times as much as the initial flow rate. In this step, an AgI fine-grain emulsion having a grain size of 0.03 μm was simultaneously added with the flow rate accerelated so that the silver iodide content becomes 3.8%, and the silver potential was maintained at −25 mV. 132 mL of an aqueous solution containing 35 g of $AgNO_3$ and a KBr aqueous solution were added by a double jetting method for 7 minutes. The addition of the KBr aqueous solution was controlled so that the potential at the time of completion of addition was −20 mV. After the temperature was changed to 40° C., the compound ExA-5 of 5.6 g in terms of KI was added, and 64 mL of sodium sulfite aqueous solution of 0.8 M was further added. Further, an NaOH aqueous solution was added to increase the pH to 9.0, the pH was maintained for 4 minutes to rapidly generate iodide ions, and thereafter the pH was returned to 5.5. After the temperature was returned to 55° C., 1 mg of benzene thiosulfanate sodium was added, and 13 g of lime-processed gelatin (original gelatin 1) having a calcium concentration of 1 ppm was added (addition 1). After the addition was completed, 250 mL of an aqueous solution containing 70 g of $AgNO_3$ and a KBr aqueous solution were added for 20 minutes while the potential is maintained at 60 mV. In this step, yellow prussiate of potash of $1.0\times10^{-5}$ mol per mol of silver was added. After the mixture was washed, 80 g of lime-processed gelatin (original gelatin 1) having a calcium concentration of 1 ppm was added (addition 2), and the pH was controlled to 5.8 and the pAg was controlled to 8.7 at 40° C.

Compound ExA-5

ExA-5

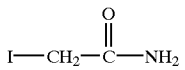

When the contents of calcium, magnesium and strontium of the above emulsion were measured by ICP emission spectral analysis method, they were 15 ppm, 2 ppm and 1 ppm respectively.

The temperature of the above emulsion was raised to 56° C. First, a pure AgBr fine-grain emulsion of 1 g in terms of silver with a grain size of 0.05 μm was added and provided with shells. Next, the sensitizing dyes 1, 2 and 3 of Example 4 in the amounts of $5.85\times10^{-4}$ mol, $3.06\times10^{-4}$ mol and $9.00\times10^{-6}$ mol per mol of silver respectively were added in the form of solid fine dispersion substance. The solid fine dispersion substances of the sensitizing dyes 1, 2 and 3 were prepared as follows. Under the preparation conditions as shown in Table 8, an inorganic salt was dissolved in ion-exchange water, and thereafter a sensitizing dye was added and dispersed for 20 minutes at 2000 rpm by using dissolver wings to obtain the solid fine dispersion substances of the sensitizing dyes 1, 2 and 3. After addition of the sensitizing dyes, when the adsorption of the sensitizing dyes reaches 90% of the adsorption amount in the equilibrium state, calcium nitrate was added so that the calcium concentration was 250 ppm. The adsorption amount of the sensitizing dyes was determined by separating the solid layer from the liquid layer by means of centrifugal sedimentation, and measuring the difference between the amount of the sensitizing dyes which was originally added and the amount of the sensitizing dyes in the supernatant liquor. After addition of calcium nitrate, potassium thiocyanate, chloroauric acid, sodium thiosulfate, N,N-dimethylselenourea and the compound RS-1 of Example 2 were added to perform optimum chemical sensitization. $3.40\times10^{-6}$ mol of N,N-dimethylselenourea was added per mol of silver. When the chemical sensitization was completed, the compounds ExA-2 and ExA-3 of Example 2 were added to prepare EM-A11.

TABLE 8

| Sensitizing dye | Amount of sensitizing dye | $NaNO_3/Na_2SO_4$ | Water | Dispersion time | Dispersion temperature |
|---|---|---|---|---|---|
| 1 | 3 parts by mass | 0.8 part by mass/ 3.2 parts by mass | 43 parts by mass | 20 minutes | 60° C. |
| 2/3 | 4 parts by mass/ 0.12 part by mass | 0.6 part by mass/ 2.4 parts by mass | 42.8 parts by mass | 20 minutes | 60° C. |

(Preparation of Sample 501)

Sample 501 was prepared in the same manner as sample 401, except that the emulsion EM-A1 in the sixth layer of sample 401 of Example 4 was substituted by the above emulsion EM-A11 so as to have the same silver amount.

(Preparation of Samples 502–509)

Multi-layer color light-sensitive materials as samples 502–509 were prepared in the same manner as sample 501, except that the half amount of the gelatin in addition 1 in the emulsion EM-A11 in the sixth layer of sample 501 was substituted by the modified gelatins 1a–1f and 2a, and comparative gelatin 1 respectively.

(Preparation of Sample 510)

A multilayer color light-sensitive material as sample 510 was prepared in the same manner as sample 401, except that 1/14 of the gelatin in the emulsion EM-A11 in the sixth layer of sample 501 was substituted by comparative gelatin 1, and the emulsion was controlled so that 4-(5-mercapto-1-tetrazolyl)benzoic acid of the same amount as that of sample 504 was introduced.

These samples were left for 14 hours under the conditions of 40° C. and a relative humidity of 70%, and thereafter the following evaluations were performed.

(Evaluation of Change in Photographic Property Due to Lapse of Time)

The increase in keeping fog of each of the coated samples due to lapse of time was evaluated by the following method.

Each of the samples 501–510 was maintained under two conditions. That is, one of each sample was maintained at −20° C. for 14 days (lapse (i)>, and the other of each sample was maintained for 14 days at 50° C. with a relative humidity of 60% <lapse (ii)>. Thereafter, the samples were subjected to the same exposure and development as those of Example 4. Then, in the same manner as the above, the density of the fog portion of each sample was measured by a red filter to obtain the rise in the fog density of lapse (ii) to the fog density of lapse (i), and the obtained value was regarded as rise in fog due to lapse of time. The results are shown in Table 9.

TABLE 9

| Sample No. | Compound | Increase of fog (before exposure, for 14 days at 50° C. with a relative humidity of 60%) | RMS (×1000) | Remarks |
|---|---|---|---|---|
| 501 | Original gelatin A | 0.21 | 11 | Comp. |
| 502 | Modified gelatin 1a | 0.20 | 11 | Inv. |
| 503 | Modified gelatin 1b | 0.15 | 10 | Inv. |
| 504 | Modified gelatin 1c | 0.14 | 10 | Inv. |
| 505 | Modified gelatin 1d | 0.13 | 10 | Inv. |
| 506 | Modified gelatin 1e | 0.15 | 11 | Comp. |
| 507 | Modified gelatin 1f | 0.15 | 11 | Comp. |
| 508 | Modified gelatin 2a | 0.20 | 11 | Inv. |
| 509 | Comparative gelatin 1 | 0.14 | 12 | Comp. |
| 510 | Comparative gelatin 1 | 0.15 | 12 | Comp. |

As is clear from comparison between the comparative samples 501, 506, 507, 509 and 510 and samples 502 to 505 and 508 of the present invention, addition of the modified gelatin of the present invention reduces fog without deteriorating the sensitivity just after preparation of the photosensitive materials.

(Evaluation of Deterioration in Property at the Time of Coating)

The sixth emulsion in each of the samples 501–510 was dissolved at 40° C., maintained for 8 hours, and samples 601–610 were prepared by the same coating conditions as samples 501–510 respectively. In the same manner as the above, the samples were subjected to exposure for 1/100 second through a continuous wedge to perform color development. The concentration of each of the processed samples was measured by a red filter, and the sensitivity was indicated by a relative value of a logarithm of a reciprocal of exposure indicated by lux and seconds for providing a cyan density equal to the fog density plus 0.2. (The sensitivity of sample 501 was regarded as 100.) Further, the RMS granularity of each of samples 501–510 and 601–610 at a density equal to the fog density plus 0.5 was measured. The results are shown in Table 10.

TABLE 10

| Sample No. | Compound | Sensitivity just after preparation of photosensitive material | RMS (×1000) | Increase of RMS by lapse of time of dissolution | Remarks |
|---|---|---|---|---|---|
| 601 | Original gelatin A | 84 | 16 | 5 | Comp. |
| 602 | Modified gelatin 1a | 98 | 13 | 2 | Inv. |
| 603 | Modified gelatin 1b | 98 | 12 | 2 | Inv. |
| 604 | Modified gelatin 1c | 97 | 12 | 2 | Inv. |
| 605 | Modified gelatin 1d | 97 | 13 | 2 | Inv. |
| 606 | Modified gelatin 1e | 92 | 15 | 4 | Comp. |
| 607 | Modified gelatin 1f | 81 | 17 | 6 | Comp. |
| 608 | Modified gelatin 2a | 98 | 12 | 1 | Inv. |
| 609 | Comparative gelatin 1 | 65 | 18 | 6 | Comp. |
| 610 | Comparative gelatin 1 | 83 | 18 | 6 | Comp. |

As is clear from comparison between the comparative examples 601, 607, 609 and 610 and the samples 602–605 and 608 of the present invention, addition of the modified gelatin of the present invention improves, in particular, deterioration in the photographic performance in coating after lapse of time of dissolution of the emulsion, and provides an excellent suitability for preparation.

EXAMPLE 6

The effects of tabular grains using a crystal-habit control agent and the modified gelatin in the present invention will now be shown.

Preparation of Silver Halide Emulsions Em-1 to 8

(Preparation of Em-1)

Tabular grains were prepared as follows, by using the mixer having a capacity of 0.5 mL described in JP-A-10-43570. This example shows a method wherein both core formation and grain growth are performed by using the mixer.

500 mL of a 0.021 M silver nitrate aqueous solution and 500 mL of 0.028 M KBr aqueous solution containing 0.1 mass % of low-molecular weight gelatin (average molecular weight 40,000) were continuously added into the mixer for 20 minutes, and an obtained emulsion was continuously received by a reaction vessel maintained at 20° C. to obtain 1000 mL of a tabular core emulsion. In this process, the stirring rotational speed of the mixer was 2000 rpm (tabular core formation).

After completion of tabular core formation, 36 mL of a 0.8 M KBr solution and 300 mL of 10 mass % trimellitated gelatin containing 0.06 mmol of (111) crystal-habit control agent (i) were added to the core emulsion in the reaction vessel while the emulsion was stirred well, the temperature of the emulsion was raised to 75° C. and the emulsion was left for 20 minutes. Thereafter, 50 mL of an aqueous solution of 1/50 M (111) crystal-habit control agent (i) was added to the emulsion (ripening).

Thereafter, 1000 mL of 0.6 M silver nitrate aqueous solution and 1000 mL of 0.6 M KBr aqueous solution containing 50 g of low molecular weight gelatin (average molecular weight 40,000) and 3 mol % of KI were added again into the mixer for 56 minutes with a constant flow rate. A fine-grain emulsion generated in the mixer was continuously added into the reaction vessel. In the addition, the stirring rotational speed of the mixer was 2000 rpm. Simultaneously, 100 mL of an aqueous solution of 1/50M of (111) crystal-habit control agent (i) was added into the reaction vessel with a constant flow rate. The dissolver wings of the reaction vessel were rotated at 800 rpm to stir the emulsion well. Further, during addition of the fine-grain emulsion, the temperature in the reaction vessel was fixedly maintained at 75° C., and the pBr at 2.5 (growth).

During growth of the grains, at the time when 70% of silver nitrate was added, $8\times10^{-8}$ mol/mol silver of iridium hexachloride(IV) complex was added to dope the emulsion. Further, before completion of grain growth, an aqueous solution of ferrocyanic acid complex was added into the mixer. The ferrocyanic acid complex was doped into 3% (in terms of added silver amount) of the shell portions of the grains so that the local density becomes $3\times10^{-4}$ mol/mol silver.

After completion of grain growth, 40 g of the original gelatin 1 of Example 1, 60 g of calcium nitrate, and 2.4 mmol of the sensitizing dye (i) per mol of silver were added, and the emulsion was maintained at 75° C. for 40 minutes (dye adsorption).

Thereafter, the temperature was lowered to 35° C., and washing and desalting were performed by a common flocculation method. After washing and desalting, the temperature was raised to 50° C. again, and 70 g of lime-processed bone gelatin and 100 mL of filtered water were added to perform re-dispersion of the emulsion. Then, NaOH and KBr were added to control the pH to 6.5 and the pAg to 8.7, and thereby Em-1 was obtained. In view of electronic microscope photographs of silver iodobromide (111) tabular grains contained in the emulsion Em-1 obtained as described above, at least 50% of the total projected area was occupied with grains having an equivalent circle diameter of at least 3.3 μm and a grain thickness less than 0.030 μm. The average equivalent circle diameter of all the grains was 3.31 μm, and the average grain thickness was 0.030 μm. Further, the ratio of the projected area of the silver iodobromide (111) tabular grains to the total projected area of all the grains was 97% or more.

Sensitizing dye (i)

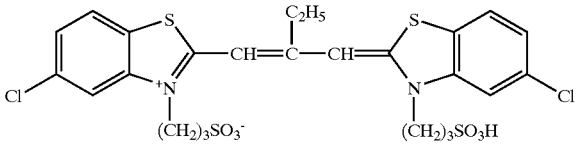

(Preparation of Em-2 to 8)

Em-2 to 8 were prepared by substituting the original gelatin 1 added after grain formation in preparation of the Em-1 by the modified gelatin la-If and comparative gelatin 1 described in Table 1 respectively. Even when the gelatin was substituted, the equivalent circle diameter and grain thickness of the silver iodobromide (111) tabular grains occupying at least 50% of the total projected area, and the average equivalent circle diameter and average grain thickness of all the grains of each emulsion, obtained from electronic microscope photographs of Em-2 to 8, were the equivalent to those of Em-1.

(Measuring of Grain Size)

The apparent sizes of the silver iodobromide (111) tabular grains contained in Em-1 to 8 were measured by using a disk centrifugal-type grain size measuring apparatus manufactured by CPS Instruments. The results of the measurement are shown in Table 11 with the values which are calculated on the basis of the volume weighted average value of the apparent size of the tabular grains contained in Em-1 regarded as 100.

TABLE 11

| Sample No. | Modified gelatin | Apparent size of grain | Remarks |
|---|---|---|---|
| Em-1 | Original gelatin A | 100 | Comp. |
| Em-2 | Modified gelatin 1a | 65 | Inv. |
| Em-3 | Modified gelatin 1b | 64 | Inv. |
| Em-4 | Modified gelatin 1c | 63 | Inv. |
| Em-5 | Modified gelatin 1d | 65 | Inv. |
| Em-6 | Modified gelatin 1e | 89 | Comp. |
| Em-7 | Modified gelatin 1f | 96 | Comp. |
| Em-8 | Comparative gelatin 1 | 102 | Comp. |

As is clear from the results shown in Table 11, the apparent sizes of the silver iodobromide (111) tabular grains contained in the Em-2 to 5 using the modified gelatin of the present invention, that is, lime-processed bone gelatin into which 0.2 to 1.0 mmol of 4-(5-mercapto-1-tetrazolyl) benzoic acid was introduced per 100 g of the gelatin, at the time of dye adsorption after grain formation are smaller than those of Em-1 and Em-6 to 8. In the meantime, there is no difference among the Em-1 to 8 in the average size (average equivalent circle diameter and average grain thickness) of the silver iodobromide (111) tabular grains contained in Em-1 to 8, determined on the basis of the electronic microscope photographs. Therefore, a large apparent size of the tabular grains measured by the disk centrifugal-type grain size distribution measuring apparatus means that two or more tabular grains cohere by aggregation generated at the time of dye adsorption and are viewed as a grain of a larger volume in appearance. Therefore, reduction in the apparent size of the tabular grains by the modified gelatin of the present invention means that the problem of aggregation of the tabular grains, which is generated at the time of dye adsorption, has been improved.

One of main causes of tabular grain aggregation generated at the time of dye adsorption is desorption of the gelatin, which adsorbed to the tabular grains and functioned as protective colloid to prevent aggregation, at the time of adsorption of the sensitizing dye to the tabular grains. It is known that a mercaptoazole group strongly adsorbs to a silver halide grain. It is considered that the modified gelatin of the present invention is effective for prevention of the aggregation because it strongly adsorbs to silver halide and reduces desorption of gelatin due to adsorption of the sensitizing dye. However, as is clear from the results of Em-6 to 8 in Table 11, there is an appropriate point in the number of adsorption groups to be introduced into the gelatin. If the number of adsorption groups to be introduced into the gelatin increases, it is expected that the possibility of plural adsorption groups being introduced in a molecule of the gelatin increases. If the modified gelatin having plural adsorption groups adsorbs over two or more tabular grains, the tabular grains are bridged, and consequently it is likely that aggregation occurs (bridge aggregation is likely to occur) for another reason different from desorption of gelatin by sensitizing dye. This is considered as the reason why there is an appropriate point of the number of adsorption groups to be introduced into the gelatin.

Sodium thiosulfate, chloroauric acid and potassium thiocyanate were added to each of Em-1 to 8 to perform optimum chemical sensitization. Gelatin and sodium dodecylbenzenesulfonate were added to each of the chemical-sensitized emulsions. Then, each of the emulsions was coated, with the silver amount of 1 g/m$^2$, by extrusion together with a protective layer containing gelatin, polymethylmethacrylate grains and 2,4-dichloro-6-hydroxy-s-triazinesodium salt, on a cellulose triacetyl film base having a substratum, and thereby samples 701–708 were obtained respectively.

The samples 701–708 were subjected to sensitometry exposure (1 second) through an optical wedge by using a blue cut filter SC-50 manufactured by Fuji Photo Film Co., Ltd. Thereafter, the samples were developed at 20° C. for 10 minutes by a developer obtained by the following prescription, and then stopping, fixing, washing and drying were performed by a conventional method, and the optical density of each sample was measured. The fog was determined based on the minimum optical density of each sample. The sensitivity was evaluated by a logarithm of a reciprocal of exposure indicated by lux and seconds for providing an optical density equal to fog plus 0.1, and indicated as a relative value in the case where the value of the coated sample 701 was regarded as 700. Further, the RMS granularity of each sample was measured at an optical density equal to fog plus 0.2, and indicated as a relative value in the case where the value of the coated sample 701 was regarded as 100. Dmax was determined based on the maximum optical density of the sample. These results are shown in Table 12.

| Developer | |
|---|---|
| Metol | 2.5 g |
| L-ascorbic acid | 10.0 g |
| Nabox (a product of Fuji Photo Film Co., Ltd.) | 35.0 g |
| KBr | 1.0 g |

Water was added to the above to be 1 L in total, and the pH was controlled to 9.6.

TABLE 12

| Sample No. | Modified gelatin | Sensitivity | Fog | Dmax | RMS | Remarks |
|---|---|---|---|---|---|---|
| 701 | Original gelatin A | 100 | 0.15 | 1.1 | 100 | Comp. |
| 702 | Modified gelatin 1a | 115 | 0.13 | 1.5 | 78 | Inv. |
| 703 | Modified gelatin 1b | 117 | 0.13 | 1.5 | 76 | Inv. |
| 704 | Modified gelatin 1c | 119 | 0.13 | 1.5 | 72 | Inv. |
| 705 | Modified gelatin 1d | 118 | 0.13 | 1.5 | 75 | Inv. |
| 706 | Modified gelatin 1e | 104 | 0.15 | 1.2 | 93 | Comp. |
| 707 | Modified gelatin 1f | 99 | 0.15 | 1.1 | 99 | Comp. |
| 708 | Comparative gelatin 1 | 97 | 0.15 | 1.1 | 103 | Comp. |

As is clear from the results shown in Table 12, the coated samples 702 to 705 using the emulsions to which the modified gelatin of the present invention {the modified gelatin made by introducing 0.2 to 1.0 mmol of 4-(5-mercapto-1-tetrazolyl)benzoic acid into 100 g of dried gelatin} was added have a low fog, high sensitivity and high Dmax in comparison with the samples 701 and 706–708 using the comparative emulsions. Further, the samples 702 to 705 were also excellent in the RMS granularity. This reflects that the technique of the present invention prevented aggregation of tabular grains of a high aspect ratio, which is generated during adsorption of the sensitizing dyes.

The emulsions Em-2 to 5 were subjected to optimum chemical sensitization, used as the emulsion of the sixth layer of the sample 201 in Example 2 of JP-A-9-146237, and subjected to the same process as the Example, and a good result was obtained.

EXAMPLE 7

The effects of the tabular grain emulsion of claim 7 and the modified gelatin of the present invention will now be shown.

(Preparation of Emulsion A<{100} Silver Chloride Tabular Grains Cub=0.500 μm [AgCl]>)

1.7 liter of H20, 35.5 g of original gelatin 1 (whose methionine content was approximately $40\times10^{-6}$ mol/g) of Example 1, 1.4 g of sodium chloride, and 6.4 mL of nitric acid 1N solution were put into a reaction vessel (pH is 4.5), and maintained at a constant temperature of 29° C. Next, a silver nitrate aqueous solution (A-1 solution: silver nitrate 0.2 g/mL) and a sodium chloride aqueous solution (M-1 solution: sodium chloride 0.069 g/mL) were added while being agitated at the rate of 68.2 mL/minute for 45 seconds. After 2 minutes thereof, P-2 solution (potassium bromide: KBr 0.021 g/mL) was added at 186 cc/minute for 14 seconds. Further, after 3 minutes, A-2 solution (silver nitrate 0.4 g/mL) and M-3 solution (sodium chloride: 0.15 g/mL) were simultaneously added, while being mixed, at the rate of 34 mL/minute for 135 seconds. As a ripening step, after 1 minute, gelatin aqueous solution G-1 ($H_2O$ 120 mL, gelatin 1 is 20 g, NaOH 1N solution 7 mL, and NaCl 1.7 g) was added, and the solution was raised to be 75° C. in 15 minutes, and subjected to ripening for 10 minutes. Then, as a growth step, 466 mL of A-3 solution (silver nitrate 0.4 g/mL) was added while the flow rate was increased in a straight-line manner from 5.0 mL/minute to 9.5 mL/minute, and simultaneously M-4 solution (sodium chloride: 0.15 g/mL) was added while the silver potential was maintained at 120 mV. Further, 142 mL of A-4 solution (silver nitrate 0.4 g/mL) was added while the flow rate was increased in a straight-line manner from 5.0 mL/minute to 7.4 mL/minute, and simultaneously M-5 solution (sodium chloride: 0.14 g/mL) was added so that the silver potential decreases in a straight-line manner from 120 mV to 100 mV.

Thereafter, sedimentation and washing were performed at 40° C., and the emulsion was subjected to desalting. Then, 130 g of gelatin 1 was added, the emulsion was re-dispersed to control the pH to 6.0 and the pAg to 7.0.

Then, a part of the emulsion was taken, and an electronic microscope photographic image (TEM image) of replica of the grains was observed. According to the image, 95.1% of the total projected area of all the silver halide grains A is occupied with tabular grains having principal planes being (111) faces and aspect ratio of 2 or more. The grains A have an average grain size of 0.94 μm, average grain thickness of 0.180 μm, average aspect ratio of 5.1, average adjacent side ratio of 1.15, and cube-converted side length of 0.500 μm.

(Preparation of emulsion B:<{100} Silver Chloride Tabular Grains Cub=0.505 μm [$AgCl_{98.6}Br_1I_{0.4}$]>).

In preparation of emulsion A, 459 mL of A-3 solution was added while the flow rate was increased in a straight-line manner from 5.0 mL/minute to 9.5 mL/minute, and simultaneously M-4 solution was added while the silver potential was maintained at 120 mV Thereafter, 142 mL of A-4 solution and 142 mL of silver iodide fine-grain emulsion serving as P-7 solution and containing 0.0067 mol of silver iodide were added while the flow rate is increased in a straight-line manner from 5.0 mL/minute to 7.4 mL/minute, and simultaneously M-5 solution was added so that the silver potential was decreased in a straight-line manner from 120 mV to 100 mV. Thereafter, A-5 solution (silver nitrate 0.08 g/mL) and P-8 solution (potassium bromide 0.056 g/mL) were added for 1 minute at the rate of 35.5 mL/minute. The emulsion B was prepared in the same manner as the preparation method of emulsion A except the above. In the grains B obtained as described above, 95.2% of the total projected area of all the silver halide grains was occupied with tabular grains having principal planes being {100} faces and aspect ratio of 2 or more. The average grain size of the grains B was 0.94 μm, average grain thickness was 0.185 μm, average aspect ratio was 5.1, average adjacent side ratio was 1.14, and cube-converted side length was 0.505 μm.

(Preparation of emulsion C:<{111} Silver Chloride Tabular Grains Cub=0.450 μm [AgCl]>)

1.2 liter of $H_2O$, 1.0 g of sodium chloride and 2.5 g of gelatin 1 were added into a reaction vessel, and a silver nitrate aqueous solution (B-1 solution: silver nitrate 0.24 g/mL) and sodium chloride aqueous solution (N-1 solution: a mixture of 0.083 g/mL of sodium chloride and 0.01 g/mL of inactive gelatin) were added, while being agitated, at 75 mL/minute for 1 minute, into the reaction vessel maintained at 30° C. One minute later of completion of addition, 20 mL of an aqueous solution (K-1) containing 0.9 millimole of the crystal-habit control agent (iii) of the present invention was added. Further, after 1 minute, 340 mL of a 10% aqueous solution (HG-1) of the gelatin 2 of Example 2, and 2.0 g of sodium chloride were added. In the next 25 minutes, the temperature in the reaction vessel was raised to 55° C., and ripening was performed for 30 minutes at 55° C. As a growth step, 524 mL of B-2 solution (silver nitrate 0.4 g/mL) and 451 mL of N-2 solution (sodium chloride 0.17 g/mL) were added at a flow rate accelerated over 27 minutes. During this step, 285 mL of an aqueous solution (K-2) containing 2.1 millimole of the crystal-habit control agent 1 was simultaneously added at an accelerated flow rate (proportional to the silver nitrate addition amount). Further, 142 mL of B-3 solution (silver nitrate 0.4 g/mL) was added while the flow rate was increased in a straight-line manner from 10.0 mL/minute to 15 mL/minute, and simultaneously N-3 solution (sodium chloride 0.14 g/mL) was added so that the silver potential was decreased in a straight-line manner from 100 mV to 85 mV.

Thereafter, sedimentation and washing were performed at 30° C., and the emulsion was subjected to desalting. Further, 130 g of gelatin 1 was added to control the pH to 6.3 and pAg to 7.2. In the emulsion C obtained as described above, 98.2% or more of the total projected area was occupied with tabular grains having principal planes being {111} faces and aspect ratio of 2 or more. The average grain size of emulsion C was 0.97 μm, average grain thickness was 0.123 μm, average aspect ratio was 7.2, and cube-converted side length was 0.450 μm.

(Preparation of Emulsion D:<{111} Silver Chloride Tabular Grains Cub=0.452 μm [$AgCl_{98.6}Br_1I_{0.4}$]>)

In preparation of emulsion D, 516 mL of B-2 solution and 445 mL of N-2 solution were added at an accelerated flow rate for 27 minutes. During this step, 280 mL of K-2 solution was simultaneously added at an accelerated flow rate (proportional to the silver nitrate addition amount). Further, 142 mL of B-3 solution and P-7 solution were added while the flow rate was increased in a straight-line manner from 10.0 mL/minute to 15 mL/minute, and simultaneously N-3 solution was added so that the silver potential is decreased in a straight-line manner from 100 mV to 85 mV. Thereafter, B-4 solution (silver nitrate 0.08 g/mL) and P-8 solution were added for 1 minute at 35.5 mL/minute. The emulsion D was prepared in the same manner as the preparation method of emulsion G except the above. In the grains D obtained as described above, 97.6% of the total projected area of all the silver halide grains was occupied by tabular grains having principal planes being {111} faces and aspect ratio of 2 or more, and the average grain size of the grains D was 0.92 μm, average grain thickness was 0.139 μm, average aspect ratio was 6.7, and cube-converted side length was 0.452 μm.

Chemical sensitization and spectral sensitization of the above emulsions A to D will be described. $9.6\times10^{-5}$ mol/molAg of gold sensitizer (colloidal pyrites) and $1.7\times10^{-4}$ mol/molAg in total of red-sensitive spectral sensitizing dyes G and H were added to each of these emulsions, and the emulsions were subjected to optimum chemical sensitization and spectral sensitization at 60° C. Further, $5.9\times10^{-4}$ mol/molAg of 1-(3-methylureidephenyl)-5-mercaptotetrazole was added to each emulsion.

(Sensitizing dye G)

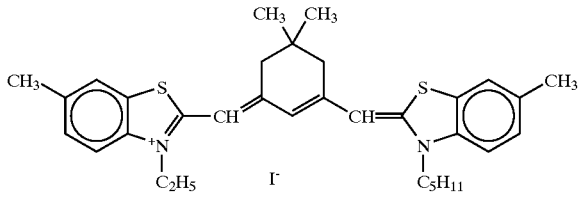

(Sensitizing dye H)

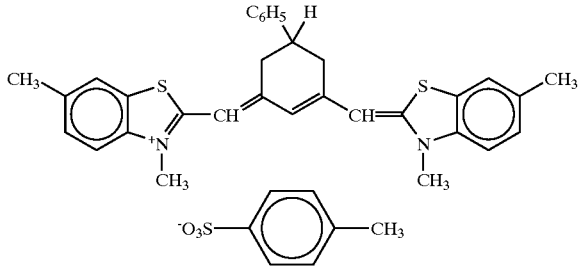

The surface of a base made by coating both sides of paper with polyethylene resin was subjected to corona discharge, and thereafter a gelatin substratum containing sodium dodecylbenzenesulfonate was provided on the surface of the base. Further, first to seventh photographic structure layers were successively coated on the surface to form sample 801 of a silver halide color photographic light-sensitive material having the following layer structure. Coating solutions for the photographic structure layers were prepared as follows.

Preparation of First-layer Coating Solution 57 g of yellow coupler (ExY), 7 g of dye-image stabilizer (Cpe-1), 4 g of dye-image stabilizer (Cpe-2), 7 g of dye-image stabilizer (Cpe-3) and 2 g of dye-image stabilizer (Cpe-8) were dissolved in 21 g of solvent (Solv-1) and 80 mL of ethyl acetate. This solution was emulsion-dispersed into 220 g of 23.5 mass % gelatin aqueous solution containing 4 g of sodium dodecylbenzenesolfonate, and water was added to the solution to prepare 900 g of emulsion-dispersed substance A.

In the meantime, the emulsion-dispersed substance A and the emulsion A were mixed and dissolved to prepare the first-layer coating solution to have the composition described below. The emulsion coating amount is indicated by the coating amount in terms of silver amount.

The coating solutions of the second to seventh layers were prepared in the same manner as that of the first-layer coating solution. As gelatin-hardening agents for each layer, 1-oxy-3,5-dichloro-s-triazinesodium salt (Ha-1), (Ha-2), and (ha-3) were used. Further, Ab-1, Ab-2, Ab-3 and Ab-4 were added to each layer so that the total amounts thereof are 15.0 mg/m$^2$, 60.0 mg/m$^2$, 5.0 mg/m$^2$ and 10.0 mg/m$^2$ respectively.

(Ha-1) Hardening agent

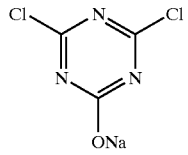

(use of 1.4% by mass of (Ha-1) per gelatin)

(Ha-2) Hardening agent (HA-25)

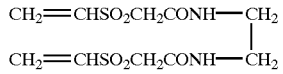

(Ha-3) Hardening agent

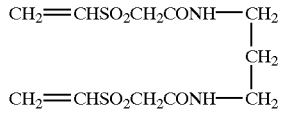

(Ab-1) Antiseptics

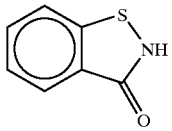

(Ab-2) Antiseptics

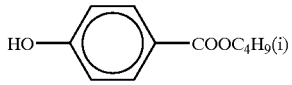

(Ab-3) Antiseptics

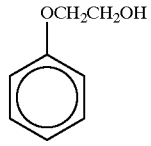

(Ab-4) Antiseptics

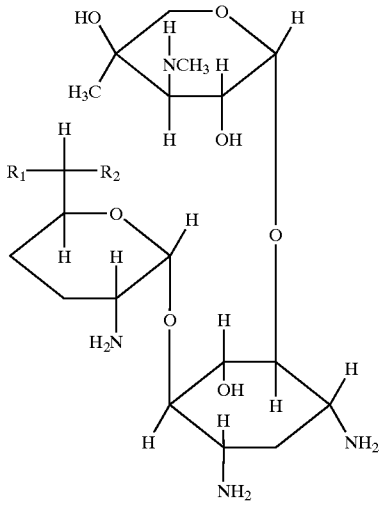

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

A mixture of a, b, c and d having a molar ratio of 1:1:1:1

The following spectral sensitizing dyes were used as respective silver chlorobromide emulsions of the light-sensitive emulsion layers.

Blue-sensitive Emulsion Layer

Sensitizing dye A

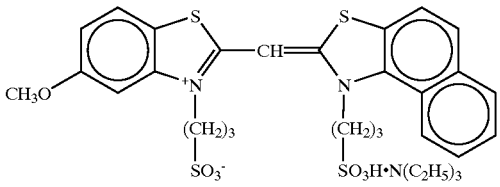

Sensitizing dye B

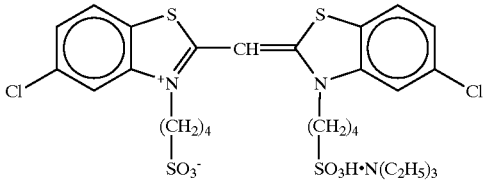

-continued

Sensitizing dye C

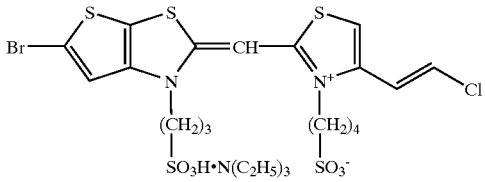

Crystal habit-control agent 1

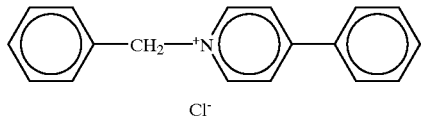

($0.42\times10^{-4}$ mol of each of the sensitizing dyes A and C was added per mol of silver halide. Further, $3.4\times10^{-4}$ mol of the sensitizing dye B was added per mol of silver halide.).

Green-sensitive Emulsion Layer (Sensitizing dye D)

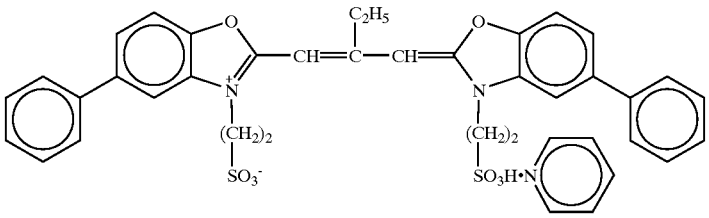

(Sensitizing dye E)

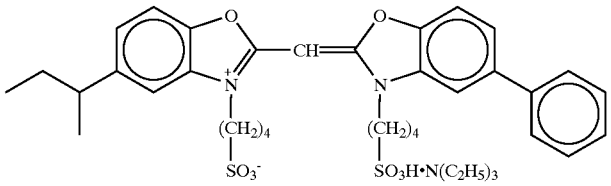

(Sensitizing dye F)

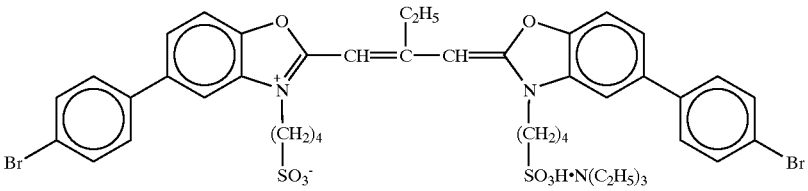

($3.0\times10^{-4}$ mol of the sensitizing dye D was added per mol of silver halide to large-size emulsion F, and $3.6\times110^{-4}$ mol to small-size emulsion G. Further, $4.0\times10^{-5}$ mol of the sensitizing dye E was added per mol of silver halide to the large size emulsion, and $7.0\times10^{-5}$ mol to the small-size emulsion. Furthermore, $2.0\times10^{-4}$ mol of the sensitizing dye F was added per mol of silver halide to the large-size emulsion, and $2.8\times10^{-4}$ mol to the small-size emulsion.)

Red-sensitive Emulsion Layer ($1.1\times10^{-4}$ mol of each of the sensitizing dyes G and H was added per mol of silver halide to small-size emulsion H.)

Further, $3.0\times10^{-3}$ mol of the following compound I was added to the red-sensitive emulsion layer per mol of silver halide.

(Compound I)

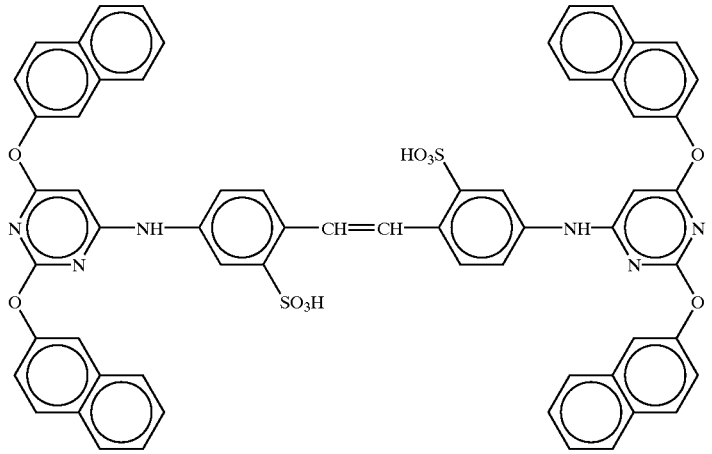

Furthermore, $3.3\times10^{-4}$ mol, $1.0\times10^{-3}$ mol and $5.9\times10^{-4}$ mol of 1-(3-methylureidophenyl)-5-mercaptotetrazole were added per mol of silver halide to the blue-sensitive emulsion layer, green-sensitive emulsion layer and red-sensitive emulsion layer respectively.

Further, it was added to the second layer, fourth layer, sixth layer and seventh layer in the amounts of 0.2 mg/m$^2$, 0.2 mg/m$^2$, 0.6 mg/m$^2$ and 0.1 mg/m$^2$, per mol of silver halide, respectively.

4-hydroxy-6-methyl-1,3,3a,7-tetrazaindene was added to the blue-sensitive emulsion layer and the green-sensitive emulsion layer in the amounts of $1\times10^{-4}$ mol and $2\times10^{-4}$ mol, per mol of silver halide, respectively.

Further, 0.05 g/m$^2$ of copolymer latex of methacrylic acid and butyl acrylate (mass ratio 1:1, average molecular weight 200000–400000) was added to the red-sensitive layer.

Furthermore, catechol-3,5-disodium disulfate was added to the second layer, fourth layer and sixth layer in the amounts of 6 mg/m$^2$, 6 mg/m$^2$, and 18 mg/m$^2$ respectively.

In order to prevent irradiation, the following dyes were also added (the figures in parentheses indicate the coating amounts).

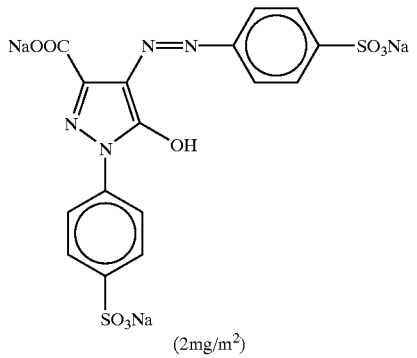

(2mg/m$^2$)

-continued

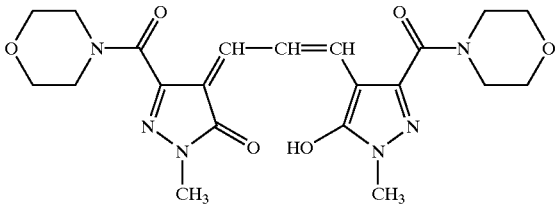

(2mg/m$^2$)

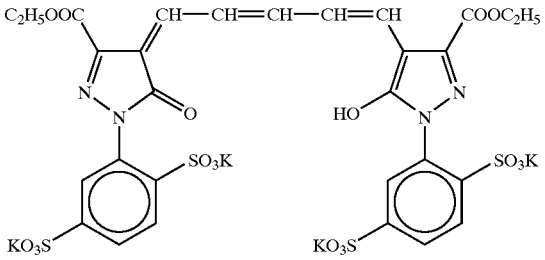

(3mg/m$^2$)

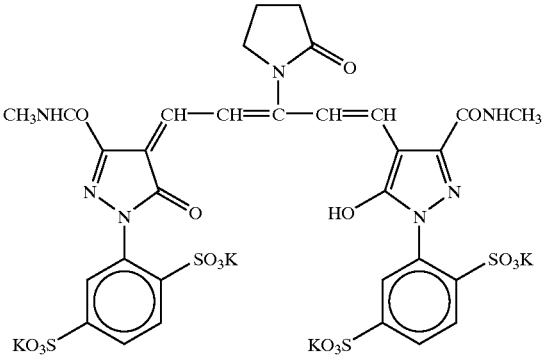

(7mg/m$^2$)

(Layer Structure)

The structure of each layer will be shown below. The figures indicate the coating amounts ($g/m^2$). The coating amount of the silver halide emulsion is indicated by the coating amount in terms of silver.

Base Polyethylene Resin-laminated Paper

[polyethylene resin on the first-layer side contains a white pigment ($TiO_2$; content 16 mass %, ZnO; content 4 mass %), a brightening agent (4.4'-bis(5-methylbenzooxazolyl) stilbene, content 0.03 mass %), and bluish dye (ultramarine blue).]

| | |
|---|---|
| 1st layer (blue-sensitive emulsion layer) | |
| Silver chlorobromide emulsion E (emulsion comprising cubes and having an average grain size of 0.74 μm, and coefficient of variation in the grain size distribution of 0.08, wherein 0.3 mol % of silver bromide was contained in the state of being localized in a part of the grain surfaces mainly formed of silver chloride) | 0.24 |
| Gelatin | 1.25 |
| Yellow coupler (ExY) | 0.57 |
| Dye-image stabilizer (Cpe-1) | 0.07 |
| Dye-image stabilizer (Cpe-2) | 0.04 |
| Dye-image stabilizer (Cpe-3) | 0.07 |
| Dye-image stabilizer (Cpe-8) | 0.02 |
| Solvent (Solv-1) | 0.21 |
| 2nd layer (color-mixing inhibitive layer) | |
| Gelatin | 0.99 |
| Color-mixing inhibitor (Cpe-4) | 0.09 |
| Dye-image stabilizer (Cpe-5) | 0.018 |
| Dye-image stabilizer (Cpe-6) | 0.13 |
| Dye-image stabilizer (Cpe-7) | 0.01 |
| Color-mixing inhibitor (Cpe-19) | 0.02 |
| Solvent (Solv-1) | 0.06 |
| Solvent (Solv-2) | 0.22 |
| 3rd layer (green-sensitive emulsion layer) | |
| Silver chloroiodobromide emulsion {1:3 mixture (silver mol ratio) of the large-size emulsion F having an average grain size of 0.45 μm and the small-size emulsion G having an average grain size of 0.35 μm, comprising gold sulfur-sensitized cubes. The coefficients of variation in the grain size distribution of the emulsions F and G are 0.10 and 0.08 respectively. Each size of the emulsions contains 0.15 mol % of silver iodide in the vicinity of the grain surfaces, and 0.4 mol % of silver bromide in the state of being localized in the grain surfaces.} | 0.14 |
| Gelatin | 1.36 |
| Magenta coupler (ExM) | 0.15 |
| Ultraviolet absorbent (UV-A) | 0.14 |
| Dye-image stabilizer (Cpe-2) | 0.02 |
| Dye-image stabilizer (Cpe-4) | 0.002 |
| Dye-image stabilizer (Cpe-6) | 0.09 |
| Dye-image stabilizer (Cpe-8) | 0.02 |
| Dye-image stabilizer (Cpe-9) | 0.03 |
| Dye-image stabilizer (Cpe-10) | 0.01 |
| Dye-image stabilizer (Cpe-11) | 0.0001 |
| Solvent (Solv-3) | 0.11 |
| Solvent (Solv-4) | 0.22 |
| Solvent (Solv-5) | 0.20 |
| 4th layer (color-mixing inhibitive layer) | |
| Gelatin | 0.71 |
| Color-mixing inhibitor (Cpe-4) | 0.06 |
| Dye-image stabilizer (Cpe-5) | 0.013 |
| Dye-image stabilizer (Cpe-6) | 0.10 |
| Dye-image stabilizer (Cpe-7) | 0.007 |
| Color-mixing inhibitor (Cpe-19) | 0.02 |
| Solvent (Solv-1) | 0.04 |
| Solvent (Solv-2) | 0.16 |

-continued

| | |
|---|---|
| 5th layer (red-sensitive emulsion layer) | |
| Silver chloroiodobromide emulsion {5:5 mixture (silver mol ratio) of the emulsion A and the small-size emulsion H having an average grain size of 0.30 μm, comprising gold sulfur-sensitized cubes. The coefficients of variation in the grain size distribution of the emulsions A and H are 0.09 and 0.11 respectively. The emulsion H contains 0.1 mol % of silver iodide in the vicinity of the grain surfaces, and 0.8 mol % of silver bromide in the state of being localized in the grain surfaces.} | 0.12 |
| Gelatin | 1.11 |
| Cyan coupler (ExC-a) | 0.13 |
| Cyan coupler (ExC-b) | 0.03 |
| Dye-image stabilizer (Cpe-1) | 0.05 |
| Dye-image stabilizer (Cpe-6) | 0.06 |
| Dye-image stabilizer (Cpe-7) | 0.02 |
| Dye-image stabilizer (Cpe-9) | 0.04 |
| Dye-image stabilizer (Cpe-10) | 0.01 |
| Dye-image stabilizer (Cpe-14) | 0.01 |
| Dye-image stabilizer (Cpe-15) | 0.12 |
| Dye-image stabilizer (Cpe-16) | 0.03 |
| Dye-image stabilizer (Cpe-17) | 0.09 |
| Dye-image stabilizer (Cpe-18) | 0.07 |
| Solvent (Solv-5) | 0.15 |
| Solvent (Solv-8) | 0.05 |
| 6th layer (Ultraviolet absorptive layer) | |
| Gelatin | 0.46 |
| Ultraviolet absorbent (UV-B) | 0.25 |
| Ultraviolet absorbent (UV-C) | 0.20 |
| Compound (S1-4) | 0.0015 |
| Solvent (Solv-7) | 0.25 |
| 7th layer (protective layer) | |
| Gelatin | 1.00 |
| Acryl denaturated copolymer of poly(vinyl alcohol) (degree of denaturation: 17%) | 0.04 |
| Liquid paraffin | 0.02 |
| Surfactant (Cpe-13) | 0.01 |

(ExY) Yellow coupler

A mixture of

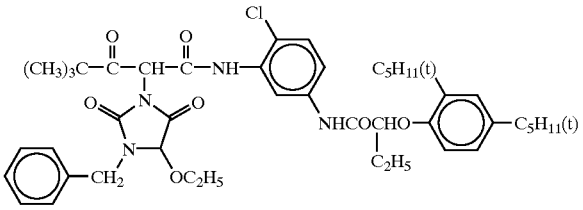

and

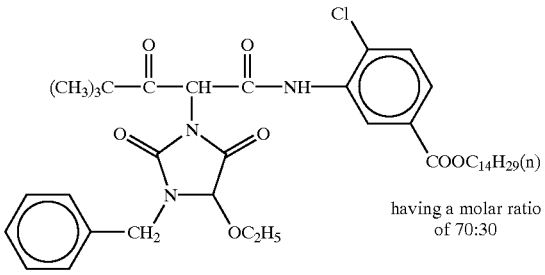

having a molar ratio of 70:30

(ExM) Magenta coupler

A mixture of

-continued

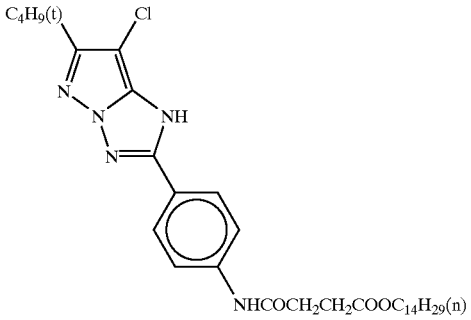

and

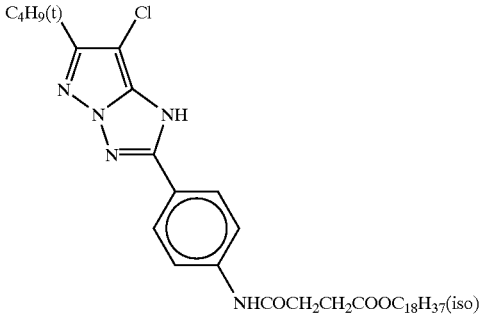

and

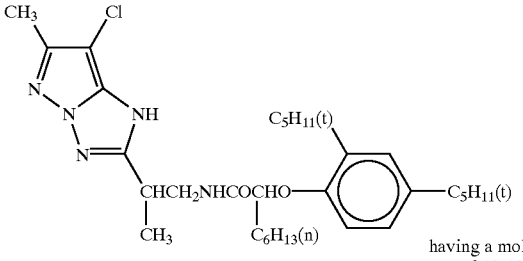

having a molar ratio of 40:40:20

(ExC-a) Cyan coupler

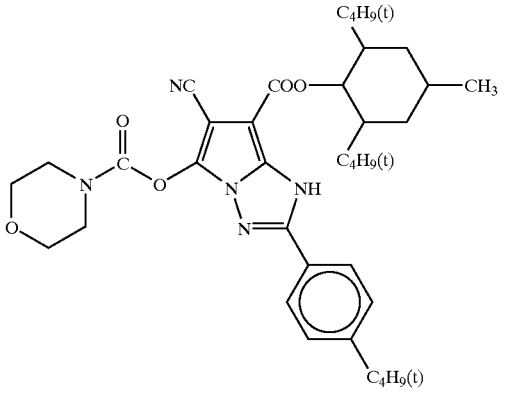

(ExC-b) Cyan coupler

A mixture of

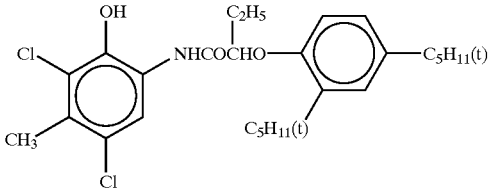

and

-continued

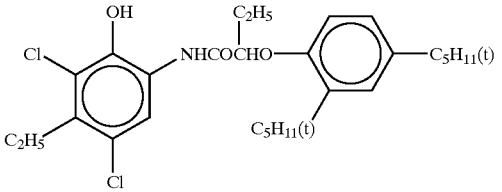

and

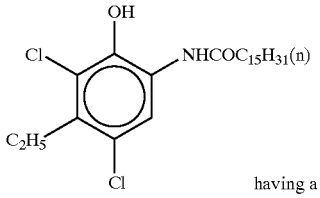

having a molar ratio of 50:25:25

(Cpe-1) Dye-image stabilizer

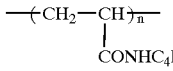

number average molecular weight 60,000

(Cpe-2) Dye-image stabilizer

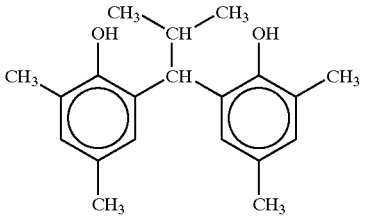

(Cpe-3) Dye-image stabilizer

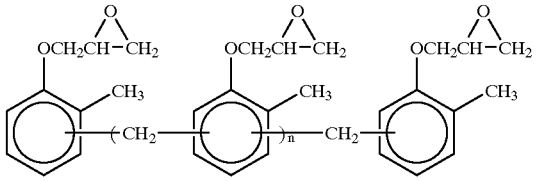

n = 7 to 8 (average value)

(Cpe-4) Color mixture preventive

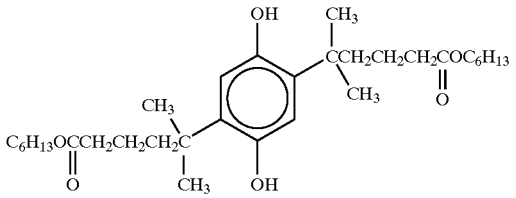

(Cpe-5) Dye-image stabilizer

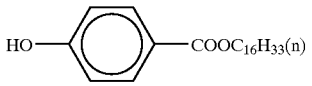

(Cpe-6) Dye-image stabilizer

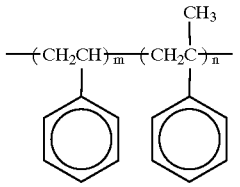

number average molecular weight 600
m/n = 10/90

-continued
(Cpe-7) Dye-image stabilizer
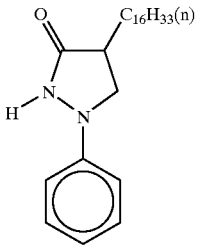
(Cpe-8) Dye-image stabilizer
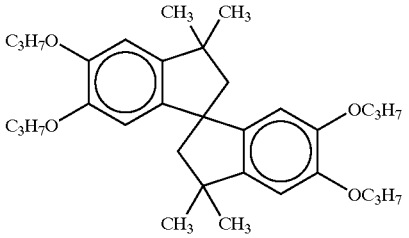
(Cpe-9) Dye-image stabilizer
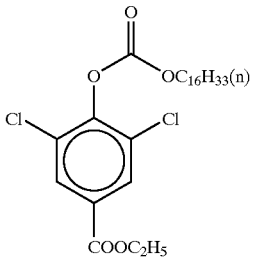
(Cpe-10) Dye-image stabilizer
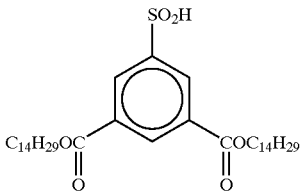
(Cpe-11)
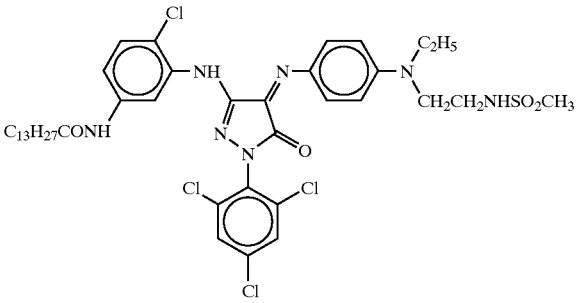
-continued
(Cpe-13) Surfactant
A mixture of
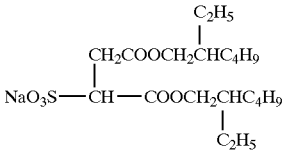
and
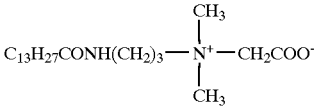
having a molar ratio of 7:3
(Cpe-14)
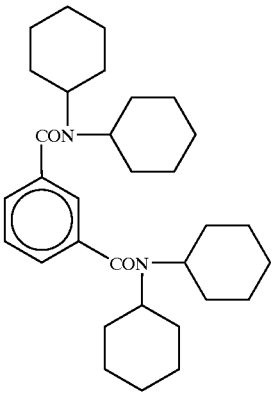
(Cpe-15)
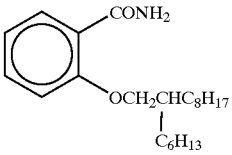
(Cpe-16)
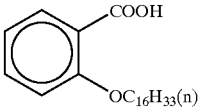
(Cpe-17)
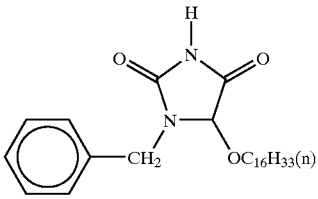
(Cpe-18)
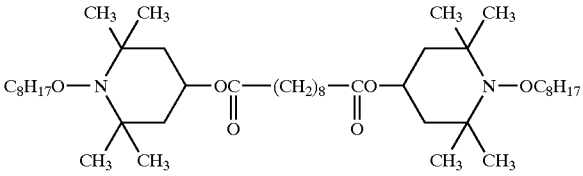

-continued (Cpe-19) Color mixture preventive

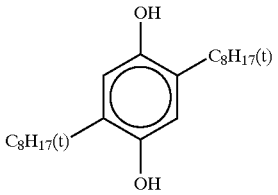

(UVa-1) Ultraviolet absorbent

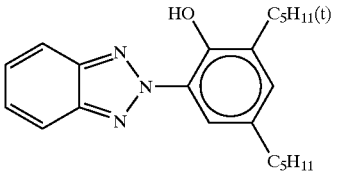

(UVa-2) Ultraviolet absorbent

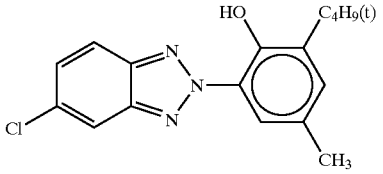

(UVa-3) Ultraviolet absorbent

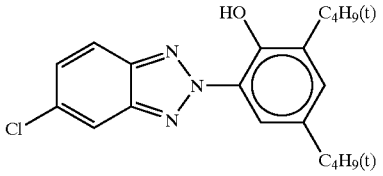

(UVa-4) Ultraviolet absorbent

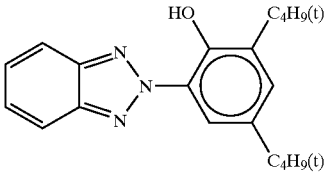

(UVa-5) Ultraviolet absorbent

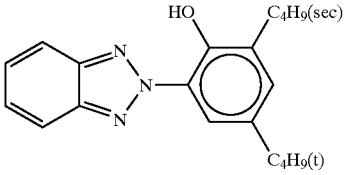

(UVa-6) Ultraviolet absorbent

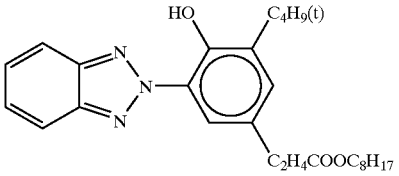

-continued (UVa-7) Ultraviolet absorbent

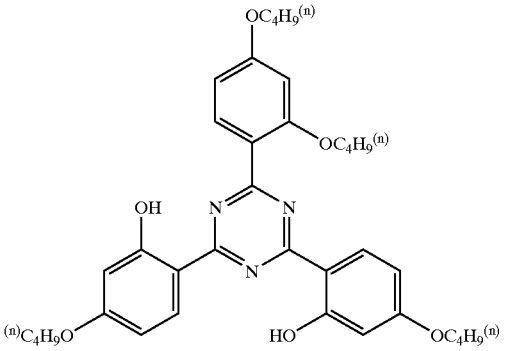

UV-A: a mixture of UVa-1/UVa-2/UVa-3/UVa-4 = 4/2/2/3 in a molar ratio
UV-B: a mixture of UVa-1/UVa-2/UVa-3/UVa-4/UVa-5/UVa-6 = 9/3/3/4/5/3 in a molar ratio
UV-C: a mixture of UVa-2/UVa-3/UVa-6/UVa-7 = 1/1/1/2 in a molar ratio (Solv-1)

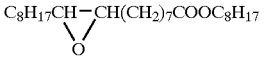

(Solv-2)

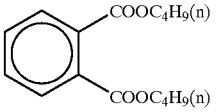

(Solv-3)

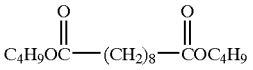

(Solv-4)

(Solv-5)

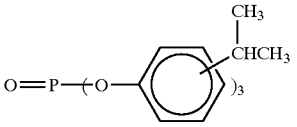

(S1-4)

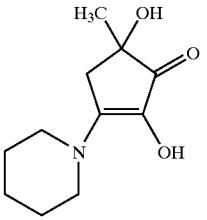

(Solv-7)

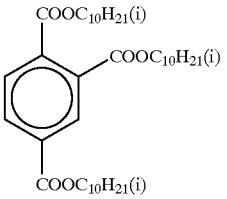

-continued (Solv-8)

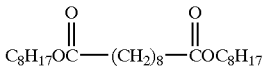

(Preparation of Samples 802 to 804)

Samples 802 to 804 were prepared in the same manner as sample 801, except that the emulsion A of sample 801 was changed to emulsions B to D respectively so as to have the same silver amount.

Each of these samples 801–804 was processed into a roll of 127 mm width, and subjected to gradation exposure for sensitometry by using minilab printer processor PP1258AR manufactured by Fuji Photo Film Co., Ltd. The samples were subjected to exposure for seconds with a SP-1 filter. Then, color development was performed with the processing steps and the developer described in Example 1 of JP-A-2001-42481.

Evaluation of Deterioration in Aggregation of Grains at the Time of Coating (Preparation of Samples 811–814)

In each of the samples 801 to 804, the emulsion of the respective fifth layers were dissolved at 40° C. and maintained for 8 hours, and then samples 811–814 were prepared under the same coating conditions as those of samples 801 to 804 respectively.

(Preparation of Samples 821–824)

Emulsions A'–D' were prepared in the same manner as the emulsions A–D, except that 30 g of gelatin in the gelatin 1 after sedimentation, washing and desalting was substituted by the modified gelatin 1c of the present invention respectively.

The emulsion A of the sample 801 was substituted by each of the emulsions A'–D' in the same manner so that the silver amount of each of the emulsions A'–D' is the same as that of the emulsion A, and the emulsion of each fifth layer was dissolved at 40° C. and left for 8 hours. Thereafter, samples 821 to 824 were prepared.

The evaluation of effects of preventing aggregation of the tabular grains will be described.

Photographs of a cross section of each multi-layer light-sensitive material of the samples 811–814 and 821–824 were taken by a scanning electronic microscope, and the dispersion property of the tabular grains of each fifth layer was observed to perform evaluation. The photographs of the cross section of each material were taken with a magnification of 3000, and an average aggregate number per field of view was determined from the cross-sectional photographs of at least 5 fields of view. The term "aggregate" indicates the state in which principal planes of at least three tabular grains adhere to one another.

In the samples 821–824 using the modified gelatin of the present invention, the number of aggregate was clearly decreased in comparison with those of the samples 811–814.

According to the present invention, it is possible to provide an excellent emulsion silver halide and light sensitive material of a high sensitivity and a small variation in the photographic property due to lapse of time. In particular, the modified gelatin of the present invention has an effect of inhibiting aggregation of silver halide grains after lapse of time of dissolution of the emulsion, and permits preparation of a silver halide emulsion which has been improved in the problem of deterioration in the photographic property in coating and is excellent in suitability for preparation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A modified gelatin obtained by reacting (A) a gelatin and (B) a compound which contains a nitrogenous aromatic ring having a mercapto group to a form covalent bond with a reactive group in the gelatin, wherein the modified gelatin is represented by the following formula (I):

$$\text{Gel-L}^1\text{-(L}^2\text{-Z-SH)}_n \qquad \text{(I)}$$

Where Gel represents a gelatin, $L^1$ represents a group selected from —C(═O)O—, —NH—, —N═, —N<, —O—, —S—, —NH—C(═$NH_2^+$)NH— and —NH—C(═NH)NH— existing in the gelatin, $L^2$ represents a divalent or trivalent coupling group, Z represents a nitrogenous aromatic heterocycle group, n is 1 or 2, and the amount of the modifying group represented by $L^2$-Z-SH is from $1.0\times10^{-6}$ mol to $2.0\times10^{-3}$ mol per 100 g of the gelatin.

2. A modified gelatin represented by the following formula (II):

(II)

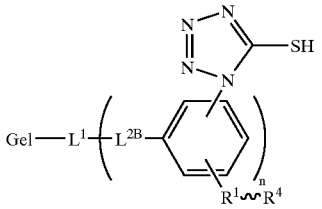

where Gel represents a gelatin $L^1$ represents a group selected from —C(═O)O—, —NH—, —N═, —N<, —O—, —S—, —NH—C(═$NH_2$+)NH— and —NH—C(═NH)NH— existing in the gelatin, $L^{2B}$ represents a divalent or trivalent coupling group, each of $R^1$, $R^2$, $R^3$ and $R^4$ independently represents a hydrogen atom or a substituent, n is 1 or 2, and the amount of the modifying group indicated in parentheses is from $1.0\times10^{-6}$ mol to $2.0\times10^{-3}$ mol per 100 g of the gelatin.

3. The modified gelatin according to claim 1, having a molecular weight distribution obtained by measuring on the basis of the PAGI method, wherein a high-molecular-weight component having a molecular weight of about 2,000,000 or more is 3% to 30%, and a low-molecular-weight component having a molecular weight of about 100,000 or less is 55% or less.

4. The modified gelatin according to claim 1, wherein the group of the compound, which contains a nitrogenous aromatic ring having a mercapto group that can form a covalent bond with the reactive group contained in the gelatin, is selected from the group consisting of an aldehyde group, acetal group, epoxy group, isocyanate group, activated halogen group, activated ester, ethyleneimino group, active olefin group, acid halide, sulfonic acid ester, acid anhydride, isothiocyanate group, carboxylic acid activated by a condensing agent, sulfonic acid activated by a condensing agent, and phosphoric acid activated by a condensing agent.

* * * * *